US010641040B2

(12) United States Patent
Holt et al.

(10) Patent No.: US 10,641,040 B2
(45) **Date of Patent: *May 5, 2020**

(54) COVERING FOR AN ARCHITECTURAL OPENING HAVING NESTED TUBES

(71) Applicant: HUNTER DOUGLAS INC., Pearl River, NY (US)

(72) Inventors: Ronald Holt, Westminster, CO (US); Marcus Long, Erie, CO (US); Stephen T. Wisecup, Niwot, CO (US)

(73) Assignee: HUNTER DOUGLAS INC., Pearl River, NY (US)

( * ) Notice: Subject to any disclaimer, the term of this patent is extended or adjusted under 35 U.S.C. 154(b) by 214 days.

This patent is subject to a terminal disclaimer.

(21) Appl. No.: 15/615,077

(22) Filed: Jun. 6, 2017

(65) Prior Publication Data

US 2017/0268292 A1 Sep. 21, 2017

Related U.S. Application Data

(63) Continuation of application No. 15/008,914, filed on Jan. 28, 2016, now Pat. No. 9,702,187.

(Continued)

(51) Int. Cl.

*E06B 9/44* (2006.01)
*E06B 9/262* (2006.01)

(Continued)

(52) U.S. Cl.

CPC ..... *E06B 9/44* (2013.01); *E06B 9/262* (2013.01); *E06B 9/322* (2013.01); *E06B 9/34* (2013.01);

(Continued)

(58) Field of Classification Search

CPC ... E06B 9/34; E06B 9/44; E06B 9/262; E06B 9/322; E06B 9/56; E06B 9/264;

(Continued)

(56) References Cited

U.S. PATENT DOCUMENTS 824,930 A 7/1906 Hopkins
2,280,358 A 4/1942 Tietig (Continued)

FOREIGN PATENT DOCUMENTS

CA 2178167 A1 12/1996
CA 2656981 A2 1/2008

(Continued)

*Primary Examiner* — Johnnie A. Shablack

(57) ABSTRACT

A covering for an architectural covering is provided. The covering may include a rotatable outer tube, a rotatable inner tube, a shade attached to the outer tube, and an operating element secured to the inner tube. The outer tube may define an elongated slot extending along a length of the outer tube and opening to an interior of the outer tube. The inner tube may be received within the outer tube. The shade may be retractable to and extendable from the outer tube. The operating element may extend through the elongated slot and may be retractable onto and extendable from the inner tube. The inner tube may rotate relative the outer tube to open and close the shade once the support sheet is in a fully extended position.

47 Claims, 32 Drawing Sheets

Related U.S. Application Data

(60) Provisional application No. 62/116,335, filed on Feb. 13, 2015.

(51) Int. Cl.

| | |
|---|---|
| ***E06B 9/322*** | (2006.01) |
| ***E06B 9/34*** | (2006.01) |
| ***E06B 9/56*** | (2006.01) |
| *E06B 9/24* | (2006.01) |
| *E06B 9/40* | (2006.01) |

(52) U.S. Cl.
CPC ..... *E06B 9/56* (2013.01); *E06B 2009/2423* (2013.01); *E06B 2009/2452* (2013.01); *E06B 2009/2622* (2013.01); *E06B 2009/405* (2013.01)

(58) Field of Classification Search
CPC ..... E06B 9/30; E06B 2009/2423; E06B 2009/2447; E06B 2009/2458; E06B 2009/2452; E06B 2009/2622; E06B 2009/405; E06B 2009/2625; E06B 2009/2627
See application file for complete search history.

(56) References Cited

U.S. PATENT DOCUMENTS 2,503,101 A 4/1950 Drury
3,007,342 A 11/1961 Wardlaw
3,063,495 A 11/1962 Petrick
3,285,325 A 11/1966 Easton
3,965,960 A * 6/1976 Massey ..... A47K 3/38 160/295
4,020,889 A 5/1977 Karoll
4,237,956 A 12/1980 Sivin et al.
4,372,432 A 2/1983 Waine et al.
4,433,765 A 2/1984 Rude et al.
4,523,620 A * 6/1985 Mortellite ..... E06B 9/60 160/315
4,610,293 A 9/1986 Weiblen
4,813,468 A 3/1989 Fraser
5,167,269 A * 12/1992 Abo ..... E06B 9/90 160/305
5,205,334 A 4/1993 Judkins
5,228,936 A 7/1993 Goodhue
5,313,999 A 5/1994 Colson et al.
D348,371 S 7/1994 Judkins
5,419,385 A 5/1995 Vogel et al.
5,647,421 A 7/1997 Hoffmann et al.
5,787,951 A 8/1998 Tonomura et al.
5,791,390 A 8/1998 Watanabe
5,897,731 A 4/1999 Colson et al.
6,158,563 A * 12/2000 Welfonder ..... E06B 9/90 160/291
6,164,362 A 12/2000 Yang
D446,070 S 8/2001 Judkins
6,289,964 B1 9/2001 Colson et al.
6,435,252 B2 8/2002 Colson et al.
6,516,856 B2 2/2003 Lai
6,530,413 B2 3/2003 Hwang
6,651,720 B1 11/2003 DiSilvestro et al.
6,712,115 B2 3/2004 Judkins
6,792,994 B2 9/2004 Lin
6,834,701 B2 12/2004 Colson et al.
6,876,493 B1 4/2005 Lin
6,959,748 B2 11/2005 Hudoba
6,959,750 B2 11/2005 Colson
7,059,377 B2 6/2006 Mien et al.
7,063,122 B2 6/2006 Colson et al.
7,093,643 B2 8/2006 Ikle
7,100,663 B2 * 9/2006 Zhang ..... E06B 9/264 160/121.1
7,128,126 B2 10/2006 Smith et al.
7,143,802 B2 12/2006 Strand et al.
7,159,635 B2 1/2007 Holt et al.
7,500,505 B2 3/2009 Smith et al.
7,549,455 B2 6/2009 Harper et al.
7,571,756 B2 8/2009 Smith et al.
7,617,858 B2 11/2009 Hoffmann et al.
7,617,859 B2 11/2009 Auger
7,686,060 B2 3/2010 Anthony
7,740,044 B2 6/2010 Gutierrez
7,849,907 B2 12/2010 Jang
7,857,033 B2 12/2010 Malausa
8,020,602 B2 * 9/2011 Smith ..... E06B 9/262 160/121.1
D659,455 S 5/2012 Marocco
D659,456 S 5/2012 Marocco
8,171,640 B2 5/2012 Colson et al.
8,186,412 B2 5/2012 Lin
D711,156 S 8/2014 Judkins
8,820,386 B2 9/2014 Mullet et al.
9,259,833 B2 2/2016 Bonini et al.
9,567,802 B2 * 2/2017 Buccola, Jr. ..... E06B 9/322
9,702,187 B2 * 7/2017 Holt ..... E06B 9/262
9,739,089 B2 * 8/2017 Smith ..... E06B 9/60
9,909,361 B2 * 3/2018 Buccola, Jr. ..... E06B 9/322
9,963,935 B2 * 5/2018 Faller ..... E06B 9/80
2002/0189771 A1 12/2002 Colson et al.
2003/0000652 A1 1/2003 Hwang
2004/0079492 A1 4/2004 Lin
2004/0226663 A1 11/2004 Smith et al.
2005/0051281 A1 3/2005 Lai
2005/0087309 A1 4/2005 Nien et al.
2005/0139329 A1 6/2005 Hoffmann
2006/0027339 A1 2/2006 Hsu
2006/0137833 A1 6/2006 Nichols et al.
2007/0144686 A1 6/2007 Drew
2008/0053626 A1 3/2008 Jarosinski et al.
2008/0093030 A1 4/2008 Gutierrez
2008/0149280 A1 6/2008 Smith et al.
2008/0223532 A1 9/2008 Auger
2008/0251624 A1 * 10/2008 Fraczek ..... E06B 9/322 242/389
2011/0067820 A1 3/2011 Hsu et al.
2012/0118514 A1 5/2012 Hughes
2012/0222824 A1 9/2012 Lin
2012/0291964 A1 11/2012 Marocco
2012/0291965 A1 11/2012 Marocco
2013/0098564 A1 4/2013 Jang
2013/0306250 A1 11/2013 Mullet et al.
2014/0020854 A1 * 1/2014 Huang ..... E06B 9/262 160/308
2014/0053989 A1 2/2014 Colson et al.
2014/0166218 A1 6/2014 Ng
2014/0216666 A1 8/2014 Smith et al.
2014/0262066 A1 9/2014 Certain et al.
2014/0262068 A1 9/2014 Buccola, Jr. et al.
2014/0262069 A1 9/2014 Drew et al.
2014/0367053 A1 12/2014 Cha
2014/0367054 A1 12/2014 Cha
2015/0047792 A1 2/2015 Lukosiunas et al.
2015/0226001 A1 8/2015 Adams et al.
2015/0292261 A1 10/2015 Chou
2015/0376941 A1 12/2015 Fujita et al.
2018/0080278 A1 * 3/2018 Huang ..... E06B 9/322
2018/0106107 A1 * 4/2018 Smith ..... E06B 9/42
2018/0171703 A1 * 6/2018 Buccola, Jr. ..... E06B 9/322
2018/0258696 A1 * 9/2018 Faller ..... E06B 9/80
2018/0328106 A1 * 11/2018 Smith ..... E06B 9/38

FOREIGN PATENT DOCUMENTS

CA 2777454 A1 11/2012
CA 2779772 A1 3/2013
CA 2915204 A1 12/2014
CN 1397714 A 2/2003
CN 1720385 A 1/2006
DE 1093527 B 11/1960
EP 1455048 A2 9/2004
FR 1557062 A 2/1969
GB 2182738 A 5/1987

(56) References Cited

FOREIGN PATENT DOCUMENTS

| | | | |
|---|---|---|---|
| WO | 2006023751 | A2 | 3/2006 |
| WO | 2007038447 | A2 | 4/2007 |
| WO | 2014201253 | A2 | 12/2014 |

* cited by examiner

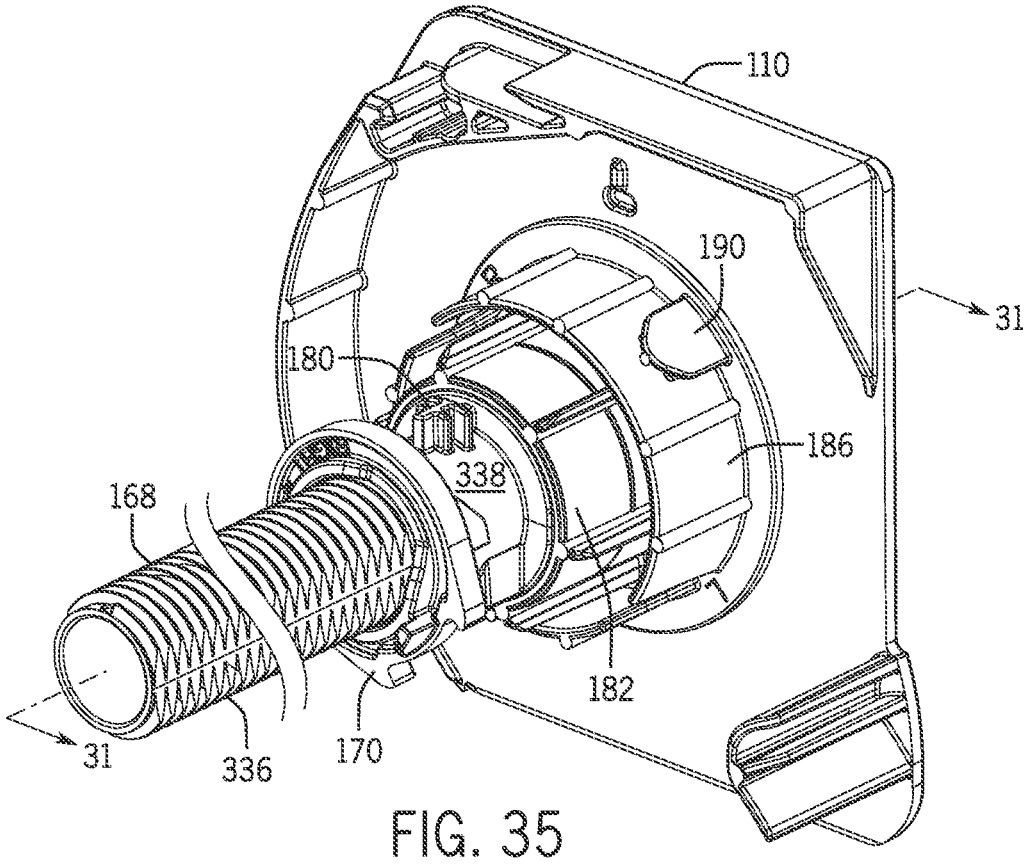
FIG. 35
FIG. 36
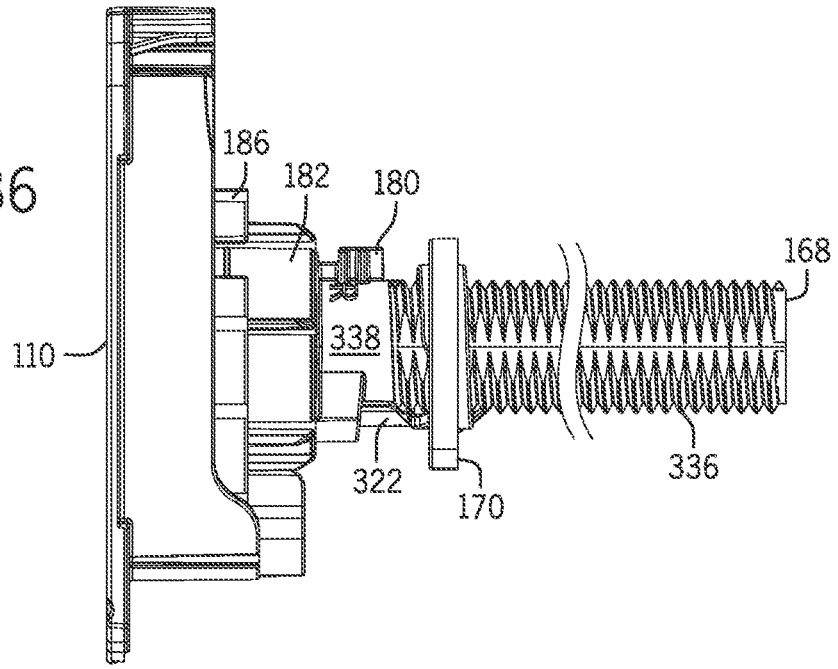

COVERING FOR AN ARCHITECTURAL OPENING HAVING NESTED TUBES

CROSS-REFERENCE TO RELATED APPLICATIONS

This is a continuation of pending U.S. patent application Ser. No. 15/008,914, filed Jan. 28, 2016, titled "Covering For An Architectural Opening Having Nested Tubes", which claims the benefit of priority under 35 U.S.C. § 119(e) of U.S. provisional patent application No. 62/116,335, filed 13 Feb. 2015, and entitled "Covering for an Architectural Opening Having Nested Tubes," which are hereby incorporated herein in their entirety.

FIELD

The present disclosure relates generally to coverings for architectural openings, and more particularly to a covering for an architectural opening having nested tubes.

BACKGROUND

Coverings for architectural openings, such as windows, doors, archways, and the like, have taken numerous forms for many years. Some coverings include a retractable shade that is movable between an extended position and a retracted position. In the extended position, the shade of the covering may be positioned across the opening. In the retracted position, the shade of the covering may be positioned adjacent one or more sides of the opening.

Some coverings include operable vanes that open and close to control the amount of light passing through the covering. When the vanes are in an open position, light may be transmitted through gaps defined in the covering between the vanes. When the vanes are in a closed position, the vanes may obstruct or prevent light from passing through the covering.

BRIEF SUMMARY

The present disclosure generally provides a covering for an architectural opening, such as a window, doorway, archway, or the like, that offers improvements and/or an alternative to existing coverings. The covering generally provides a nested tube configuration operable to open and/or close the covering to control the amount of light passing through the covering. In some arrangements, the nested tube configuration includes an inner tube and an outer tube that rotate relative to each other to open and/or close an associated shade. The inner and outer tubes may selectively engage each other such that the tubes rotate substantially in unison. The covering may include timing mechanisms to limit rotation of at least one of the tubes and may be operable to control at what point during extension or retraction of the shade the tubes may rotate relative to each other.

Examples of the disclosure may include a covering for an architectural opening having nested tubes. In some examples, the covering may include a rotatable outer tube defining an elongated slot extending along a length of the outer tube and opening to an interior of the outer tube; an inner tube rotatably received within the outer tube; a shade attached to the outer tube, the shade retractable to and extendable from the outer tube, the shade including a support sheet and at least one strip of material, the at least one strip of material including a first edge portion and a second edge portion, the first edge portion attached to the support sheet, and the second edge portion movable relative to the first edge portion and the support sheet; and at least one operating element attached to the inner tube, the at least one operating element extending through the elongated slot and operably attached to the second edge portion of one or more of the at least one strip of material. In some examples, rotation of the inner tube relative to the outer tube causes the second edge portion of the one or more of the at least one strip of material to move relative to the first edge portion of the one or more of the at least one strip of material.

In some examples, the covering includes a first engagement feature extending outwardly from the inner tube. In some examples, the first engagement feature includes one or more drive stubs positioned within an external groove extending along a length of the inner tube. In some examples, the covering includes a second engagement feature extending inwardly from the outer tube into a rotational path of the first engagement feature such that the first and second engagement features engage one another within one revolution of the inner tube relative to the outer tube. In some examples, the second engagement feature includes an internal rib extending longitudinally along the length of the outer tube. In some examples, the support sheet includes an upper edge portion attached to the outer tube. In some examples, the operating element extends along a face of the support sheet and is positioned at least partially between the support sheet and the plurality of strips of material.

In some examples, the covering includes one or more collars positioned at least partially radially between the outer and inner tubes. In some examples, the one or more collars include a plurality of collars spaced apart from one another along the length of the outer tube. In some examples, the plurality of collars substantially fills the gap between the outer tube and the inner tube to provide structural rigidity along the length of the outer tube. In some examples, the outer tube includes a first shell and a second shell. The one or more collars may be engaged with the first and second shells to lock the first and second shells together. The one or more collars may extend around a majority of an outer periphery of the inner tube and define a bearing surface for the inner tube. In some examples, at least one collar is fixed against an inner surface of the outer tube and is movable relative to the inner tube.

In some examples, the covering includes a locking element operably associated with the outer tube to selectively restrict rotation of the outer tube. The locking element may be axially displaceable between a first position where the locking element allows unrestricted rotation of the outer tube and a second position where the locking element restricts rotation of the outer tube. The locking element may be spring biased towards the first position. In some examples, the covering includes an externally-threaded screw and an internally-threaded nut received at least partially within the inner tube. The nut may be threaded onto the screw and keyed to the inner tube such that rotation of the inner tube rotates the nut about the screw and advances the nut axially along a length of the screw. The nut may engage and axially displace the locking element from the first position towards the second position during rotation of the inner tube. The locking element may be slidably attached to the screw. In some examples, the covering includes a bushing keyed to the outer tube such that the bushing rotates in unison with the outer tube. In the second position, the locking element may engage the bushing to restrict rotation of the outer tube.

In some examples, the covering includes a lift assist operably associated with the outer tube to rotate the outer tube but not the inner tube. The lift assist may be rotationally displaceable between a first rotational position and a second rotational position. The lift assist may be biased to rotate in a first direction to return to the first rotational position. In some examples, rotation in the first direction substantially wraps a first shade about the outer tube. In some examples, the lift assist may be at least partially received within the outer tube. In some examples, the lift assist may include a biasing spring. The biasing spring may be positioned axially between an end of the inner tube and an associated end cap. In some examples, the lift assist may include a sleeve. The sleeve may be positioned axially between an end of the inner tube and an associated end cap. The biasing spring may be received at least partially within a cavity defined by the sleeve. The sleeve may be received within the outer tube axially adjacent an end of the inner tube.

Examples of the disclosure may include a method of operating a covering for an architectural opening. In some examples, the method includes rotating an outer tube to unwrap a shade from an outer periphery of the outer tube, the shade including a support sheet and a plurality of strips of material, the plurality of strips of material having opposing longitudinal edge portions, a first edge portion of the opposing longitudinal edge portions attached to the support sheet and a second edge portion of the opposing longitudinal edge portions movable relative to the first edge portion and to the support sheet; and upon the shade reaching an extended position, rotating an inner tube positioned within the outer tube relative to the outer tube to move the second edge portion relative to the first edge portion.

In some examples, the method includes wrapping a portion of an operating element about the inner tube during rotation of the inner tube relative to the outer tube. In some examples, the method includes retracting the operating element through an elongated slot formed in the outer tube during rotation of the inner tube relative to the outer tube. In some examples, rotating the outer tube includes rotating the outer tube in a first rotational direction. In some examples, rotating the inner tube includes rotating the inner tube in the first rotational direction.

In some examples, the method includes rotating the inner tube in the first rotational direction relative to the outer tube to wrap a portion of the operating element around the inner tube. In some examples, the method includes rotating the inner tube in a second rotational direction opposite the first rotational direction to unwrap a portion of the operating element from the inner tube and subsequently drivingly rotate the outer tube in the second rotational direction and wrap the shade and the operating element around the outer tube.

The present disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of examples, it should be appreciated that individual aspects of any example can be claimed separately or in combination with aspects and features of that example or any other example.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. It should be understood that the claimed subject matter is not necessarily limited to the particular examples or arrangements illustrated herein.

BRIEF DESCRIPTION OF THE DRAWINGS

The accompanying drawings, which are incorporated into and constitute a part of the specification, illustrate embodiments of the disclosure and, together with the general description given above and the detailed description given below, serve to explain the principles of these embodiments.

FIG. 35 is an isometric view of a limit stop assembly attached to an end cap in accordance with an embodiment of the present disclosure.

FIG. 36 is a front elevation view of FIG. 35 in accordance with an embodiment of the present disclosure.

DETAILED DESCRIPTION

Figure 1:
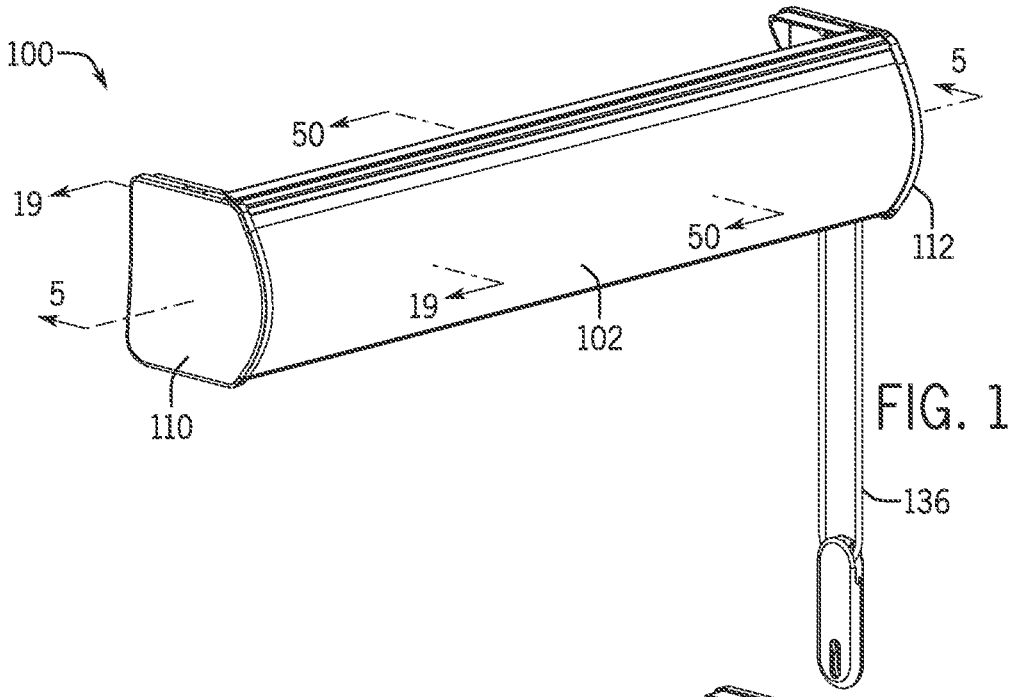
FIG. 1 is an isometric view of a covering with a shade in a fully-retracted position in accordance with an embodiment of the present disclosure.

The present disclosure provides a covering for an architectural opening. The covering may include a first roller, a second roller, a shade, and an operating element. The first roller may be a tube and may define an elongated slot extending along a length of the first roller. The elongated slot may open to an interior of the first roller. The second roller may be received within the first roller and may be selectively rotatable relative to the first roller. The second roller may be a tube. The first roller may be referred to as an outer roller or an outer tube, and the second roller may be referred to as an inner roller or an inner tube.

During operation, the first roller and the second roller may rotate relative to each other to control operation of the shade. For example, rotation of the second roller relative to the first roller may open or close associated vanes of the shade. The covering may include timing mechanisms to control the relative rotation of the second roller with the first roller. The timing mechanisms may control at what point during extension or retraction of the shade the second roller may be selectively rotatable relative to the first roller. The timing mechanisms may limit the amount of relative rotation of the second roller with the first roller.

The shade may be attached to one of the outer roller or the inner roller, and the operating element may be attached to the other of the outer roller or the inner roller. The shade may include a support sheet and a plurality of strips of material operably attached to the support sheet. Each of the plurality of strips of material may include a first edge portion attached to the support sheet and a second edge portion movable relative to the first edge portion and to the support sheet. The operating element may be attached to the second edge portion of each of the plurality of strips of material to move the second edge portion of each of the plurality of strips of material relative to the first edge portion of each of the plurality of strips of material upon rotation of the other of the outer roller or the inner roller relative to the one of the outer roller or the inner roller. Each second edge portion of a strip of material may abut or overlap the first edge portion of an adjacent strip of material.

In the example described below, the shade may be attached to the outer roller, and the operating element may be attached to the inner roller. During extension of the shade across an architectural opening, the shade and a first portion of the operating element may be unwrapped from the outer roller when the outer roller is rotated in a first rotational direction. Once the support sheet is extended across the architectural opening, the inner roller may be rotated in the first rotational direction relative to the outer roller to move the operating element in a first translational direction relative to the support sheet to cause the second edge portion of the plurality of strips of material to move relative to the first edge portion of the plurality of strips of material and create a gap between adjacent strips of material to permit light passage. The covering may include a locking element operably associated with the outer roller to restrict rotation of the outer roller during actuation of the plurality of strips of material.

To retract the shade, the inner roller may be rotated relative to the outer roller in a second rotational direction opposite the first rotational direction to move the operating element in a second translational direction (opposite the first translational direction) relative to the support sheet to cause the second edge portion of the plurality of strips of material to move relative to the first edge portion of the plurality of strips of material and close the gap between the adjacent strips of material. When the gap is closed, the inner roller and the outer roller may be rotated together in unison with each other in the second rotational direction to wrap the extended portion of the shade and the operating element about the outer roller. One or more collars may be positioned radially between the outer and inner rollers to reduce deflection of the rollers along their respective lengths and reduce operation noise by preventing unwanted contact between the first roller and the second roller.

Thus, according to the present disclosure, the covering may generally improve both control and operation of the shade while simultaneously reducing the size of the head rail by nesting the second roller within the first roller, thereby improving the aesthetic design and commercial appeal of the covering. A further understanding of the nature and advantages of the present disclosure may be realized by reference to the remaining portions of the specification and the drawings.

Figure 2:
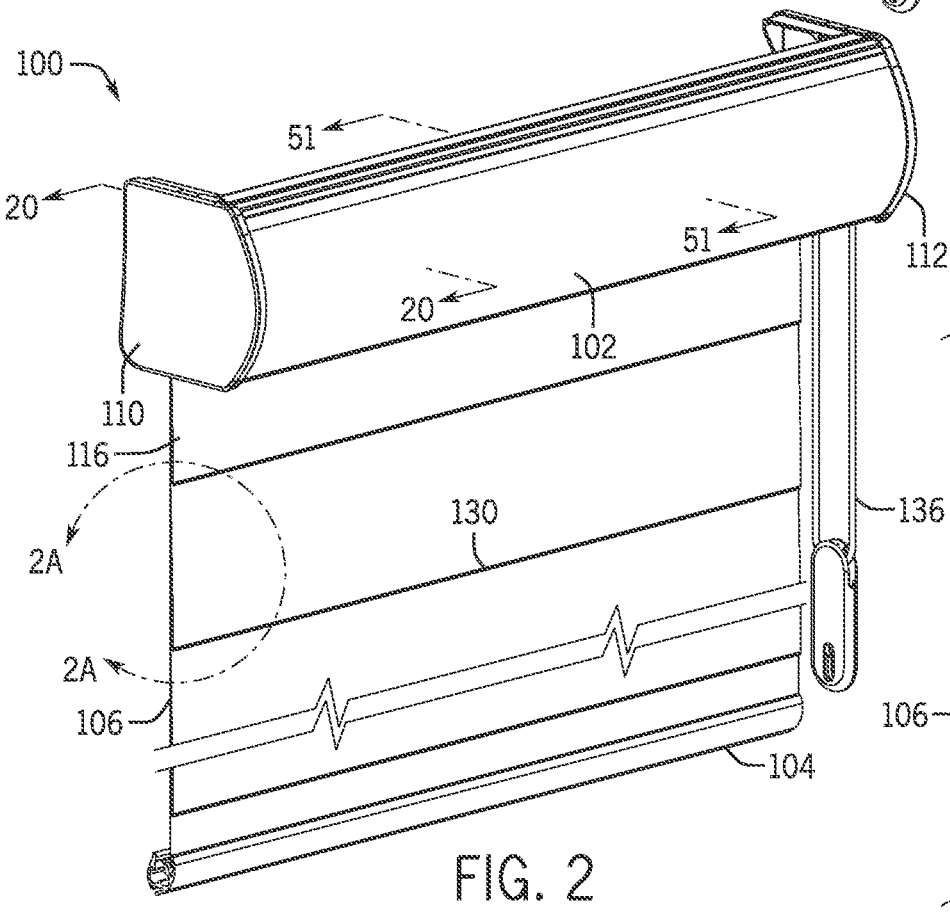
FIG. 2 is an isometric view of the covering of FIG. 1 with a support sheet in a fully-extended position and strips of material in a closed position in accordance with an embodiment of the present disclosure.
Figure 3:
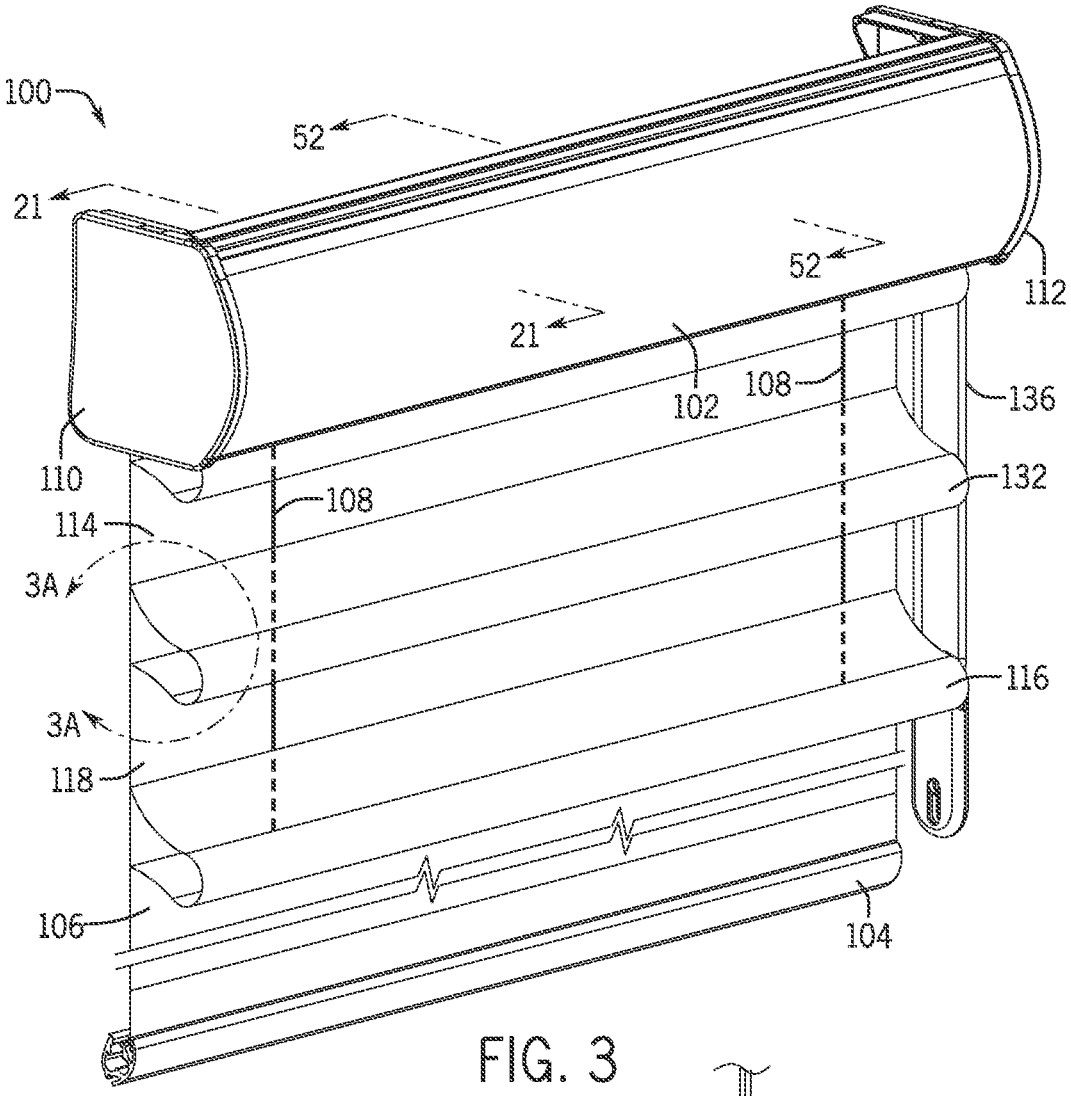
FIG. 3 is an isometric view of the covering of FIG. 1 with a support sheet in a fully-extended position and strips of material in an open position in accordance with an embodiment of the present disclosure.

Referring to FIGS. 1, 2, and 3, a covering 100 for an architectural opening is provided. The covering 100 may include a head rail 102, a bottom rail 104, a shade 106, and one or more operating elements 108. The head rail 102 may be mounted adjacent one or more sides of the architectural opening. The head rail 102 may include two opposing end caps, such as a left end cap 110 and a right end cap 112, which may enclose the ends of the head rail 102. The shade 106 may extend between the head rail 102 and the bottom rail 104 and may be movable between extended and retracted positions, as detail below. The bottom rail 104 may extend along a lower edge of the shade 106 and may function as a ballast to maintain the shade 106 in an extended configuration and preferably in a substantially taut condition. The bottom rail 104 may be an elongated member and may be attached to a lower edge of the shade 106.

Figure 2A:
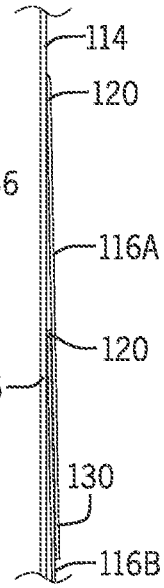
FIG. 2A is an enlarged fragmentary side view of Detail 2A of FIG. 2 in accordance with an embodiment of the present disclosure.

The shade 106 may include a support sheet 114 and a plurality of strips of material 116, which may be referenced as vanes. The support sheet 114 may depend from the head rail 102 and may be suspended in a vertical plane. The support sheet 114 may include a front face 118 facing inwardly towards an interior of a room. The strips of material 116 may extend across the front face 118 of the support sheet 114 perpendicular to a length dimension of the support sheet 114. Each strip of material 116 may include a first edge portion 120 and a second edge portion 130 extending along opposing edges of the strip of material 116. The first edge portions 120 may be secured to the front face 118 of the support sheet 114. For example, the first edge portions 120 may be attached to the front face 118 of the support sheet 114 by adhesive, double-sided tape, rivets, stitching, or other suitable attachment means. The second edge portion 130 may be movable relative to the first edge portion 120 and the support sheet 114. Referring to FIGS. 2 and 2A, when the shade 106 is in an extended position and the strips of material 116 are in a closed position, the second edge portion 130 of a first strip of material 116A (e.g., an upper strip of material) may abut the first edge portion 120 of a second strip of material 116B (e.g., a lower strip of material). In some embodiments, the second edge portion 130 of the first strip of material 116A may overlap and extend below the first edge portion 120 of the second strip of material 116B.

Figure 3A:
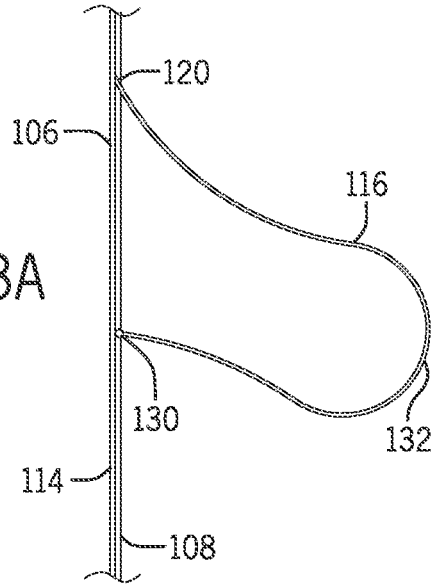
FIG. 3A is an enlarged fragmentary side view of Detail 3A of FIG. 3 in accordance with an embodiment of the present disclosure.

Referring to FIGS. 3 and 3A, when the shade 106 is in an extended position and the strips of material 116 are in an open position, the second edge portion 130 of each strip of material 116 may be gathered adjacent the first edge portion 120 of each strip of material 116 to define a gap between adjacent strips of material 116. In some embodiments, the strips of material 116 may extend horizontally across the front face 118 of the support sheet 114. In some embodiments, the first edge portion 120 may form an upper portion of each strip of material 116, and the second edge portion 130 may form a lower portion of each strip of material 116. In some embodiments, the first edge portion 120 may form a lower portion of each strip of material 116, and the second edge portion 130 may form an upper portion of each strip of material 116.

Referring to FIGS. 2, 3, and 3A, the strips of material 116 may be movable between a closed position where the strips of material 116 may be contiguous with or immediately adjacent the support sheet 114, and an open position where a middle portion 132 of one or more of the strips of material 116 defined between the first and second edge portions 120, 130 may be spaced forwardly from the front face 118 of the support sheet 114 forming a curved (e.g., substantially C-shaped) cell in cross-section. Referring to FIG. 3A, in some embodiments the second edge portion 130 of the strips of material 116 may be weighted to bias the strips of material 116 to the closed position.

The support sheet 114 and the strips of material 116 may be constructed of substantially any type of material. For example, the support sheet 114 and the plurality of strips of material 116 may be constructed from natural and/or synthetic materials, including fabrics, polymers, and/or other suitable materials. Fabric materials may include woven, non-woven, knits, or other suitable fabric types. In some implementations, the support sheet 114 and the strips of material 116 may be made from a flexible material, such as a fabric material. The support sheet 114 and the plurality of strips of material 116 may have any suitable level of light transmissivity. For example, the support sheet 114 and the plurality of strips of material 116 may be constructed of transparent, translucent, and/or opaque materials to provide a desired ambience or décor in an associated room. In some examples, the support sheet 114 is transparent and/or translucent, and each of the plurality of strips of material 116 is translucent and/or opaque. In some examples, the strips of material 116 are made from a sheet of material with zero light transmissivity, often referred to as a black-out material. The support sheet 114 and the strips of material 116 may include a single layer of material or multiple layers of material connected together. The strips of material 116 may have a high level of drape (less stiff) or a low level of drape (more stiff), which may be selected for obtaining the appropriate cell shape.

Referring to FIGS. 3 and 3A, the covering 100 may include one or more operating elements 108. The one or more operating elements 108 may extend along the front face 118 of the support sheet 114 in a length direction of the support sheet 114. In some embodiments, the one or more operating elements 108 may be positioned at least partially between the front face 118 of the support sheet 114 and one or more of the plurality of strips of material 116. In some embodiments, the one or more operating elements 108 may be substantially hidden from view when the strips of material 116 are in a closed configuration (see FIGS. 2 and 2A). Referring to FIG. 3, the covering 100 may have a plurality of operating elements 108, such as two operating elements 108 that extend vertically along the front face 118 of the support sheet 114 and are horizontally-spaced apart from one another. The operating elements 108 may be movable relative to the first edge portions 120 of the strips of material 116 and to the support sheet 114. The operating elements 108 may be attached to the second edge portions 130 of the strips of material 116 to move the strips of material 116 between the closed position (see FIGS. 2 and 2A) and the open position (see FIGS. 3 and 3A).

The one or more operating elements 108 may be constructed of substantially any type of material. For example, the one or more operating elements 108 may be constructed from natural and/or synthetic materials, including fabrics, polymers, and/or other suitable materials. In some embodiments, the one or more operating elements 108 may be a monofilament fiber. The one or more operating elements 108 may have any suitable level of light transmissivity. For example, the one or more operating elements 108 may be transparent or translucent to reduce the visibility of the one or more operating elements 108 when the strips of material 116 are in the open position.

Figure 4:
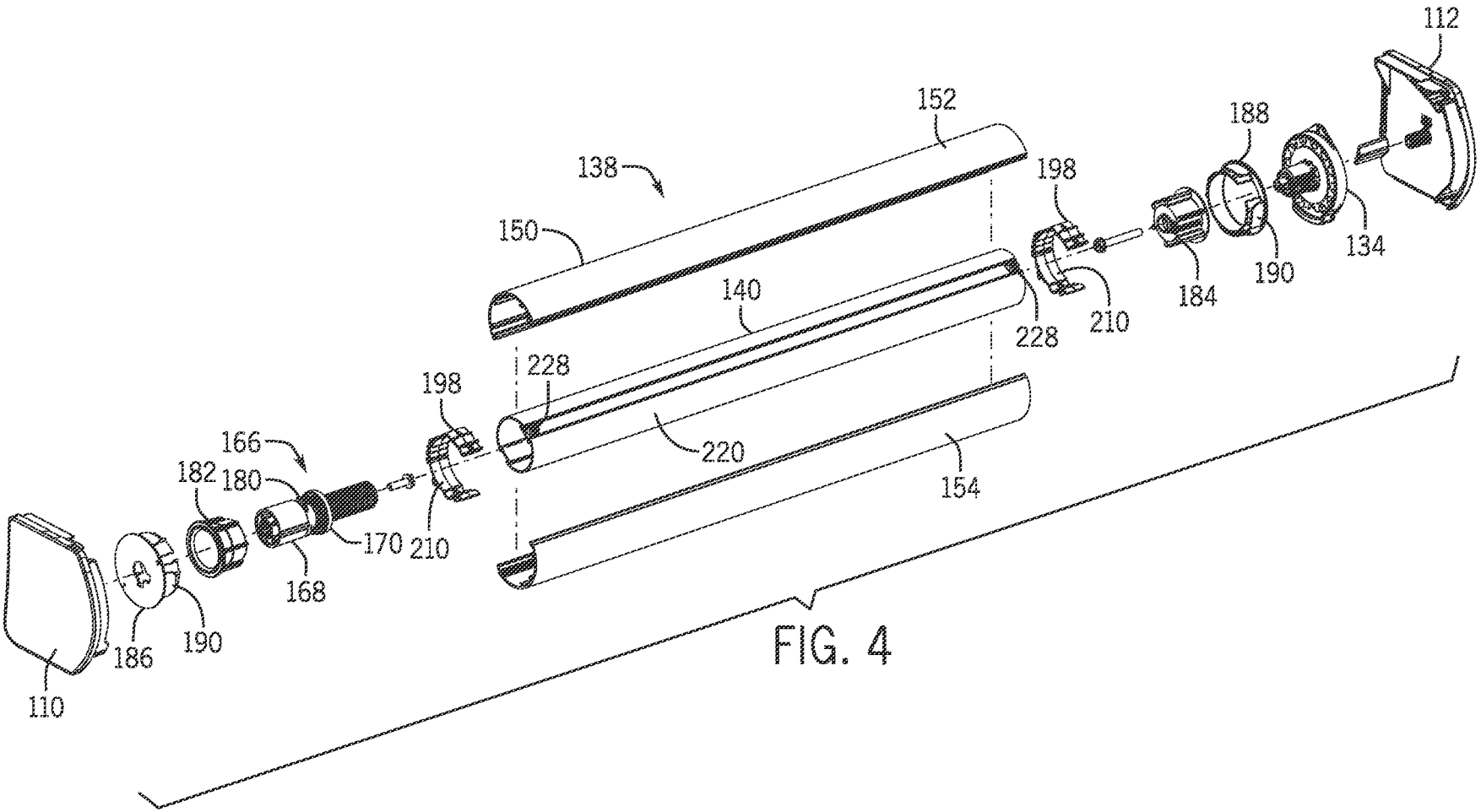
FIG. 4 is an isometric, partially-exploded view of head rail components of a covering in accordance with an embodiment of the present disclosure. The head rail cover and the shade are not shown for clarity.
Figure 5:
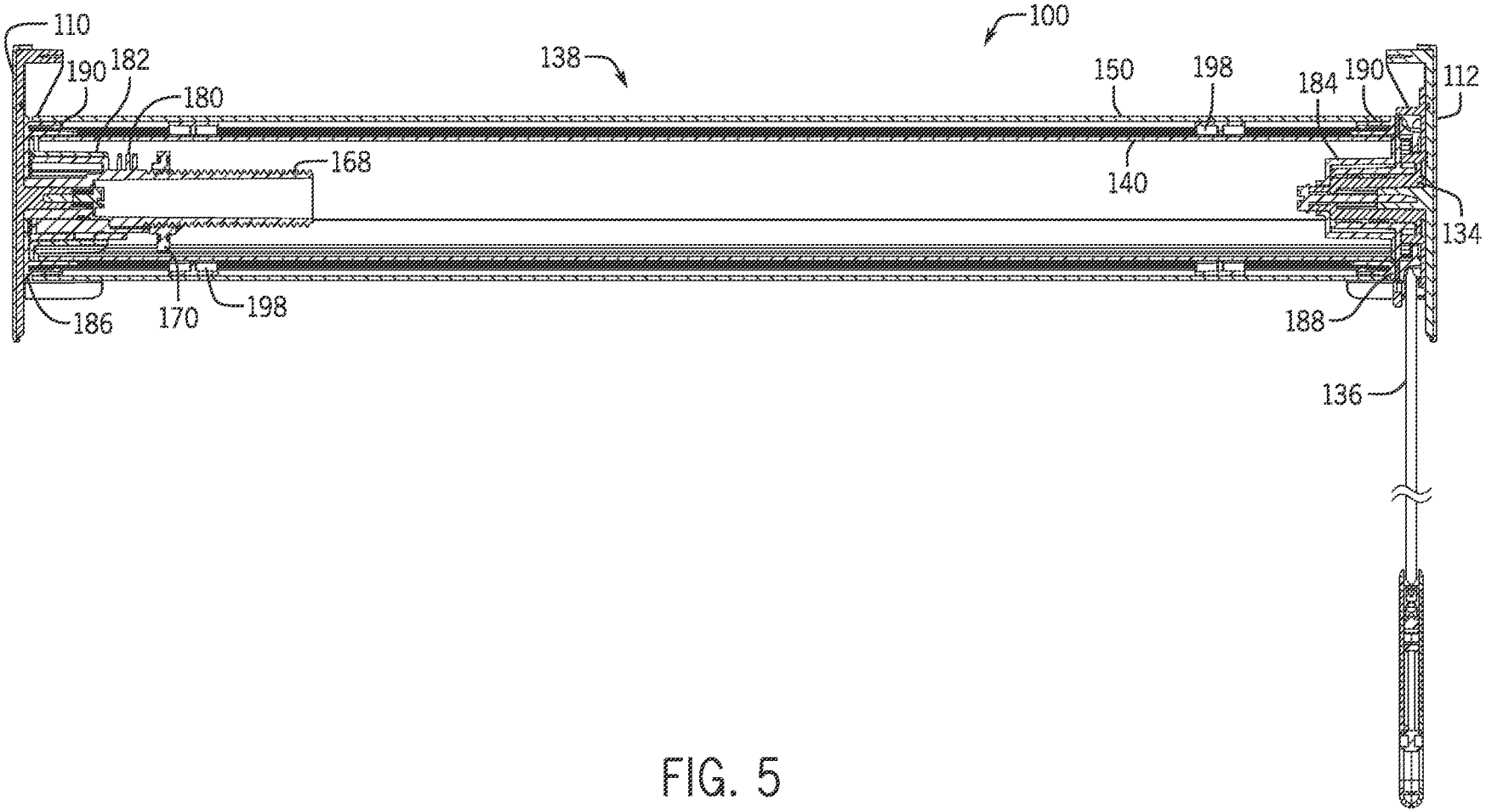
FIG. 5 is a lengthwise cross-sectional view of a covering taken along line 5-5 of FIG. 1 with the head rail components of FIG. 4 in accordance with an embodiment of the present disclosure.

Referring to FIGS. 4 and 5, the covering 100 may include a drive mechanism 134 configured to raise or retract the support sheet 114 and/or manipulate the plurality of strips of material 116. The drive mechanism 134 may include a speed governing device to control or regulate the extension (e.g., lowering) or retraction (e.g., raising) speed of the shade 106. The drive mechanism 134 may be attached to the right end cap 112 or to the left end cap 110 by a screw, adhesive, corresponding retention features, heat or sonic welding, or any other suitable attachment means.

The drive mechanism 134 may be controlled mechanically and/or electrically. In some examples, the drive mechanism 134 may be controlled by a mechanical actuation component 136 (such as a ball chain, a cord, or a wand) to allow the user to extend or retract the shade 106 and open or close the cells. To move the shade 106, a user may manipulate the mechanical actuation component 136. For example, to raise or retract the shade 106 from an extended position, the user may pull the mechanical actuation component 136 in a first direction (e.g., downwardly). To extend or lower the shade 106 from a retracted position, the user may manipulate the mechanical actuation component 136 to release a brake, which may allow the shade 106 to automatically lower under the influence of gravity.

Additionally, or alternatively, the drive mechanism 134 may include an electric motor configured to extend or retract the shade 106 upon receiving an extension or retraction command. The motor may be hard-wired to a switch and/or operably coupled to a receiver that is operable to communicate with a transmitter, such as a remote control unit, to permit a user to control the motor and thus the extension and retraction of the shade 106. The motor may include a "gravity lower" state to permit the shade 106 to lower via gravity without motor intervention, thereby reducing power consumption. Pre-programmed commands may be used to control the motor and thus to control the position of the shade 106. The commands may instruct the motor to move the support sheet 114 and the strips of material 116 into predetermined shade positions, such as a first position in which the shade 106 is fully retracted, a second position in which the shade 106 is fully extended and the strips of material 116 are in a closed configuration, and a third position in which the shade 106 is fully extended and the strips of material 116 are in an open or retracted configuration. The commands may be transmitted to the motor by the remote control unit.

Referring to FIG. 4, the covering 100 may include a dual tube unit 138, which may be disposed within the head rail 102. The dual tube unit 138 may include an inner tube 140 and an outer tube 150. The inner tube 140 may be referred to as an inner roller, and the outer tube 150 may be referred to as an outer roller. The inner tube 140 may be positioned inside the outer tube 150. The inner and outer tubes 140, 150 may be coaxially aligned about the same rotation axis. The inner and outer tubes 140, 150 may be concentric about a central axis of the inner tube 140.

Referring to FIGS. 4 and 5, the inner tube 140 may have a generally circular transverse cross-sectional shape. The outer tube 150 may have a generally circular transverse cross-sectional shape and may at least partially surround the inner tube 140. In some embodiments, the outer tube 150 may have a half round transverse cross-sectional shape. The outer tube 150 may be formed of two longitudinal pieces that interlock with one another to form the outer tube 150. For example, with reference to FIG. 4, the outer tube 150 may include a first shell 152 and a second shell 154 that interlock together to at least partially surround the inner tube 140. Referring to FIGS. 4, 6, 9, and 17-21, first longitudinally-extending edge portions 156, 158 of the first and second shells 152, 154, respectively, may overlap and interlock with one another. For example, the first edge portions 156, 158 of the first and second shells 152, 154 may generally form a separable hinge assembly along a longitudinal length of the first and second shells 152, 154 to releasably secure the first and second shells 152, 154 together. Referring to FIGS. 17-21, the first and second shells 152, 154 may define a slot 160 extending along an axial length of the outer tube 150 and in communication with the interior of the outer tube 150. As more fully explained below, the slot 160 may permit passage of the operating element 108 therethrough during opening and closing of the strips of material 116. When the first edge portions 156, 158 of the first and second shells 152, 154, respectively, are interlocked together, second longitudinally-extending edge portions 162, 164 of the first and second shells 152, 154, respectively, may be peripherally spaced apart from one another to define the slot 160. The confronting second edge portions 162, 164 of the first and second shells 152, 154 may be spaced a sufficient distance from one another to permit passage of the operating element 108 or the support sheet 114 therebetween.

Referring to FIG. 5, the inner and outer tubes 140, 150 may extend substantially the entire distance between the left and right end caps 110, 112. The inner and outer tubes 140, 150 may have the same or substantially the same axial length. The support sheet 114 and the plurality of strips of material 116 may have the same or substantially the same width, which may be equivalent to the axial length of the tubes 140, 150. In some examples, the support sheet 114 and the plurality of strips of material 116 have equivalent widths that match the axial length of the inner and outer tubes 140, 150, which may reduce or eliminate the existence of a light gap between the edges of the shade 106 and the sides of the architectural opening.

Referring to FIGS. 4 and 5, the dual tube unit 138 may be rotatably supported by the opposing end caps 110, 112. As explained below, a lock mechanism 166 may be fixedly attached to the left end cap 110 to prevent rotation of at least a portion of the dual tube unit 138 upon full extension of the shade 106. In some embodiments, the lock mechanism 166 may be attached to the left end cap 110 by a screw, adhesive, corresponding retention features, heat or sonic welding, or any other suitable attachment means. The lock mechanism 166 may include a limit screw 168 and a limit nut 170 threadedly engaged with the limit screw 168. The limit nut 170 may be received within the inner tube 140 and may be keyed to the inner tube 140 so that the limit nut 170 rotates in unison with the inner tube 140 about the rotation axis of the inner tube 140. As the inner tube 140 rotates, the limit nut 170 may move axially along the threaded limit screw 168 and may engage a lower limit stop 180 formed on the limit screw 168 to define the lowermost extended position of the shade 106 (see FIG. 3). Additionally, or alternatively, an upper limit stop may be employed on the limit screw 168 if desired to define a top retraction position, as more fully explained below. A first internal bushing 182 may be rotatably mounted onto the limit screw 168 and may be axially aligned with the inner tube 140. The first internal bushing 182 may be received within the inner tube 140 and may tightly engage the inner tube 140 to support the left end of the inner tube 140.

With continued reference to FIGS. 4 and 5, the drive mechanism 134 may be fixedly attached to the right end cap 112. The drive mechanism 134 may be operably associated with the inner tube 140 to cause it to rotate. The drive mechanism 134 may include a second internal bushing 184, which may be axially aligned with the inner tube 140. The second internal bushing 184 may be received within the inner tube 140 and may tightly engage the inner tube 140 to support the right end of the inner tube 140. The second internal bushing 184 may be driven in rotation by the drive mechanism 134 to drive the inner tube 140 in rotation. The drive mechanism 134 may include a planetary gear drive often utilized in window covering applications. The drive mechanism 134 may be actuated, for example, by the mechanical actuation component 136 or a remote control unit.

Referring to FIGS. 4 and 5, first and second outer bushings 186, 188 may be axially aligned with the outer tube 150 and may be disposed adjacent opposing ends of the outer tube 150. The second outer bushing 188 may be rotatably mounted onto the drive mechanism 134, and the first outer bushing 186 may be rotatably mounted onto the limit screw 168. The outer bushings 186, 188 may lock into the ends of the outer tube 150 and may include multiple axial projections 190. One of the axial projections 190 may engage the first shell 152, and another of the axial projections 190 may engage the second shell 154. When the outer bushings 186, 188 are engaged with the opposing ends of the outer tube 150, the outer bushings 186, 188 and the outer tube 150 may rotate in unison about the rotation axis of the inner and outer tubes 140, 150.

Figure 6:
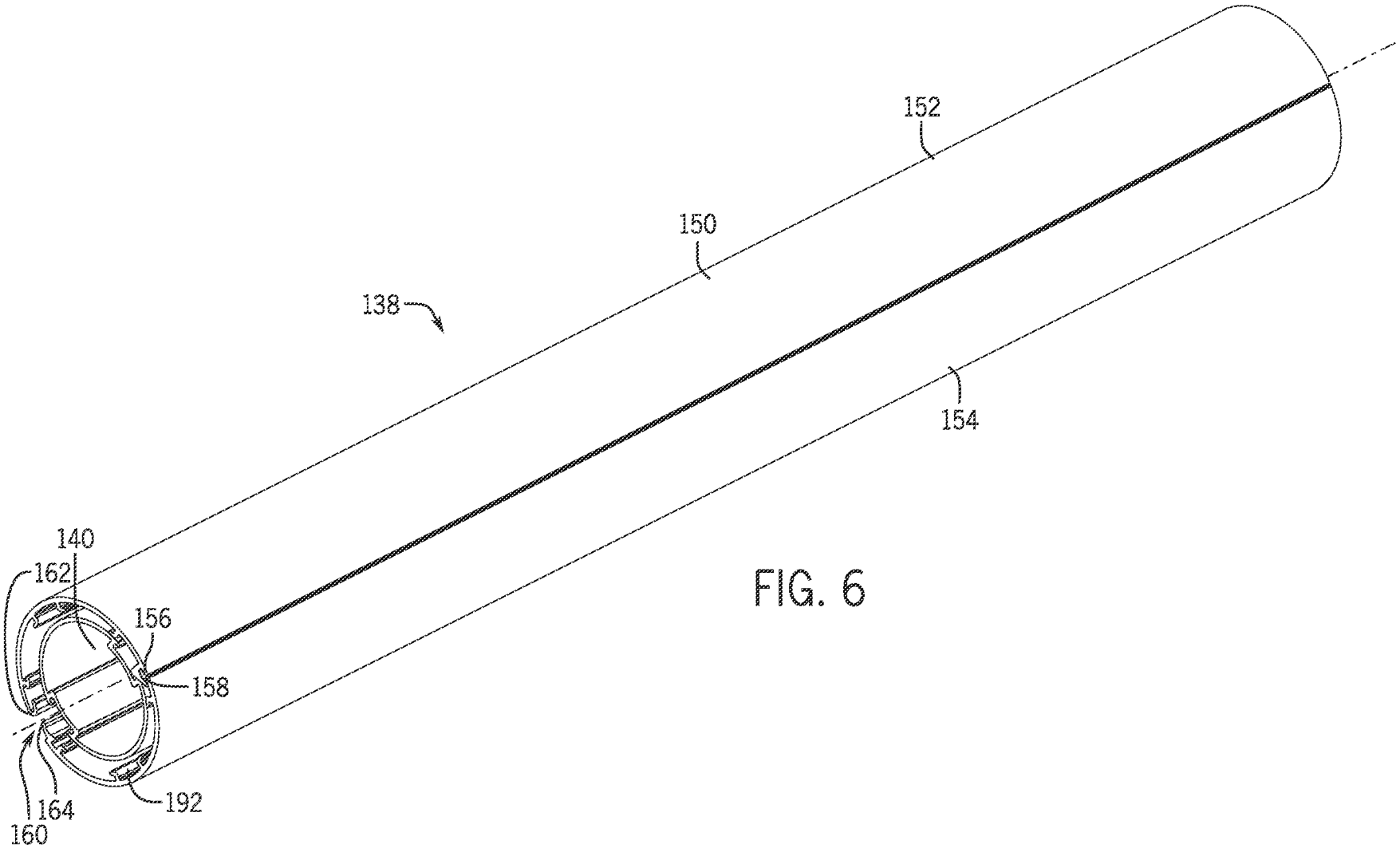
FIG. 6 is an isometric view of an inner tube nested inside an outer tube in accordance with an embodiment of the present disclosure.
Figure 9:
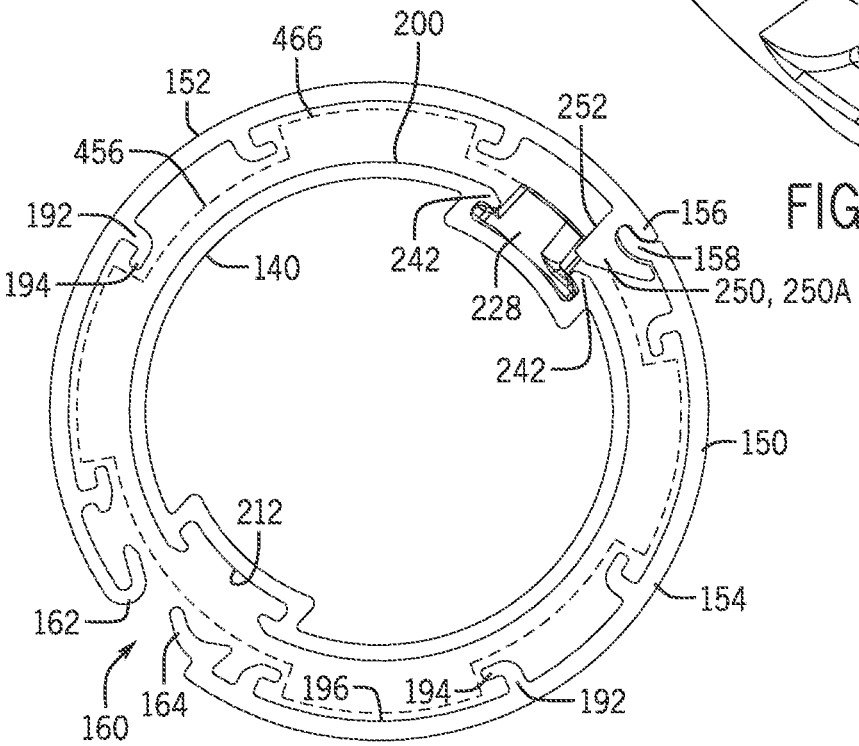
FIG. 9 is an elevation view of an inner tube nested inside an outer tube and showing the first engagement feature of FIG. 8 engaged with a corresponding second engagement feature of the outer tube in accordance with an embodiment of the present disclosure.
Figure 50:
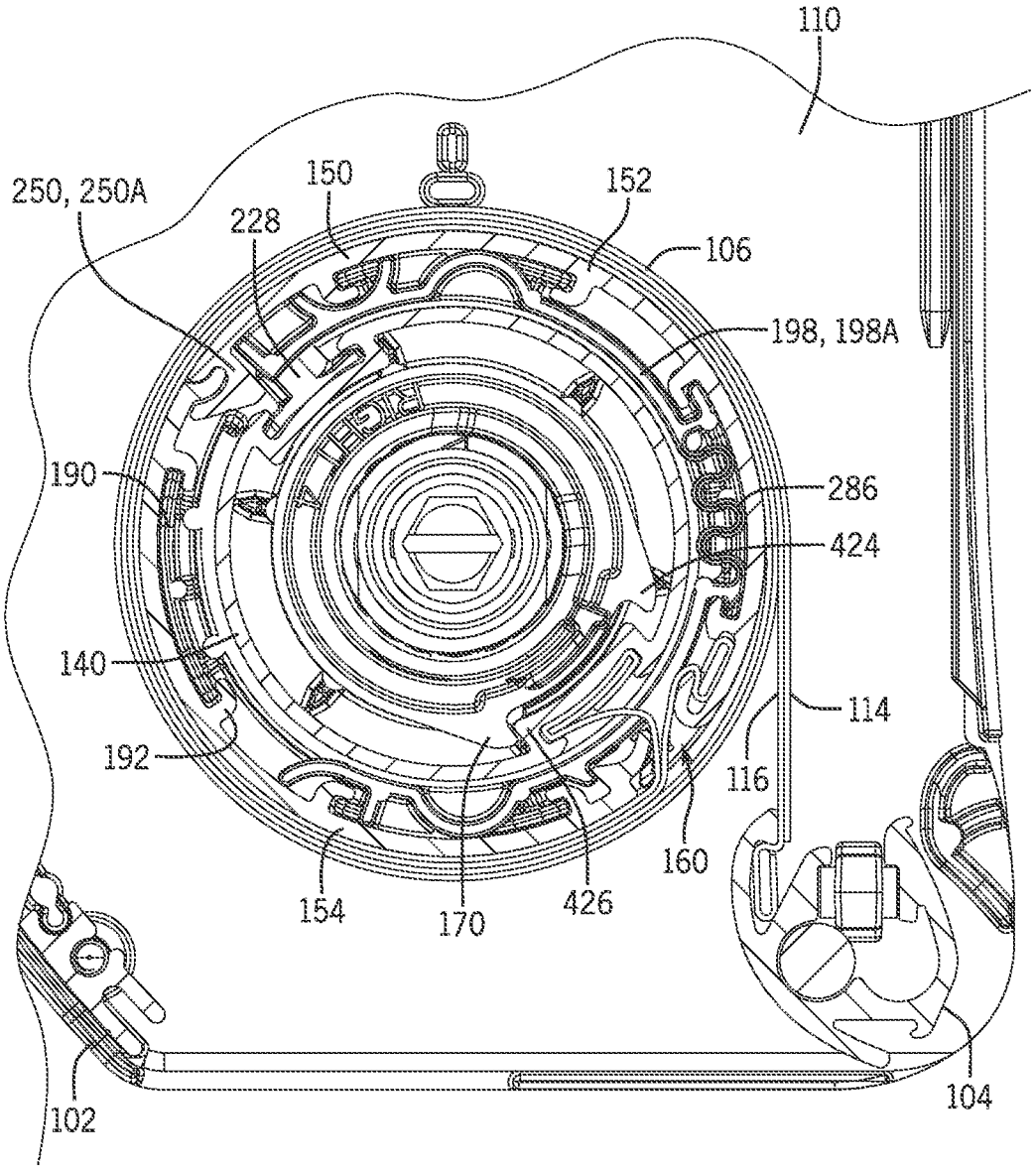
FIG. 50 is a transverse cross-sectional view of a covering taken along line 50-50 of FIG. 1 in accordance with an embodiment of the present disclosure.

Referring to FIGS. 6 and 9, the first and second shells 152, 154 of the outer tube 150 may each define a retention feature 192 that snugly receives the axial projections 190 of the outer bushings 186, 188 (see FIG. 50). The retention feature 192 may be formed as circumferentially-spaced shelves 194 that extend inwardly from a circumferential wall 196 of the outer tube 150 into an interior space defined by the outer tube 150. When the outer bushings 186, 188 are engaged with the ends of the outer tube 150, the axial projections 190 may be snugly received between the shelves 194 and the circumferential wall 196 of the outer tube 150 to prevent relative movement between the first and second shells 152, 154. The axial projections 190 of the outer bushings 186, 188 may maintain the width of the slot 160 during operation of the covering 100.

Figures 16, 17, 18:
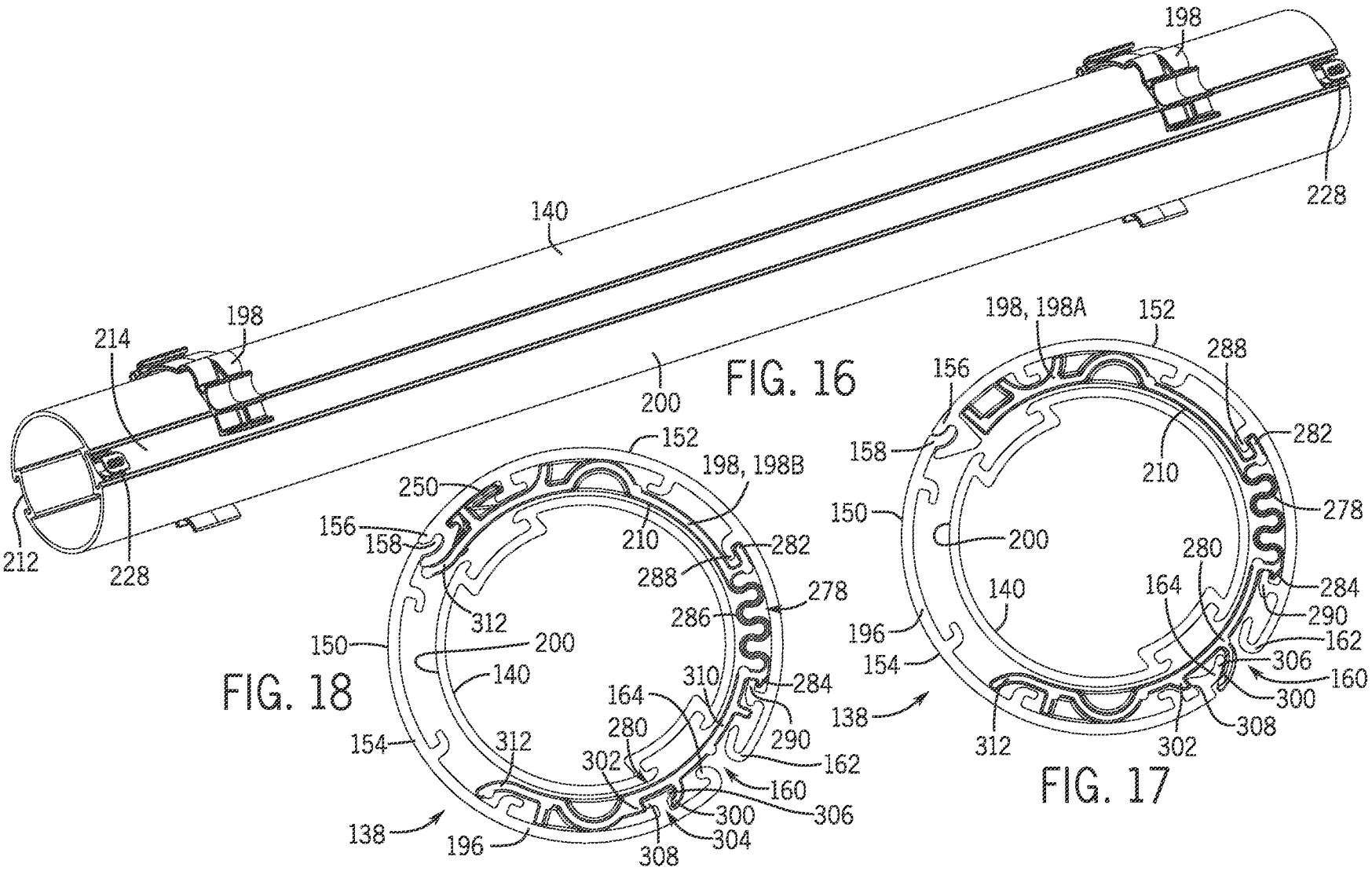
FIG. 16 is an isometric view of an inner tube with the collar of FIG. 12 and the first engagement feature of FIG. 8 in accordance with an embodiment of the present disclosure.
FIG. 17 is an elevation view of the collar of FIG. 12 nested within a dual tube unit in accordance with an embodiment of the present disclosure.
FIG. 18 is a side elevation view of the collar of FIG. 14 and the second engagement feature of FIG. 11 positioned within a dual tube unit in accordance with an embodiment of the present disclosure.

With reference to FIGS. 4, 17, and 18, the dual tube unit 138 may include one or more collars 198, such as collar 198A of FIG. 17 and/or collar 198B of FIG. 18, axially aligned with inner and outer tubes 140, 150. As understood herein, reference to collar 198 necessarily includes a reference to both collar 198A and collar 198B. That is, absent a specific reference to either collar 198A or collar 198B, the description below with reference to collar 198 applies to both collar 198A and collar 198B. Any differing structure is discussed below with specific reference to either collar 198A or collar 198B. As illustrated, the collars 198 may be positioned at least partially radially between the inner and outer tubes 140, 150. The collars 198 may partially surround an outer surface 200 of the inner tube 140 and may provide a bearing surface 210 for the inner tube 140. The collars 198 may be configured to attach the first shell 152 and the second shell 154 together. The collars 198 may stiffen the dual tube unit 138 and reduce deflection of the tubes 140, 150 along their axial lengths. The collars 198 may maintain the width of the slot 160 during operation of the covering 100. The collars 198 may be spaced apart from one another along the axial length of the dual tube unit 138 (e.g., the inner tube 140) and may be positioned near the end caps 110, 112.

Figure 7:
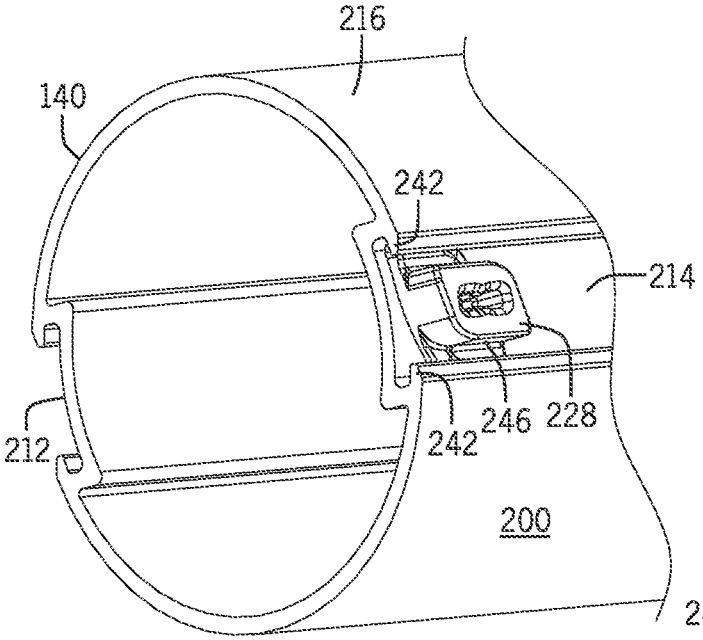
FIG. 7 is a fragmentary isometric view of an inner tube and a first engagement feature attached to the inner tube in accordance with an embodiment of the present disclosure.

Referring to FIG. 7, the inner tube 140 may define a first groove 212 and a second groove 214 in the circumferential wall 216 of the inner tube 140. In some embodiments, the first groove 212 and the second groove 214 may be defined in the outer surface 200 of the inner tube 140. The first and second grooves 212, 214 may extend lengthwise along an axial length of the inner tube 140. The second groove 214 may be formed in the outer surface 200 of the inner tube 140 diametrically opposite the first groove 212. In some embodiments, the second groove 214 may be substantially identical to the first groove 212 to permit the inner tube 140 to be inserted within the outer tube 150 without regard to the orientation of the inner tube 140. In some embodiments, the first and second grooves 212, 214 may extend continuously or discontinuously along an axial length of the inner tube 140. In some embodiments, the first and second grooves 212, 214 may extend only partially along the axial length of the inner tube 140. In some embodiments, the first and second grooves 212, 214 may be formed intermittently along the axial length of the inner tube 140.

Figure 19:
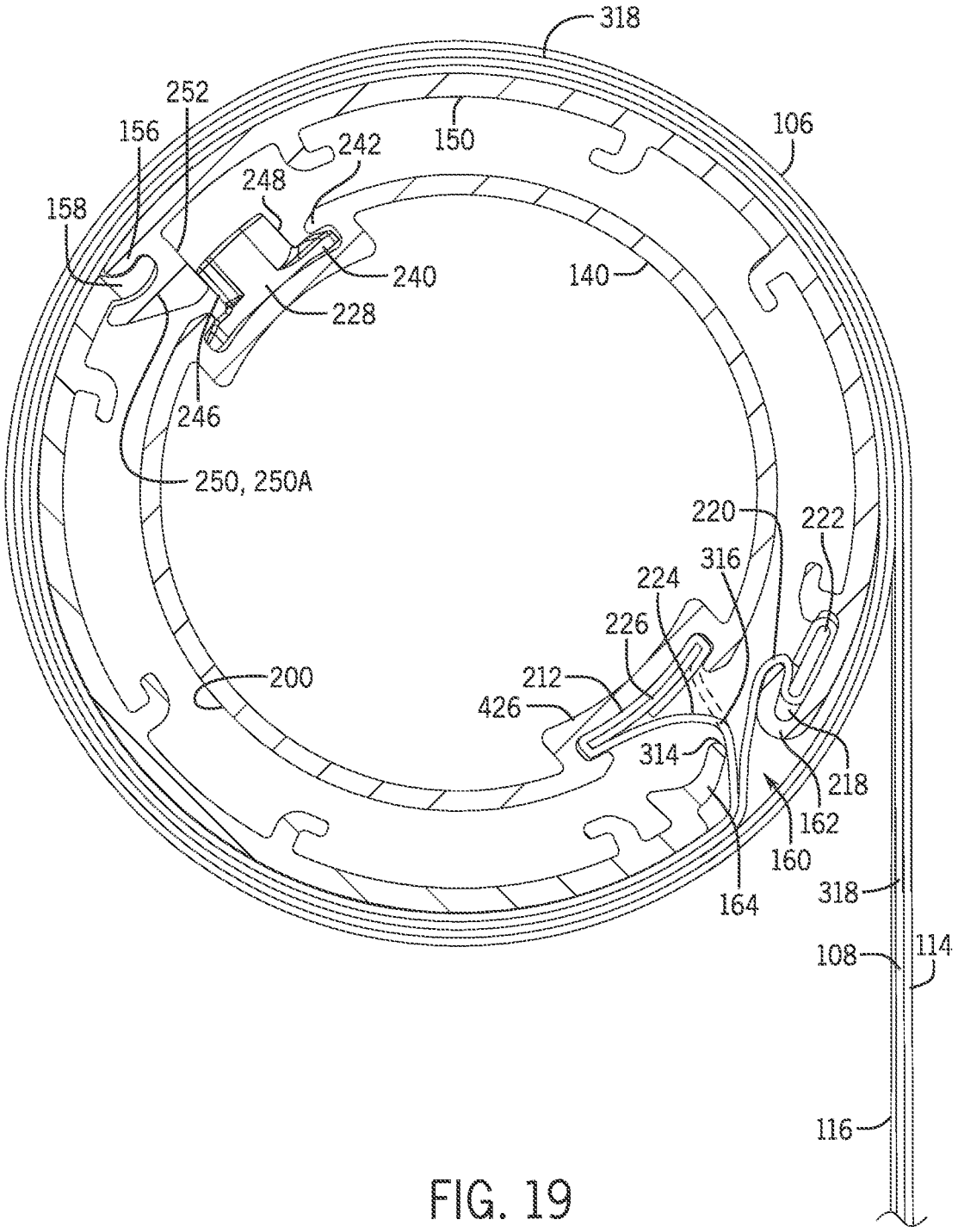
FIG. 19 is a fragmentary transverse cross-sectional view of a covering taken along line 19-19 of FIG. 1 in accordance with an embodiment of the present disclosure. Various components are removed for clarity.
Figure 20:
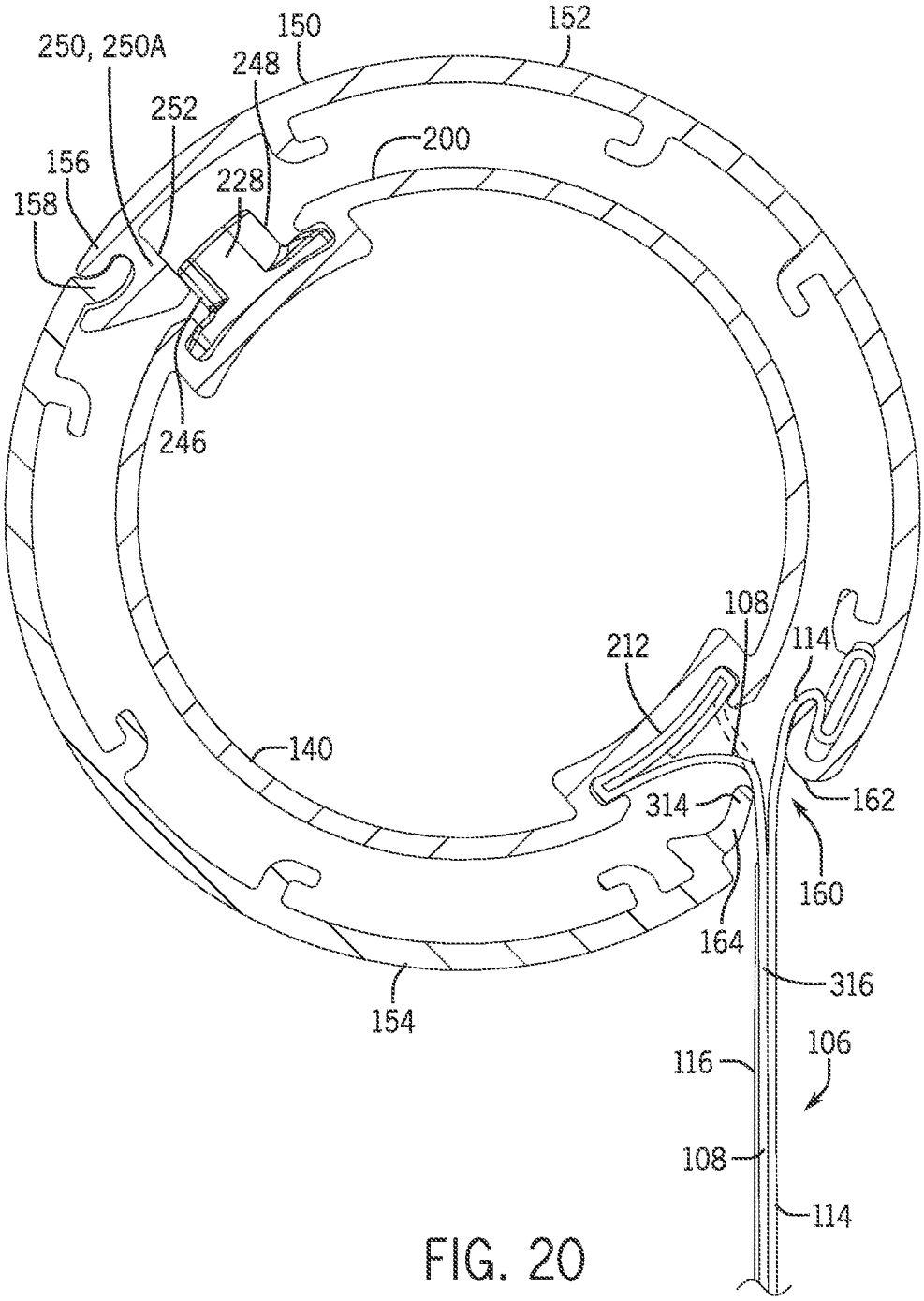
FIG. 20 is a fragmentary transverse cross-sectional view of a covering taken along line 20-20 of FIG. 2 in accordance with an embodiment of the present disclosure. Various components are removed for clarity.
Figure 21:
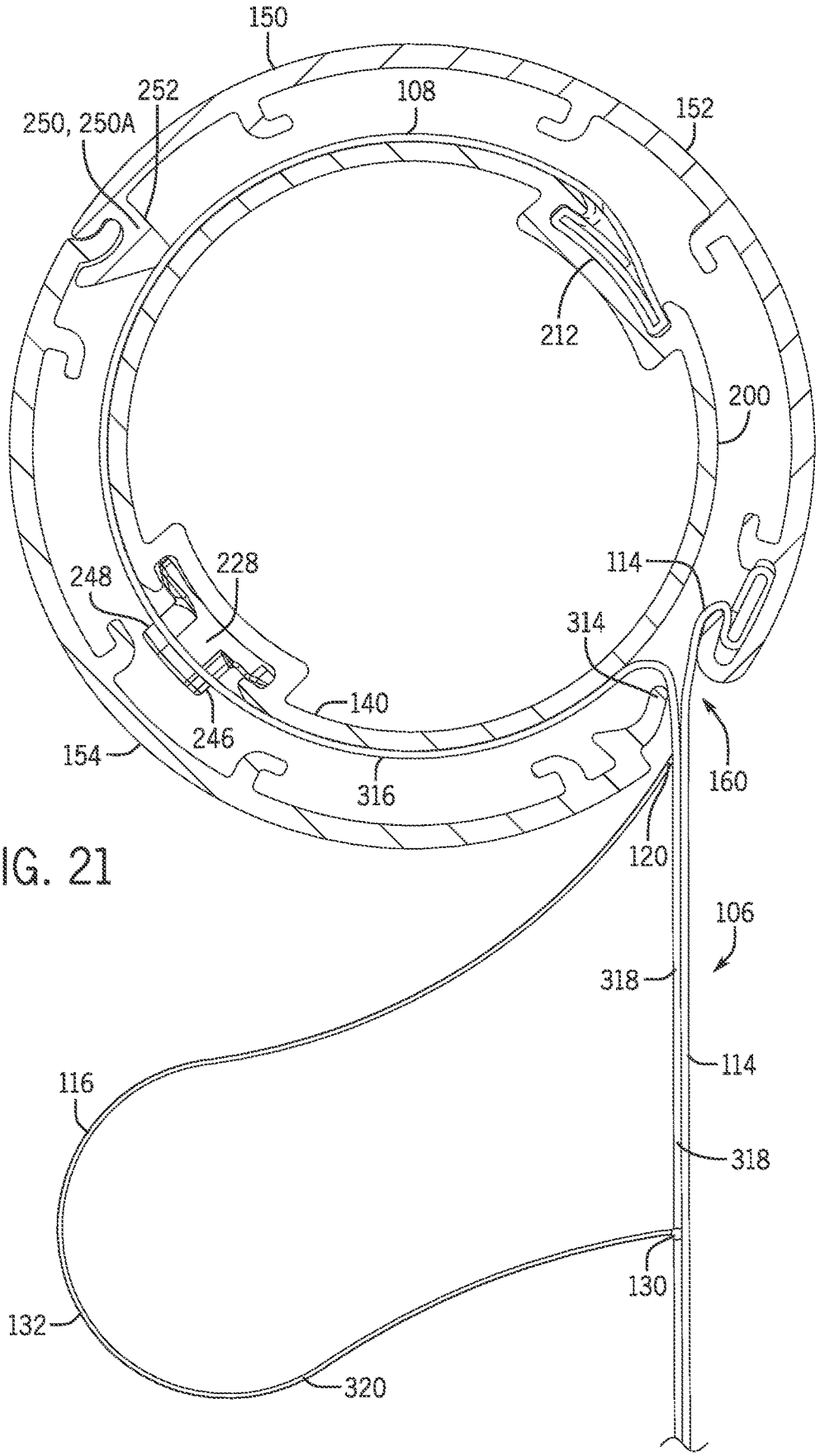
FIG. 21 is a fragmentary transverse cross-sectional view of a covering taken along line 21-21 of FIG. 3 in accordance with an embodiment of the present disclosure. Various components are removed for clarity.

The support sheet 114 may be attached to the outer tube 150 by adhesive, corresponding retention features, or other suitable attachment means. Referring to FIGS. 19-21, the outer tube 150 may define a retention groove 218 in the interior circumferential wall 196 of the outer tube 150. The retention groove 218 may extend lengthwise along an axial length of the outer tube 150. In some embodiments, the retention groove 218 may be formed in an interior surface of the first shell 152 of the outer tube 150. In some embodiments, the retention groove 218 may be adjacent the slot 160 defined by the second edge portions 162, 164 of the first and second shells 152, 154. The retention groove 218 may receive a top edge portion 220 of the support sheet 114. The top edge portion 220 of the support sheet 114 may be hemmed and an insert 222 may be received in the hem to retain the top edge portion 220 of the support sheet 114 in the retention groove 218. In some embodiments, an adhesive bead may be disposed within the retention groove 218 and the top edge portion 220 of the support sheet 114 may be adhered to the outer tube 150 by the adhesive bead.

The operating element 108 may be attached to the inner tube 140 by adhesive, mechanical fasteners, corresponding retention features, or other suitable attachment means. Referring to FIGS. 19-21, the first groove 212 may receive a top end portion 224 of the operating element 108. The top end portion 224 of the operating element 108 may be hemmed and an insert 226 may be received in the hem to retain the top end portion 224 of the operating element 108 in the first groove 212. The top end portion 224 of the operating element 108 may extend from a first end of the first groove 212. Additionally or alternatively, the top end portion 224 may extend from a second end of the first groove 212 opposite the first end, as shown in dashed lines in FIGS. 19-21. In some embodiments, an adhesive bead may be disposed within the first groove 212 and the top end portion 224 of the operating element 108 may be adhered to the inner tube 140 by the adhesive bead.

Figure 10:
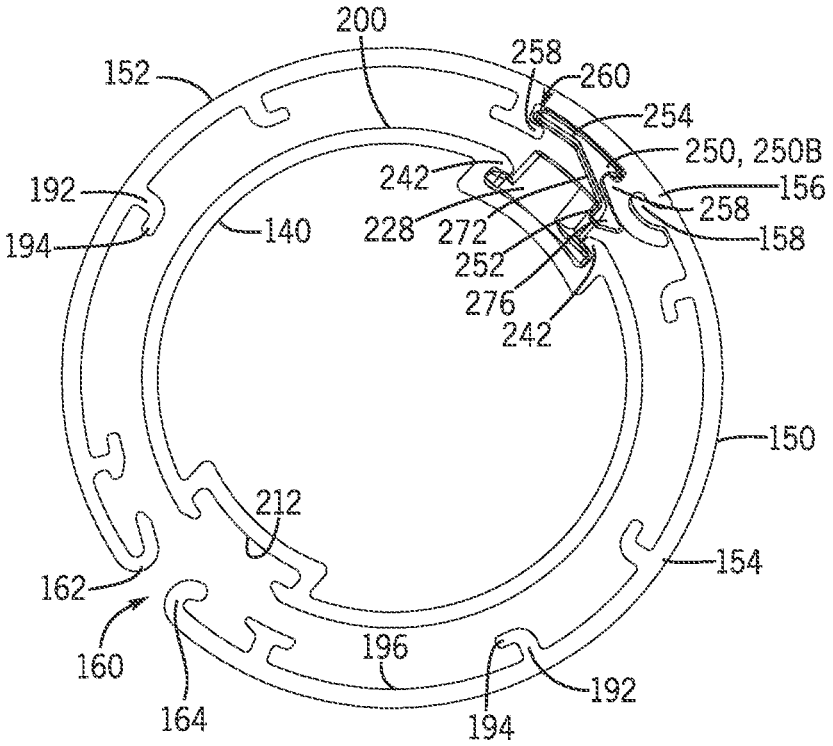
FIG. 10 is an elevation view of an inner tube nested within an outer tube and showing the first engagement feature of FIG. 8 engaged with an alternative second engagement feature of the outer tube in accordance with an embodiment of the present disclosure.

One or more first engagement features 228 may be operably attached to the inner tube 140 to selectively engage and rotate the outer tube 150. Referring to FIGS. 7, 9, and 10, for instance, each first engagement feature 228, which may be referred to as a drive stub or a drive peak, may extend outwardly from the inner tube 140. Each first engagement feature 228 may be received at least partially within the second groove 214. Each first engagement feature 228 may include a central body 230 and a pair of flanges 240 extending in opposite directions from opposing sides of the body 230. The flanges 240 may be captured within the second groove 214 by opposing lips 242 defined by the inner tube 140 that extend over longitudinally-extending edge portions of the second groove 214. The first engagement feature 228 may be slidably received within the second groove 214 by inserting the first engagement feature 228 into an open end of the second groove 214 and sliding the first engagement feature 228 along an axial length of the inner tube 140. The flanges 240 may be snugly received within the second groove 214 so that an external force is required to move the first engagement feature 228 along the axial length of the inner tube 140 to a desired position. The flanges 240 may be interference fit within the second groove 214 so that the first engagement feature 228 does not move relative to the inner tube 140 during operation of the covering 100. Multiple first engagement features 228 may be positioned within the second groove 214. The first engagement features 228 may be spaced apart from one another along the axial length of the inner tube 140. The number of first engagement features 228 may depend upon the axial length of the inner tube 140. For example, the number of first engagement features 228 may be increased as the axial length of the inner tube 140 is increased. The first engagement features 228 may be constructed of substantially any type of material. For example, the first engagement features 228 may be constructed from natural and/or synthetic materials, including plastics, metals, and/or other suitable materials.

Figure 8:
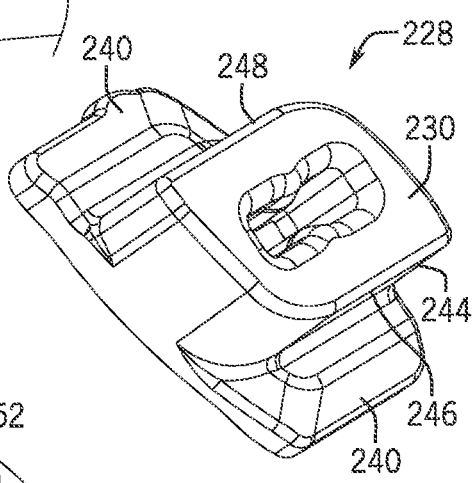
FIG. 8 is an enlarged isometric view of the first engagement feature of FIG. 7 in accordance with an embodiment of the present disclosure.

The central body 230 of each first engagement feature 228 may extend outwardly of the outer surface 200 of the inner tube 140 to selectively engage and rotate the outer tube 150. Referring to FIGS. 7 and 8, the central body 230 of the first engagement feature 228 may include side surfaces 244 that extend outwardly from the inner tube 140 and face in opposite directions relative to one another. The side surfaces 244 may be planar. One of the side surfaces 244 may be referred to as an engagement surface 246 and may face generally tangentially away from the inner tube 140 in a first direction (e.g., downward in FIG. 7). During operation of the covering 100, the engagement surface 246 may selectively engage the outer tube 150 to drivingly rotate the outer tube 150 in unison with the inner tube 140. The other of the side surfaces 244 may be referred to as a limit surface 248 and may face generally tangentially away from the inner tube 140 in a second direction (e.g., upward in FIG. 7) opposite the first direction. The engagement surface 246 and the limit surface 248 may be identical to one another so that the first engagement feature 228 may be inserted into the second groove 214 without regard to the orientation of the first engagement feature 228. In other words, both of the side surfaces 244 may function as either the engagement surface 246 or the limit surface 248 depending on the orientation of the first engagement feature 228 relative to the inner and outer tubes 140, 150. Although FIGS. 7 and 8 depict a first engagement feature 228 with generally planar engagement and limit surfaces 246, 248, it is contemplated that the one or more first engagement features 228 may be substantially any type of protrusion extending outwardly from the inner tube 140, such as a cylinder, dome, or any other geometric shape. In some embodiments, the one or more first engagement features 228 are integrally formed with the circumferential wall 216 of the inner tube 140. In such embodiments, the inner tube 140 may not have the second groove 214 formed within the circumferential wall 216 of the inner tube 140.

Referring to FIG. 9, the outer tube 150 may be coaxially aligned with the inner tube 140 and may at least partially surround the inner tube 140. The outer tube 150 may be formed of two pieces, such as the first shell 152 and the second shell 154, that interlock with one another as explained above. Referring to FIGS. 6, 9, and 19-21, the slot 160 may be formed along the axial length of the outer tube 150 and may be in communication with the interior of the outer tube 150. The slot 160 may be defined between opposing, longitudinally-extending edge portions 162, 164 of the first and second shells 152, 154. As explained below, the operating element 108 may be extended and retracted through the slot 160 to close and open the strips of material 116, respectively.

One or more second engagement features 250 may be operably attached to the outer tube 150 to selectively engage the inner tube 140. The second engagement feature 250, such as second engagement feature 250A of FIG. 8 and/or second engagement feature 250B of FIG. 10, may extend inwardly from the outer tube 150 (e.g., from the circumferential wall 196 of the first shell 152 of the outer tube 150) into a rotational path of the first engagement feature 228 such that the first and second engagement features 228, 250 engage each other within one revolution of the inner tube 140 relative to the outer tube 150. As understood herein, reference to second engagement feature 250 necessarily includes a reference to both second engagement feature 250A and second engagement feature 250B. That is, absent a specific reference to either second engagement feature 250A or second engagement feature 250B, the description below with reference to second engagement feature 250 applies to both second engagement feature 250A and second engagement feature 250B. Any differing structure is discussed below with specific reference to either second engagement feature 250A or second engagement feature 250B.

Each second engagement feature 250 may include an engagement surface 252 configured to engage the engagement surface 246 of the one or more first engagement features 228. The engagement surface 252 of the second engagement feature 250 may complement the shape of the engagement surface 246 of the first engagement features 228. In some embodiments, the engagement surface 252 of the second engagement feature 250 may be planar. The second engagement feature 250 may extend inwardly from the first shell 152, the second shell 154, or both. The second engagement feature 250 may be positioned at various locations along the inner surface of the outer tube 150. In some embodiments, and as shown in FIGS. 9 and 10, the second engagement feature 250 may be positioned within the outer tube 150 so as to be located generally opposite the slot 160. The second engagement feature 250 may be constructed of substantially any type of material. For example, the second engagement feature 250 may be constructed from natural and/or synthetic materials, including plastics, metals, and/or other suitable materials. Although FIGS. 9 and 10 depict a second engagement feature 250 with a generally planar engagement surface 252, it is contemplated that the second engagement feature 250 may be substantially any type of protrusion extending inwardly from the outer tube 150 and configured to engage the one or more first engagement features 228.

Referring to at least FIG. 9, in one non-exclusive embodiment, the second engagement feature 250A may be an internal rib extending longitudinally along the axial length of the outer tube 150 and adjacent the first edge portion 156 of the first shell 152. In such embodiments, the second engagement feature 250A may be formed monolithically with the first shell 152 during, for example, the extrusion process. In some embodiments, the second engagement feature 250A may be formed integrally with the first edge portion 156 of the first shell 152.

Figure 11:
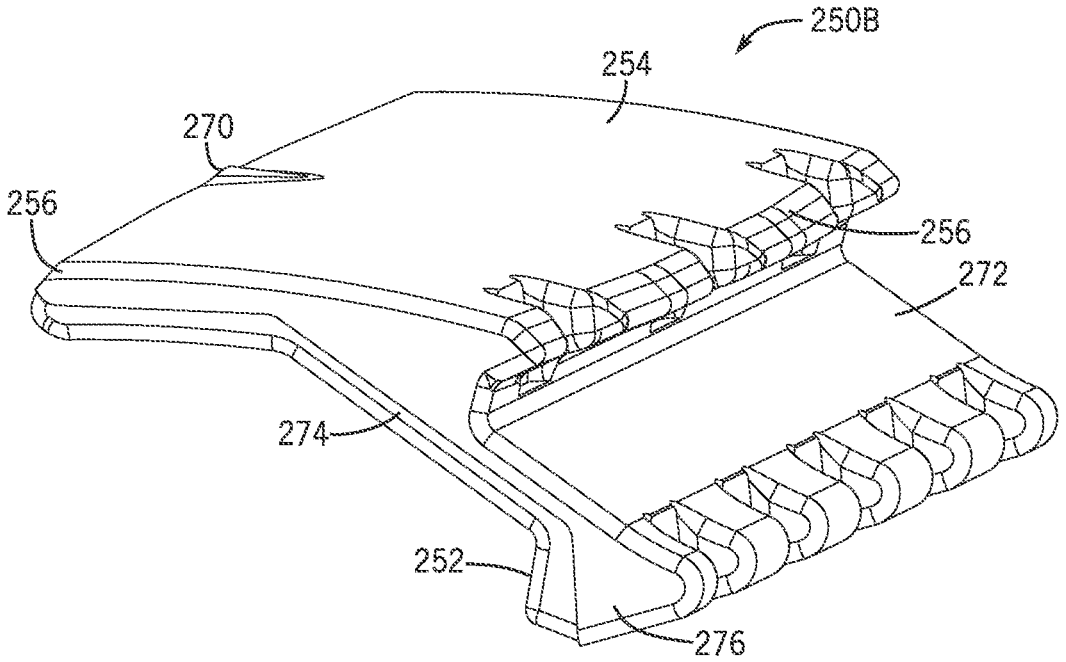
FIG. 11 is an enlarged isometric view of the second engagement feature of FIG. 10 in accordance with an embodiment of the present disclosure.

With reference to FIG. 10, to account for variation in the extrusion process creating the outer tube 150, for instance, the second engagement feature 250B in some embodiments may be formed as one or more separate structures coupled to the first shell 152 of the outer tube 150. Referring to FIG. 11, the second engagement feature 250B may include a planar first portion 254 from which a pair of opposing flanges 256 extends. In such embodiments, the opposing flanges 256 may couple the second engagement feature 250B to the first shell 152 of the outer tube 150 such as through corresponding engagement with opposing tabs 258 extending from the first shell 152 (see FIG. 10). In such embodiments, the second engagement feature 250B may be slid into substantially any position within a channel 260 defined between the opposing tabs 258 and extending along a length of the outer tube 150. To retain the second engagement feature 250B in position within the channel 260, at least one rib 270 may extend from the outer surface of the first portion 254 adjacent at least one of the opposing flanges 256 to create an interference fit between the at least one opposing flange 256 within the channel 260.

With reference to FIG. 11, a second portion 272 having opposing first and second ends 274, 276 may extend from the first portion 254 so at least a portion of the second portion 272 (e.g., the second end 276) extends within the rotational path of the first engagement feature 228 once the second engagement feature 250B is coupled to the outer tube 150. The first end 274 may be connected to the first portion 254 to space the second end 276 of the second portion 272 away from the first portion 254, and the second portion 272 may extend at an angle relative to the first portion 254 such that the second portion 272 at least partially overlies one of the opposing flanges 256. In the exemplary embodiments of FIGS. 10 and 11, the engagement surface 252 may be defined in the second portion 272 of the second engagement feature 250B (e.g., in the second end 276 of the second portion 272). With reference to FIG. 10, once the second engagement feature 250B is coupled to the outer tube 150, the second end 276 of the second portion 272 may extend adjacent the hinge assembly formed by the first edge portions 156, 158 of the first and second shells 152, 154.

In some embodiments, second engagement features 250B having various dimensions (e.g., engagement surfaces 252 of differing heights) may be interchangeably coupled to the outer tube 150 to account for differing or various gaps between the inner and outer tubes 140, 150. For example, a second engagement feature 250B having an engagement surface 252 dimensioned such that the second engagement feature 250B and/or the engagement surface 252 is considered "tall" may be coupled to a dual tube unit 138 having a relatively large gap between the inner and outer tubes 140, 150. In like manner, a second engagement feature 250B having an engagement surface 252 dimensioned such that the second engagement feature 250B and/or the engagement surface 252 is considered "short" may be coupled to a dual tube unit 138 having a relatively small gap between the inner and outer tubes 140, 150. Similarly, to account for sagging of the inner tube 140 and/or the outer tube 150 across the axial length of the dual tube unit 138, second engagement features 250B of various dimensions may be selectively positioned along the axial length of the dual tube unit 138 depending on the actual gap between the inner and outer tubes 140, 150.

Referring to FIGS. 9 and 10, the inner tube 140 may be generally free to rotate relative the outer tube 150 about the central longitudinal axis of the inner tube 140. As the inner tube 140 is rotated relative the outer tube 150 in a first direction (e.g., clockwise in FIGS. 9 and 10), the first engagement features 228 of the inner tube 140 may engage the second engagement feature 250 of the outer tube 150. Upon the first engagement features 228 engaging the second engagement feature 250, continued rotation of the inner tube 140 in the first direction causes the inner tube 140 to drivingly rotate the outer tube 150 in the first direction. That is, rotation of the inner tube 140 in the first direction may be applied to the outer tube 150 through the engagement of the first engagement feature 228 with the second engagement feature 250. As such, once the first engagement feature 228 engages the second engagement feature 250, the outer tube 150 generally rotates in conjunction with the inner tube 140 in the first direction.

Absent rotational forces on the outer tube 150, rotation of the inner tube 140 in a second direction opposite the first direction (counterclockwise in FIGS. 9 and 10) disengages the first engagement feature 228 from the second engagement feature 250, and the inner tube 140 is free to rotate relative the outer tube 150 for about one revolution in the second direction. Because the second engagement feature 250 extends inwardly from the outer tube 150 into the rotational path of the first engagement feature 228, as the inner tube 140 is rotated relative the outer tube 150 in the second direction, the limit surface 248 of the first engagement feature 228 may engage the second engagement feature 250 to prevent further rotation of the inner tube 140 relative the outer tube 150 in the second direction.

Figure 12:
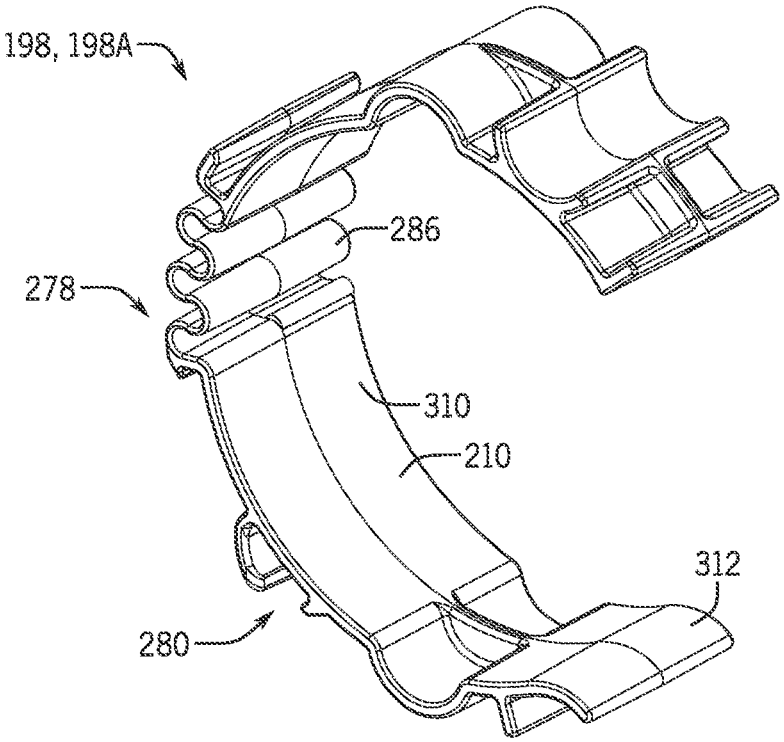
FIG. 12 is an isometric view of a collar in accordance with an embodiment of the present disclosure.
Figure 14:
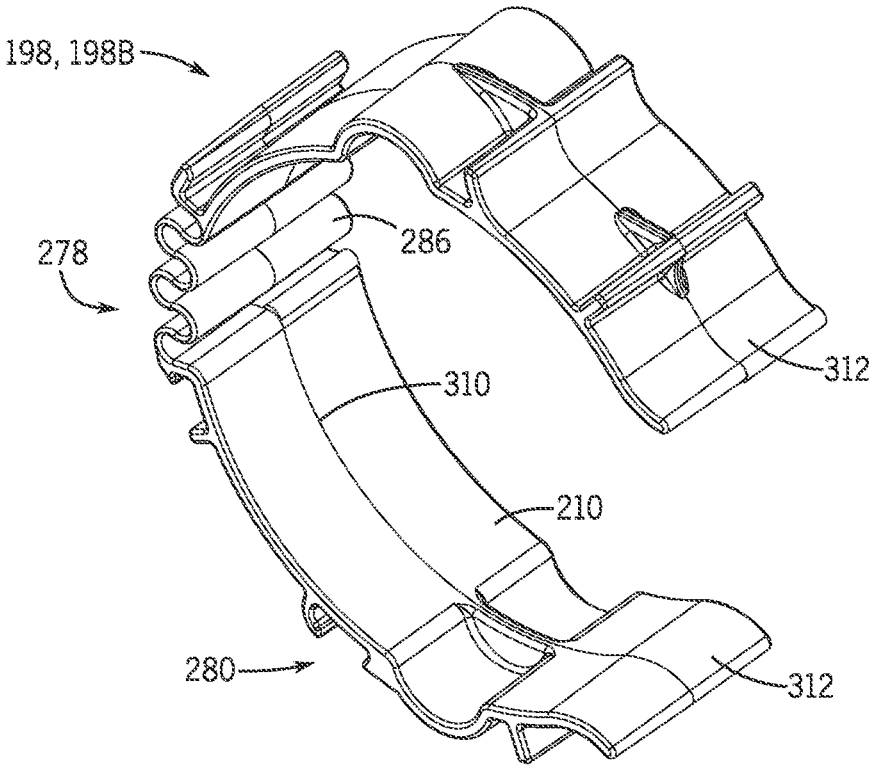
FIG. 14 is an isometric view of an alternative collar in accordance with an embodiment of the present disclosure.

Referring now to FIGS. 17 and 18, the dual tube unit 138 may include at least one collar 198, such as collar 198A of FIG. 12 and/or collar 198B of FIG. 14, positioned at least partially radially between the outer tube 150 and the inner tube 140. In some embodiments, the covering 100 includes a plurality of collars 198 spaced apart from one another along the axial length of the outer tube 150 (see FIG. 5). The plurality of collars 198 may substantially fill the space or gap between the inner tube 140 and the outer tube 150 and may provide structural rigidity along the axial length of the dual tube unit 138 by structurally connecting the inner tube 140 to the outer tube 150 to increase the structural cross-section of the combined structure of the dual tube unit 138, which helps to reduce deflection along the length of the structure. In some examples, the collars 198 may stiffen the dual tube unit 138 and reduce deflection of the tubes 140, 150 along their respective axial lengths. Also, the plurality of collars 198 may prevent unwanted contact between the inner tube 140 and the outer tube 150, thereby reducing operation noise of the covering 100. The collars 198 may be fixed against the inner surface of the outer tube and may be movable relative to the inner tube 140. The collars 198 may provide a bearing surface 210 for the outer surface 200 of the inner tube 140.

The one or more collars 198 may be attached to the outer tube 150 and may rotate in unison with the outer tube 150. Referring to FIGS. 17 and 18, each collar 198 may be attached to the first shell 152 and the second shell 154 of the outer tube 150 to, for example, secure the first and second shells 152, 154 together. Each collar 198 may be formed as an arc defined by a single radius and an angle that is greater than 180 degrees but less than 360 degrees. With reference to FIGS. 12-15, each collar 198 may include a first connection portion 278 and a second connection portion 280. As explained below, the first connection portion 278 may attach the collar 198 to the first shell 152, and the second connection portion 280 may attach the collar 198 to the second shell 154.

The first connection portion 278 of the collar 198 may include first and second attachment features 282, 284 separated from one another by a flex region 286. The first and second attachment features 282, 284 may extend generally outwardly from the collar 198. The first shell 152 may have a first connection tab 288 and a second connection tab 290 extending generally inwardly from the first shell 152. The first attachment feature 282 may engage the first connection tab 288 of the first shell 152, and the second attachment feature 284 may engage the second connection tab 290 of the first shell 152 to secure the collar 198 to the first shell 152. The first and second connection tabs 288, 290 may extend generally inwardly from the first shell 152. In some embodiments, the first attachment feature 282 and the first connection tab 288 may be complementary hooks engaging one another. Likewise, the second attachment feature 284 and the second connection tab 290 may be complementary hooks engaging each other.

The flex region 286 of the first connection portion 278 may be resiliently deformable (e.g., compressible and/or expandable). In some embodiments, the distance between the first and second attachment features 282, 284 of the first connection portion 278 may be different (e.g., greater) than the distance between the first and second connection tabs 288, 290 of the first shell 152. To facilitate, and retain, engagement of the respective attachment features 282, 284 and tabs 288, 290, the flex region 286 may be resiliently deformed during attachment of the collar 198 to the first shell 152. In some embodiments, the flex region 286 initially is compressed during attachment of the collar 198 to the first shell 152 so that the first and second attachment features 282, 284 may be positioned between the first and second connection tabs 288, 290, and the flex region 286 is subsequently uncompressed so that the respective attachment features 282, 284 and tabs 288, 290 engage one another. Once the collar 198 is attached to the first shell 152, the flex region 286 may provide a biasing force to maintain engagement of the first and second attachment features 282, 284 with the first and second connection tabs 288, 290. The collar 198 may abut against the inner surface of the first shell 152. In some embodiments, the first connection portion 278 does not include a flex region 286 and the respective attachment features 282, 284 and tabs 288, 290 are interference fit together.

Figure 13:
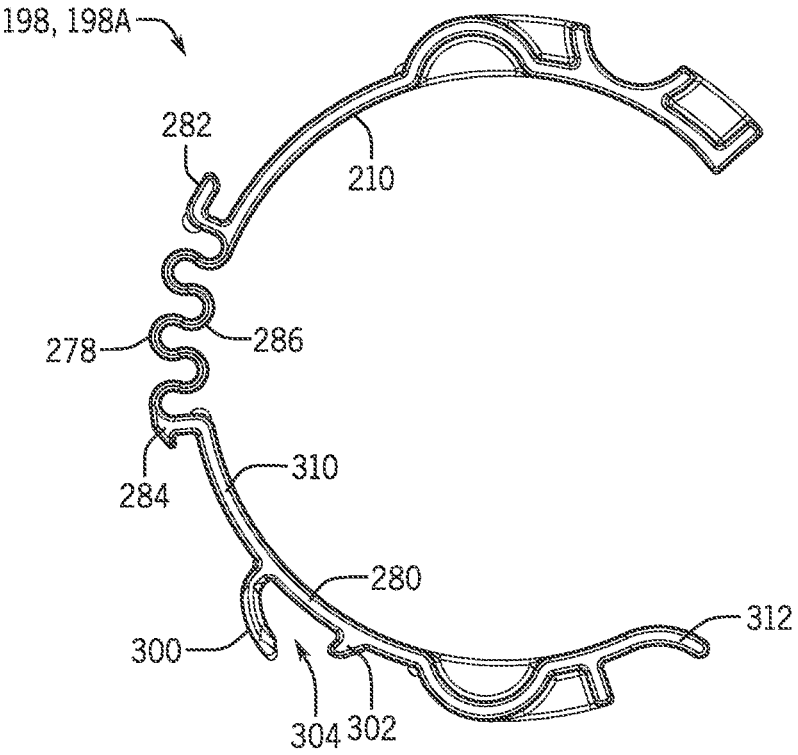
FIG. 13 is a side elevation view of the collar of FIG. 12 in accordance with an embodiment of the present disclosure.
Figure 15:
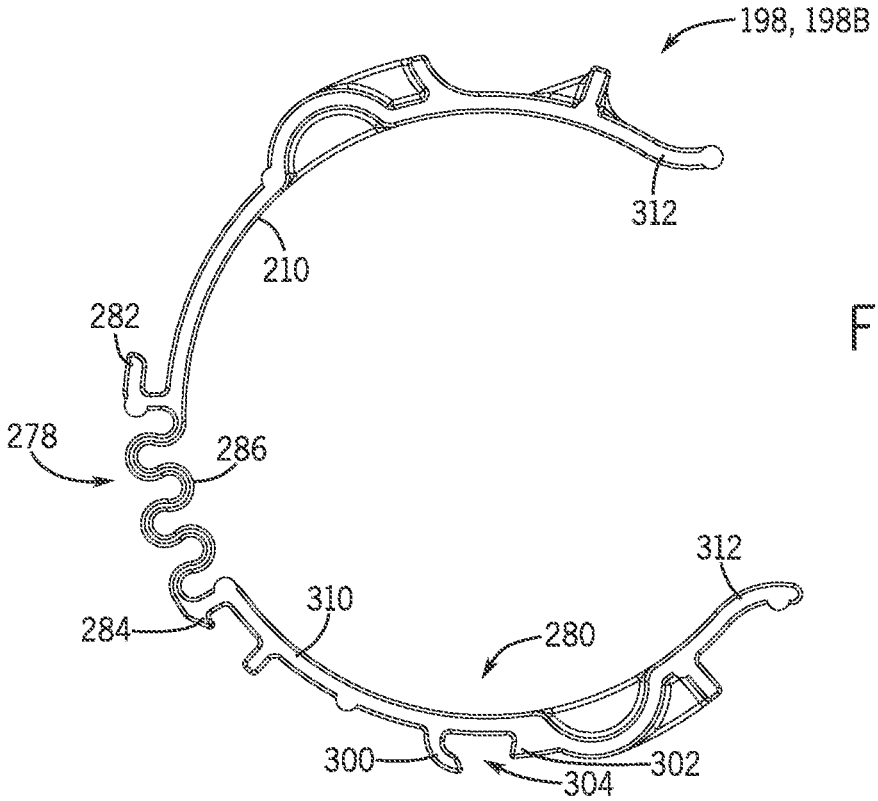
FIG. 15 is an elevation view of the collar of FIG. 14 in accordance with an embodiment of the present disclosure.

With reference to FIGS. 13 and 15, the second connection portion 280 of the collar 198 may include first and second attachment features 300, 302 separated from each other by a receiving space 304. The first and second attachment features 300, 302 may extend generally outwardly from the collar 198. The second shell 154 may have a first connection tab 306 and a second connection tab 308 extending generally inwardly from the second shell 154. The first attachment feature 300 may engage the first connection tab 306 and the second attachment feature 302 may engage the second connection tab 308 to secure the collar 198 to the second shell 154. In some embodiments, the first and second connection tabs 306, 308 may be snugly received within the receiving space 304 between the first and second attachment features 300, 302 of the second connection portion 280 to secure the collar 198 to the second shell 154. In some embodiments, the first attachment feature 300 and the first connection tab 306 may be complementary hooks engaging each other. Likewise, the second attachment feature 302 and the second connection tab 308 may be complementary hooks engaging each other.

The first and second connection portions 278, 280 of the collar 198 may be peripherally spaced from one another. Referring to FIGS. 12-15, the collar 198 may include a separation portion 310 positioned between the first and second connection portions 278, 280. The separation portion 310 may set the distance between the first and second connection portions 278, 280. When the collar 198 is attached to the first and second shells 152, 154 of the outer tube 150, the separation portion 310 may span across the slot 160 formed between the first and second shells 152, 154. In such embodiments, the separation portion 310 may set the lateral dimension of the slot 160.

The collar 198 may restrict both outward movement of the second edge portions 162, 164 of the first and second shells 152, 154 away from the inner tube 140 and inward movement of the second edge portions 162, 164 towards the inner tube 140. Referring to FIGS. 17 and 18, the first connection portion 278 of the collar 198 may be located between the first and second edge portions 156, 162 of the first shell 152. Referring now to FIG. 17, in one non-exclusive embodiment, the second connection portion 280 of the collar 198A may be at least partially positioned between the second edge portions 162, 164 of the first and second shells 152, 154. As shown in FIG. 17, the first attachment feature 300 of the second connection portion 280 may extend through the slot 160. The first attachment feature 300 may be positioned between the second edge portions 162, 164 of the first and second shells 152, 154, respectively, and may engage the second edge portion 164 of the second shell 154. The first attachment feature 300 may substantially surround the first connection tab 306, which may form the leading edge of the second edge portion 164 of the second shell 154, to restrict movement of the second edge portion 164 of the second shell 154 towards the second edge portion 162 of the first shell 152. The second attachment feature 302 may engage the second connection tab 308, which may form a back portion of the second edge portion 164 of the second shell 154, to further restrict movement of the second edge portion 164, and therefore the second shell 154, relative to the collar 198 and the first shell 152. As shown in FIG. 17, the second edge portion 164 of the second shell 154 may be positioned inwardly towards the inner tube 140 to allow the first attachment feature 300 of the second connection portion 280 to sit substantially flush with the outer surface of the outer tube 150.

In some shade applications, the collar 198A may cause a portion of the shade 106 to "pucker" or create wave-like undulations or the like adjacent an exteriorly positioned portion (e.g., the first attachment feature 300 in FIG. 17) of the collar 198A. This "puckering" or wave-like undulation feature may be caused by the first attachment feature 300 of the collar 198A contacting the shade 106, and may create a non-linear engagement line between the shade 106 and the dual tube unit 138, which may be undesirable in some applications. This "puckering" or wave-like undulation feature may be reduced (e.g., eliminated) by positioning the entirety of the collar 198 within the interior of the dual tube unit 138. With reference to FIG. 18, collar 198B is illustrated that may be used in addition to or instead of the collar 198A. The collar 198B generally is positioned entirely within the interior of the dual tube unit 138 such that the collar 198B does not "pucker" or create wave-like undulations in the shade 106. The first attachment feature 300 of the collar 198B does not extend through the slot 160. Rather, the first attachment feature 300 of the collar 198B is positioned within the interior of the outer tube 150 and engages the first connection tab 306.

Referring to FIG. 18, both the first and second connection tabs 306, 308 of the outer tube 150 may be spaced away from the second edge portion 164 of the second shell 154 so both the first and second attachment features 300, 302 may be positioned within the interior of the dual tube unit 138. As illustrated, the first and second attachment features 300, 302 may substantially surround the first and second connection tabs 306, 308 such that both the first and second connection tabs 306, 308 are captured within the receiving space 304 to both secure the collar 198B to the second shell 154 and restrict movement of the second edge portion 164 of the second shell 154 towards the second edge portion 162 of the first shell 152, for instance. In some embodiments, the collar 198 may include terminal end portions 312, and one of the end portions 312 may extend at least partially about the hinge assembly formed by the first edge portions 156, 158 of the first and second shells 152, 154. As illustrated in FIGS. 17 and 18, at least one of the end portions 312 may curve away from the inner tube 140 and towards the circumferential wall 196 of the outer tube 150 to, for example, permit smooth rotation of the inner tube 140 relative to the collars 198.

Referring now to FIGS. 16-18, the one or more collars 198 may extend circumferentially around a majority of the outer surface 200 of the inner tube 140. The collar 198 may provide a bearing surface 210 for an outer surface 200 of the inner tube 140 (see FIGS. 17 and 18). As shown in FIGS. 17 and 18, some clearance may be provided between the outer surface 200 of the inner tube 140 and the bearing surface 210 of the collar 198 to reduce relative friction between the inner tube 140 and the collar 198 and permit free rotation of the inner tube 140 relative the outer tube 150. In some examples, a plurality of collars 198 may be spaced apart from one another along the axial length of the inner tube 140. As shown in FIG. 16, the collars 198 may be positioned between the first engagement features 228 along the axial length of the inner tube 140. The plurality of collars 198 may be located symmetrically about a midpoint of the inner tube 140 along the axial length of the inner tube 140. As shown in FIGS. 17 and 18, each collar 198 may span across the slot 160 in connecting the first shell 152 and the second shell 154 together. The collars 198 may be constructed of substantially any type of material. For example, each collar 198 may be constructed from natural and/or synthetic materials, including plastics, ceramics, and/or other suitable materials.

With reference to FIGS. 19-21, the shape of the slot 160 and its orientation on the outer tube 150 may encourage smooth and predictable passage of the operating element 108 to move the strips of material 116 between open and closed positions (see FIGS. 2-3A). The shape and orientation of the slot 160 may allow the operating element 108 to drop vertically out of the slot 160. The generally tangential orientation of the slot 160 on the outer tube 150 may assist in this regard. A lower free edge 314 of the slot 160 (defined by the second edge portion 164 of the second shell 154 of the outer tube 150) may be curved or rounded to allow for smooth travel of the operating element 108 over the second edge portion 164 as the operating element 108 is extended and retracted through the slot 160. The lower free edge 314 of the slot 160 may be manufactured from an anti-static material that inhibits triboelectric charging such that travel of the operating element 108 over the second edge portion 164 does not induce an electric charge in either the operating element 108 or the outer tube 150. The slot 160 may be positioned on the outer tube 150 so as to be located below and adjacent to the first groove 212 when the shade 106 is in its fully extended configuration (see FIG. 2).

With continued reference to FIGS. 19-21, the shade 106 may be coupled to and wrappable about the outer tube 150. For example, the support sheet 114 and the plurality of strips of material 116 may be wrapped about the outer tube 150 and concealed in the head rail 102. As explained above, the support sheet 114 may be attached along its top edge portion 220 to the outer tube 150. The shade 106 may be wrapped about or unwrapped from a rear side of the outer tube 150, with the rear side of the outer tube 150 positioned between a front side of the outer tube 150 and a street side of an associated architectural opening (in FIGS. 19-21, the rear side of the outer tube 150 is to the right). Generally, rotation of the outer tube 150 in a first direction (counterclockwise in FIGS. 19-21) retracts the shade 106 by winding it about the outer tube 150 to a position adjacent one or more sides (such as the top side) of an associated architectural opening, and rotation of the outer tube 150 in a second, opposite direction extends the shade 106 across the opening (such as to the bottom side of the architectural opening).

Referring still to FIGS. 19-21, the operating element 108 may be coupled to and wrappable about the inner tube 140 and the outer tube 150. An end portion, such as the top end portion 224, of the operating element 108 may be attached to the inner tube 140, as discussed previously. A first portion 316, such as an upper portion, of the operating element 108 may be wrapped about or unwrapped from the inner tube 140. The first portion 316 may include a sufficient length of the operating element 108 to wrap one time around the inner tube 140. A second portion 318, such as a lower remainder portion, of the operating element 108 may be wrapped about or unwrapped from the outer tube 150 in conjunction with the shade 106 (see FIG. 19). Generally, rotation of the inner tube 140 in a first direction (counterclockwise in FIGS. 19-21) relative to the outer tube 150 extends the operating element 108 along the front face 118 of the support sheet 114 by unwinding the operating element 108 from the inner tube 140, causing the strips of material 116 to close (see FIG. 20). Rotation of the inner tube 140 in a second, opposite direction (clockwise in FIGS. 19-21) relative to the outer tube 150 retracts the operating element 108 by winding the operating element 108 about the inner tube 140, causing the strips of material 116 to open (see FIG. 21).

The operation of the dual tube unit 138 is described below with reference to FIGS. 1-3A and 19-21. As shown in FIGS. 1 and 19, the shade 106 is in a fully-retracted position and concealed within the head rail 102. In this configuration (see FIG. 19), the first portion 316 of the operating element 108 is wrapped about the inner tube 140, and the support sheet 114, the second portion 318 of the operating element 108, and the plurality of strips of material 116 are wrapped about the outer tube 150. In some embodiments, the bottom rail 104 engages a portion of the head rail 102 to define an upper limit stop.

To extend the shade 106 from the head rail 102, the user may actuate the drive mechanism 134 to cause the inner tube 140 to rotate in a shade extension direction (clockwise in FIGS. 19-21), which in turn may cause the outer tube 150 to rotate in the shade extension direction (clockwise in FIGS. 19-21) due at least in part to rotational motion of the inner tube 140 being transferred to the outer tube 150 by the operating element 108. As the shade 106 extends off of the outer tube 150, the outer tube 150 generally rotates in unison with the inner tube 140. In general, the dual tube unit 138 rotates in the direction the user controls the inner tube 140 to rotate.

Referring to FIGS. 2, 2A, and 20, the shade 106 extends off of the rear of the outer tube 150 in a closed or collapsed configuration in which the support sheet 114, the operating element 108, and the plurality of strips of material 116 are relatively close together extending vertically in an approximately coplanar, contiguous relationship with each other. The second portion 318 of the operating element 108 may be positioned at least partially between the support sheet 114 and the strips of material 116. Once the shade 106 is substantially unwrapped from the outer tube 150, continued rotation of the inner tube 140 in the shade extension direction wraps the first portion 316 of the operating element 108 about the inner tube 140 to shift the strips of material 116 from a closed position (FIGS. 2, 2A, and 20) to an open position (FIGS. 3, 3A, and 21) by raising the second edge portions 130 of the strips of material 116 creating a gap between adjacent strips of material 116 through which the support sheet 114 is visible.

Referring to FIGS. 3, 3A, and 21, the covering 100 is shown with the shade 106 in a fully extended position with the strips of material 116 in an open, such as retracted, configuration. In this position, the support sheet 114 may be vertically-extended with the strips of material 116 folded and extending substantially horizontally away from the front face 118 of the support sheet 114 towards the interior of a room. The operating element 108 may be at least partially wrapped about the inner tube 140 and may extend vertically downwardly through the slot 160 and along the front face 118 of the support sheet 114 towards the bottom rail 104. Referring to FIG. 21, each of the second edge portions 130 of the strips of material 116 may be positioned above a lower periphery 320 defined as the lowermost portion of the strips of material 116 when the strips of material 116 are in the open or retracted configuration. In some embodiments, the slot 160 may be referred to as being at 4 o'clock when the shade 106 is fully extended and the strips of material 116 are in an open or retracted configuration. Rotation of the inner tube 140 in a clockwise or counterclockwise direction from the position shown in FIG. 21 causes the second edge portions 130 of the strips of material 116 to move up or down and the strips of material 116 to re-orient into a more open or closed configuration, respectively.

When the shade 106 is fully unwrapped from the outer tube 150, the slot 160 in the outer tube 150 may be rotationally oriented within the head rail 102 such that the operating element 108 may retract upwardly through the slot 160 and into the interior space of the outer tube 150 in a substantially vertical manner immediately adjacent the support sheet 114 upon rotation of the inner tube 140 in the shade extension direction. The slot 160 may be rotationally oriented within the head rail 102 such that the operating element 108 may drop vertically out of the slot 160 immediately adjacent the support sheet 114 upon rotation of the inner tube 140 in an opposite, shade retraction direction (counterclockwise in FIG. 21).

As mentioned above, the lower free edge 314 of the slot 160 (defined by the second edge portion 164 of the second shell 154 of the outer tube 150) may be curved or rounded to allow for smooth travel of the operating element 108 over the second edge portion 164 as the operating element 108 is extended and retracted through the slot 160. The general orientation of the slot 160 allows the weight of the lower portions of the strips of material 116 to bias the operating element 108 downwardly from the inner tube 140 through the slot 160 when the tension in the operating element 108 is decreased due to rotation of the inner tube 140 in the shade extension direction. The drive mechanism 134 may include a brake system operably coupled to the inner tube 140 to restrict unwanted downward movement of the operating element 108, and thus the closing of the strips of material 116.

In order to open or retract the strips of material 116, the drive mechanism 134 may be actuated by the user to rotate the inner tube 140 in the shade extension direction to retract the operating element 108 through the slot 160 and wrap the operating element 108 about the inner tube 140. During retraction of the operating element 108, the outer tube 150 and support sheet 114 may remain stationary due to the weight of the support sheet 114 and the weight of the bottom rail 104 maintaining the rotational position of the outer tube 150. In some embodiments, as discussed below, the positive lock mechanism 166 may be used to limit rotation of the outer tube 150 upon full extension of the shade 106. During opening or retraction of the strips of material 116, the inner tube 140 rotates relative to the outer tube 150, with the first and second internal bushings 182, 184 supporting the respective ends of the inner tube 140. As the inner tube 140 rotates in the shade extension direction, the operating element 108 may be wrapped about the inner tube 140 as the operating element 108 is retracted through the slot 160 formed in the outer tube 150. Rotation of the inner tube 140 in the shade extension direction may move the limit nut 170 along the limit screw 168 towards the lower limit stop 180, as explained in more detail below.

Referring to FIGS. 3, 3A, and 21, the covering 100 is shown with the shade 106 in a fully extended position with the strips of material 116 in an open or retracted configuration. In this position, the support sheet 114 may be vertically extended with gaps defined between the strips of material 116. In some embodiments, opening the strips of material 116 may permit light to pass through the support sheet 114, between the opened or retracted strips of material 116, and into the interior of a room. In the closed configuration (see FIGS. 2, 2A, and 20), the strips of material 116 may close the gaps and inhibit light from passing through the shade 106. To control the amount of light passing through the shade 106, the second edge portions 130 of the strips of material 116 may be manipulated by the operating element 108 to configure the strips of material 116 in a fully open position, a partially open position, or a closed position.

Retraction of the shade 106 may be accomplished in reverse order as compared to the extension sequence described above, such as generally following FIG. 21 to FIG. 19. In FIGS. 3, 3A, and 21, the support sheet 114 is disposed in a fully extended position with the strips of material 116 in an open or retracted configuration. The retraction process generally involves actuation of the drive mechanism 134 to first rotate the inner tube 140 in a shade retraction direction (counterclockwise in FIGS. 19-21) relative to the outer tube 150 to extend the operating element 108 relative to the support sheet 114 and thereby close the strips of material 116. When the operating element 108 is fully extended and the strips of material 116 are fully closed, continued rotation of the inner tube 140 in the shade retraction direction drivingly rotates the outer tube 150 in the shade retraction direction (counterclockwise in FIGS. 19-21) to retract the shade 106 and the suspended portion of the operating elements 108 onto the outer tube 150. This sequence is described further below.

To close the cells from the open configuration of FIGS. 3, 3A, and 21, the user may actuate the drive mechanism 134 to cause the inner tube 140 to rotate in the shade retraction direction relative to the outer tube 150, which in turn may unwrap the operating element 108 from the inner tube 140 and lower the second edge portions 130 of the strips of material 116 downwardly along the front face 118 of the support sheet 114. Referring to FIGS. 19-21 in reverse order, when the strips of material 116 are in the closed or extended position, the first engagement features 228 may engage the second engagement feature 250 of the outer tube 150. Referring to FIGS. 19 and 20, when the first engagement features 228 are engaged with the second engagement feature 250 of the outer tube 150, the outer tube 150 may be driven in the shade retraction direction (counterclockwise in FIGS. 19 and 20) by the drive mechanism 134 through rotation of the inner tube 140 in the same retraction direction. As such, when the first engagement features 228 engage the second engagement feature 250 and a retraction force (counterclockwise in FIGS. 19 and 20) is applied to the inner tube 140 by the drive mechanism 134, the outer tube 150 generally rotates in conjunction with the inner tube 140.

Referring to FIG. 19, as the outer tube 150 continues to rotate in the retraction direction, the shade 106 and the suspended portion of the operating elements 108 may be wrapped around the outer tube 150. The shade 106 may be under tension as it is wrapped about the outer tube 150 due to the weight of the suspended portion of the shade 106 and the bottom rail 104. When the shade 106 is fully retracted, the bottom rail 104 may engage a portion of the head rail 102, such as an abutment, to serve as an upper limit stop for the dual tube unit 138. It is contemplated that other mechanisms may be utilized to define the top retraction position, including an upper limit stop positioned on the limit screw 168 opposite the lower limit stop 180. For example, an upper limit stop may be formed on the limit screw 168 and positioned along the screw such that the limit nut 170 engages the upper limit stop upon full retraction of the shade 106. It is contemplated that the shade 106 may be wrapped about or unwrapped from the front side of the outer tube 150.

Figure 22:
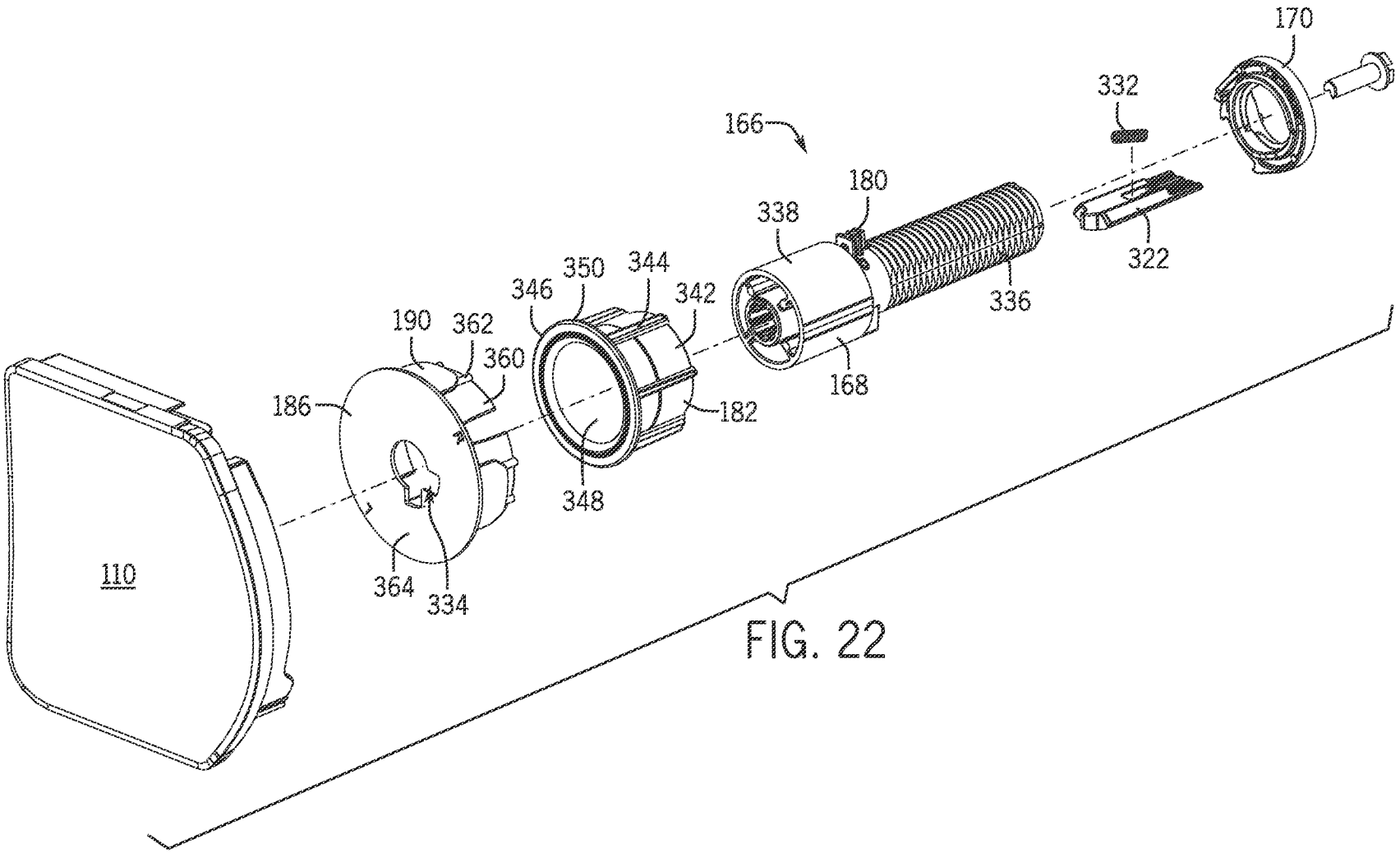
FIG. 22 is a top front isometric, exploded view of limit stop components of a covering in accordance with an embodiment of the present disclosure.
Figure 23:
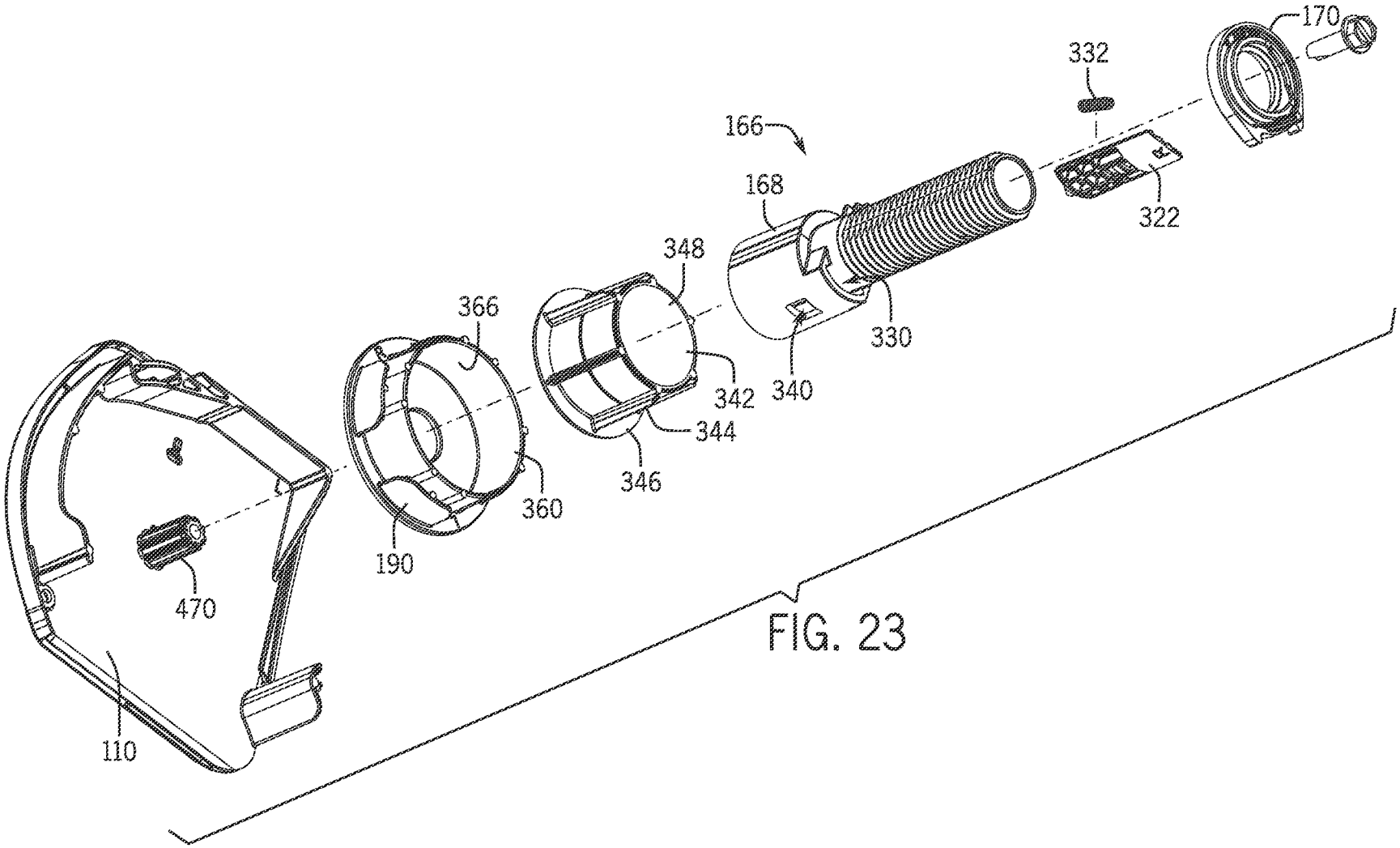
FIG. 23 is a bottom front isometric, exploded view of the limit stop components of FIG. 22 in accordance with an embodiment of the present disclosure.
Figure 24:
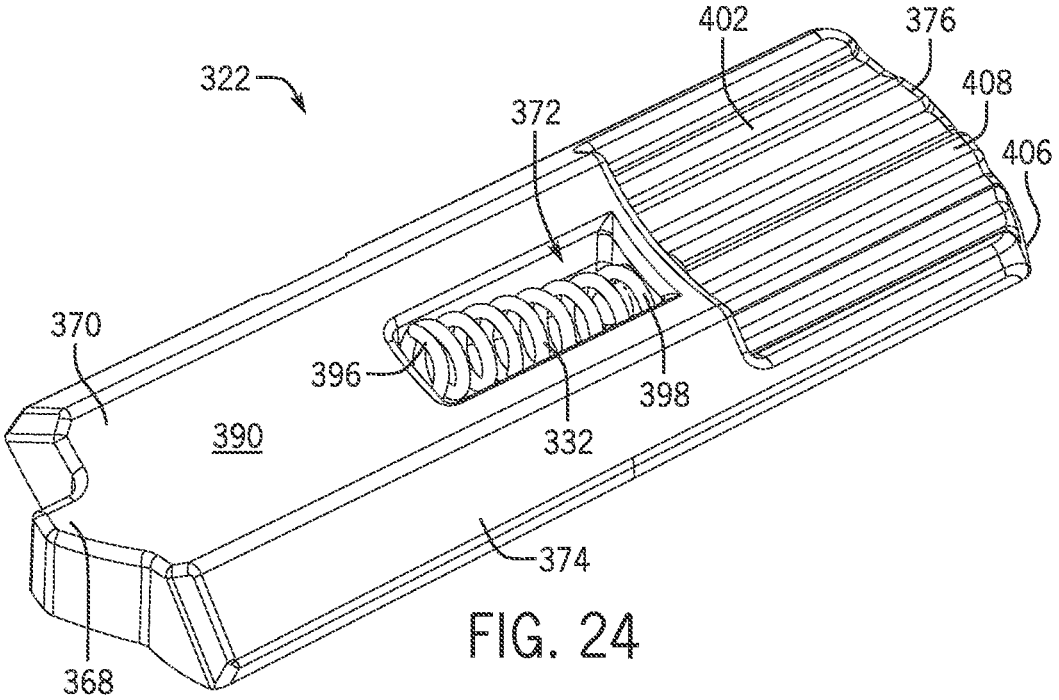
FIG. 24 is an isometric view of a locking element in accordance with an embodiment of the present disclosure.

Referring to FIGS. 22 and 23, the covering 100 may include a lock mechanism 166 to positively lock rotation of the outer tube 150 upon full extension of the support sheet 114, thereby ensuring the support sheet 114 remains in the fully extended position and is substantially unaffected by rotation of the inner tube 140 during extension or retraction of the operation element 10 relative to the support sheet 114. The lock mechanism 166 may be movable (such as pivotable, translatable, or other suitable movements) between a first position that permits rotation of the outer tube 150 and a second position that restricts rotation of the outer tube 150. In one example, as illustrated in FIG. 22, the lock mechanism 166 includes a locking element 322, a limit screw 168 having a channel or cavity 330 formed therein to receive at least a portion of the locking element 322, a biasing spring 332, a limit nut 170 configured to engage the locking element 322 and threadedly engaged with and travelable axially along the limit screw 168, the first internal bushing 182, and a first outer bushing 186 having a stop aperture 334 defined therein to receive a portion of the locking element 322. In some embodiments, the locking element 322 may translate longitudinally through the channel or cavity 330 to engage the stop aperture 334 defined in the first outer bushing 186 to restrict rotation of the outer tube 150. The biasing spring 332 may bias the locking element 322 to automatically return to the first position permitting rotation of the outer tube 150. Although the lock mechanism 166 is depicted in conjunction with the left end cap 110, the lock mechanism 166 may be used in conjunction with the right end cap 112.

Referring to FIGS. 22, 23, 35, and 36, the lock mechanism 166 may be secured to the left end cap 110 and extend axially away from the left end cap 110 towards the right end cap 112. The limit screw 168, limit nut 170, and locking element 322 may be housed within the inner tube 140. The limit screw 168 may be removably connected to the left end cap 110 with a fastener.

With reference to FIGS. 22 and 23, the limit screw 168 may be axially aligned with the rotation axis of the inner tube 140. The limit screw 168 may be positioned internal to the inner tube 140 and may extend longitudinally along an inner periphery of the inner tube 140 in a spaced relationship (see FIG. 5). The limit screw 168 may include a threaded portion 336 and an unthreaded portion 338. The lower limit stop 180 may be positioned at the intersection of the threaded and unthreaded portions 336, 338. The cavity 330 may be positioned diametrically opposite the lower limit stop 180. The cavity 330 may extend along the unthreaded portion 338 of the limit screw 168 to a terminal end of the limit screw 168 and may open to the first outer bushing 186. The limit screw 168 may define an aperture 340 extending from a circumferential periphery of the unthreaded portion 338 of the limit screw 168 into the cavity 330. The aperture 340 may receive a corresponding protrusion of the locking element 322 to substantially retain the locking element 322 in the cavity 330.

With reference to FIGS. 22, 23, 35, and 36, the first internal bushing 182 may be rotatably mounted onto the unthreaded portion 338 of the limit screw 168. The first internal bushing 182 may include a sleeve 342, a plurality of longitudinally-extending, circumferentially-spaced ribs 344 projecting radially outwardly from the sleeve 342, and a flange 346 projecting radially outwardly from an end of the sleeve 342. The sleeve 342 may define a substantially cylindrical inner surface 348 that rotatably bears against the unthreaded portion 338 of the limit screw 168. The ribs 344 may engage an inner surface of the inner tube 140 so that the first internal bushing 182 rotates in unison with the inner tube 140 about the unthreaded portion 338 of the limit screw 168. The flange 346 may project radially outwardly of the ribs 344 and may abut against an end of the inner tube 140 to axially locate the first internal bushing 182 relative to the inner tube 140. The flange 346 may have a substantially cylindrical outer surface 350. The first internal bushing 182 may be radially positioned between the limit screw 168 and the first outer bushing 186.

Referring still to FIGS. 22, 23, 35, and 36, the first outer bushing 186 may be rotatably mounted onto the first internal bushing 182. The first outer bushing 186 may include a sleeve 360, a plurality of longitudinally-extending, circumferentially-spaced ribs 362 projecting radially outwardly from the sleeve 360, a terminal wall 364 projecting radially outwardly from an end of the sleeve 360, and multiple axial projections 190 attached to and extending from the terminal wall 364 in an axial direction toward the outer tube 150. The sleeve 360 may define a substantially cylindrical inner surface 366 that rotatably bears against the outer surface 350 of the flange 346 of the first internal bushing 182. The ribs 362 may engage an inner surface of the outer tube 150 so that the first outer bushing 186 rotates in unison with the outer tube 150 about the first internal bushing 182. The terminal wall 364 may project radially outwardly of the ribs 362 and may abut against an end of the outer tube 150 to axially locate the first outer bushing 186 relative to the outer tube 150. As discussed previously, the axial projections 190 may be snugly received in an end of the outer tube 150 to prevent relative movement between the first and second shells 152, 154.

With further reference to FIGS. 22, 23, 35, and 36, the terminal wall 364 of the first outer bushing 186 may be positioned between the left end cap 110 and the limit screw 168. With reference to FIGS. 22 and 23, the terminal wall 364 may be oriented perpendicularly to the rotation axis of the inner tube 140. The terminal wall 364 may define one or more stop apertures 334 (e.g., channels, recesses, slots, or voids) positioned therein to receive a portion of the locking element 322. Referring to FIGS. 24-29, in some embodiments, the locking element 322 includes an engagement feature 368, such as a knob, positioned on a first end 370 of the locking element 322. The engagement feature 368 may be configured such that it is received within the stop aperture 334 when the locking element 322 is translated longitudinally along a length of the limit screw 168 toward the left end cap 110 (see FIG. 44, for instance). The engagement feature 368 and the stop aperture 334 may be configured such that insertion of the engagement feature 368 into the stop aperture 334 substantially restricts or prevents rotation of the first outer bushing 186, thereby substantially restricting or preventing rotation of the outer tube 150.

Referring to FIGS. 24-31A, the locking element 322 may restrict rotation of the outer tube 150 when the support sheet 114 is in the fully extended position. The locking element 322 may translate longitudinally through the cavity 330 relative to the limit screw 168. The locking element 322 may be configured to substantially fill and generally match the shape of the cavity 330. The locking element 322 may be secured within the cavity 330 such that the locking element 322 is not movable in a rotational direction about the rotation axis of the inner tube 140.

In some embodiments, the engagement feature 368 of the locking element 322 may be received within the stop aperture 334 of the first outer bushing 186 when the locking element 322 translates longitudinally through the cavity 330 relative to the limit screw 168 and towards the left end cap 110. Reception of the engagement feature 368 within the stop aperture 334 may substantially restrict rotation of the first outer bushing 186. As explained above, because the first outer bushing 186 is keyed to the outer tube 150 and the locking element 322 is not rotatable about the rotation axis of the inner tube 140, insertion of the engagement feature 368 into the stop aperture 334 may substantially restrict or limit rotation of the outer tube 150.

Figure 25:
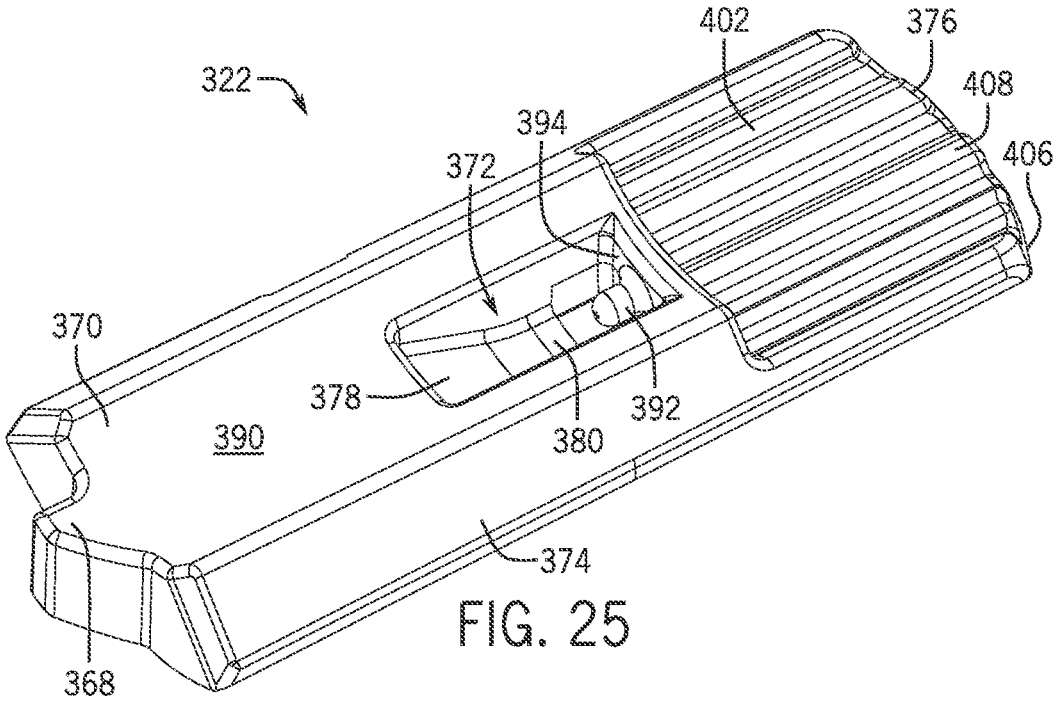
FIG. 25 is an isometric view of the locking element of FIG. 24 with a biasing spring removed for clarity in accordance with an embodiment of the present disclosure.
Figure 26:
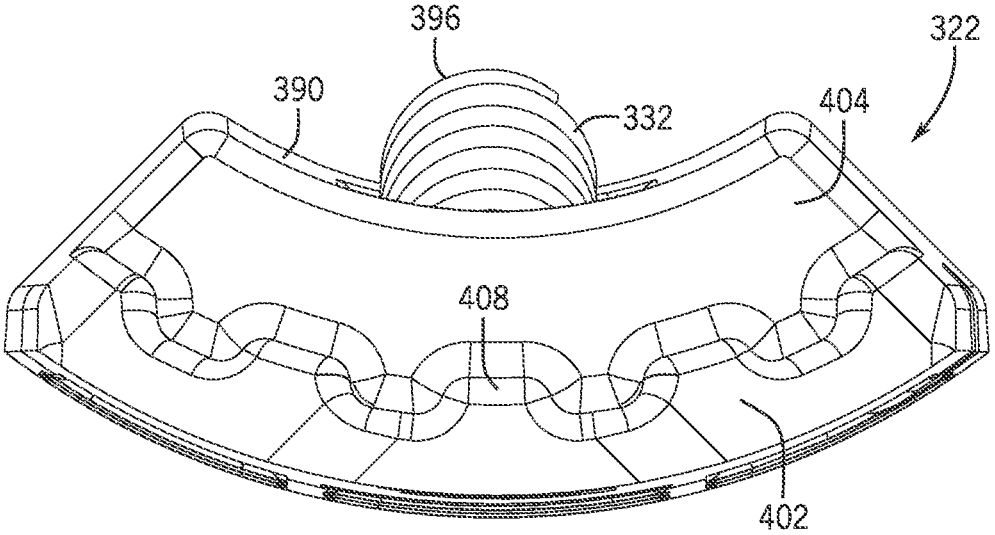
FIG. 26 is a rear elevation view of the locking element of FIG. 24 in accordance with an embodiment of the present disclosure.

Referring to FIG. 25, the locking element 322 may have a recess 372 defined within a main body 374 of the locking element 322. The recess 372 may be formed substantially along a longitudinal center-line of the locking element 322. Additionally, or alternatively, the recess 372 may be formed substantially midway between the first end 370 and a second, opposite end 376 of the locking element 322. The recess 372 may include an upwardly sloping ramp 378 transitioning from a bottom wall 380 of the recess 372 towards an interior surface 390 of the locking element 322. In some examples, a retention feature, such as a post 392, may project from an end wall 394 of the recess 372 in a longitudinal direction towards the first end 370 of the locking element 322. As explained below, the post 392 may substantially restrict lateral movement of the biasing spring 332 positioned within the recess 372.

Referring to FIGS. 24 and 26-30, the biasing spring 332 may be positioned substantially within the recess 372. The biasing spring 332 may include a first end 396 and a second end 398. The second end 398 may abut the end wall 394 and circumferentially surround the post 392. The second end 398 of the biasing spring 332 may fit snugly around the post 392 to prevent lateral and translational movement of the second end 398 relative the post 392. The biasing spring 332 may be positioned adjacent the sloping ramp 378 to position the first end 396 of the biasing spring 332 substantially external the recess 372. Referring to FIGS. 31 and 31A, the first end 396 of the biasing spring 332 may contact an abutment feature 400 formed within the cavity 330 of the limit screw 168. The abutment feature 400 may receive the portion of the biasing spring 332 external the recess 372. Axial displacement of the locking element 322 towards the left end cap 110 compresses the biasing spring 332 whereas axial displacement of the locking element 322 away from the left end cap 110 decompresses the biasing spring 332. When the locking element 322 is in the first position wherein the locking element 322 does not restrict rotation of the outer tube 150, the biasing spring 332 may be decompressed. When the locking element 322 is in the second position wherein the locking element 322 restricts rotation of the outer tube 150, the biasing spring 332 may be compressed and may bias the locking element 322 towards the first position. The locking element 322 may be biased to automatically return to the first position absent an external force displacing the locking element 322 towards the second position.

Figure 27:
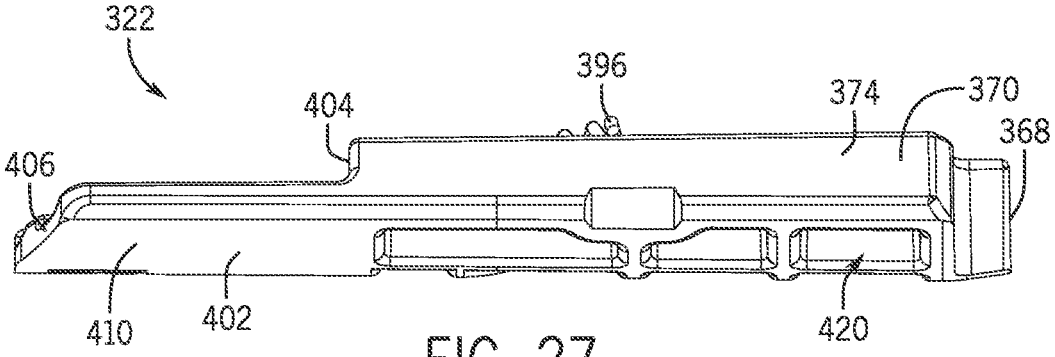
FIG. 27 is a side elevation view of the locking element of FIG. 24 in accordance with an embodiment of the present disclosure.
Figure 28:
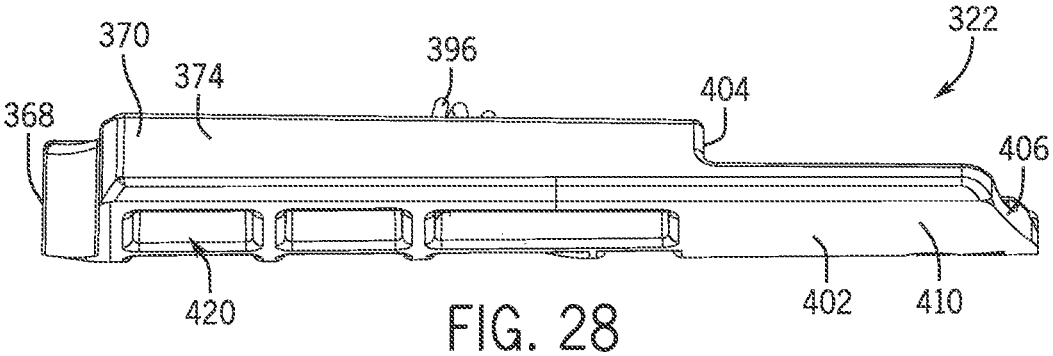
FIG. 28 is a side elevation view of the locking element of FIG. 24 in accordance with an embodiment of the present disclosure.
Figure 30:
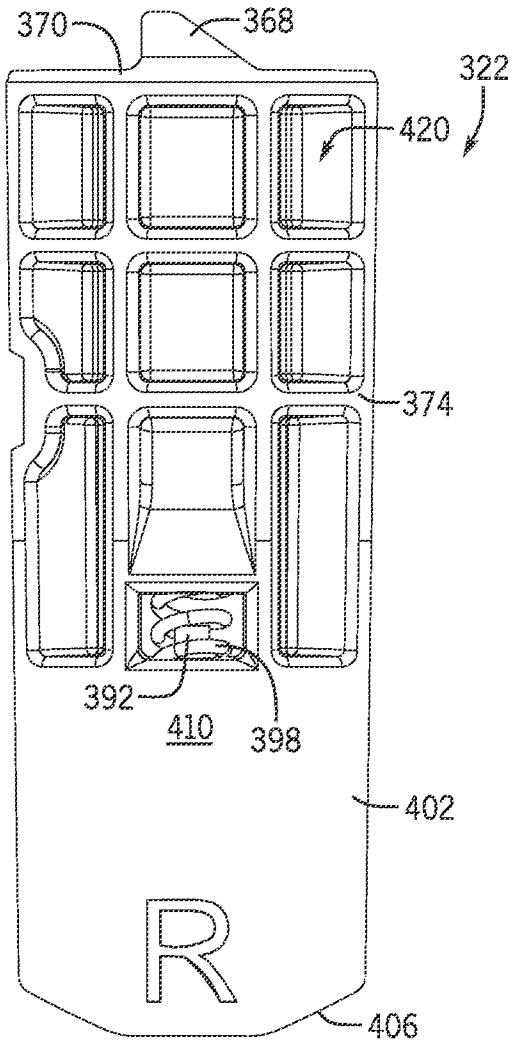
FIG. 30 is a bottom plan view of the locking element of FIG. 24 in accordance with an embodiment of the present disclosure.
Figure 29:
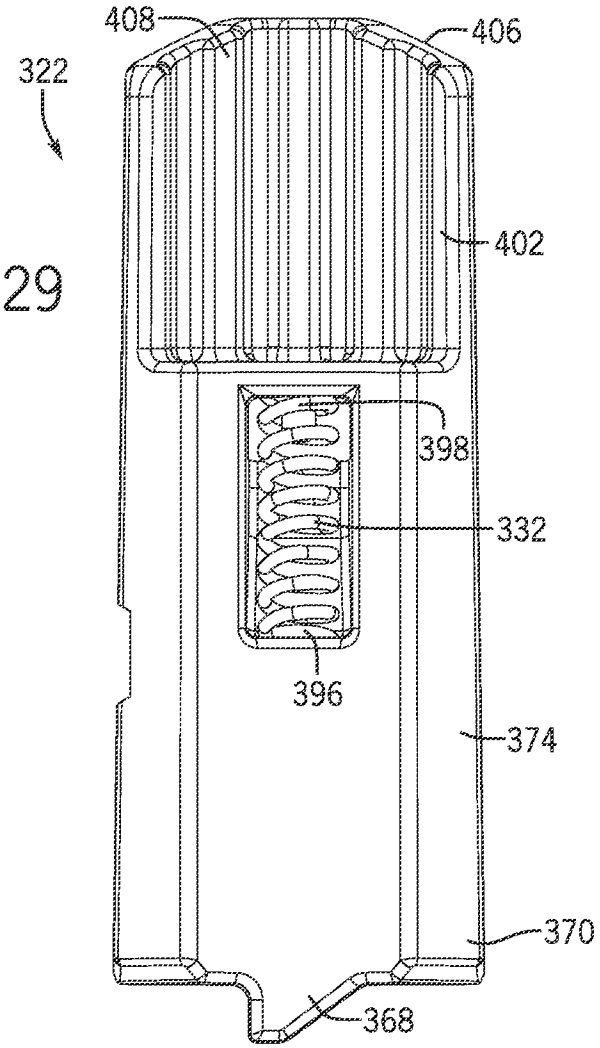
FIG. 29 is a top plan view of the locking element of FIG. 24 in accordance with an embodiment of the present disclosure.
Figure 31:
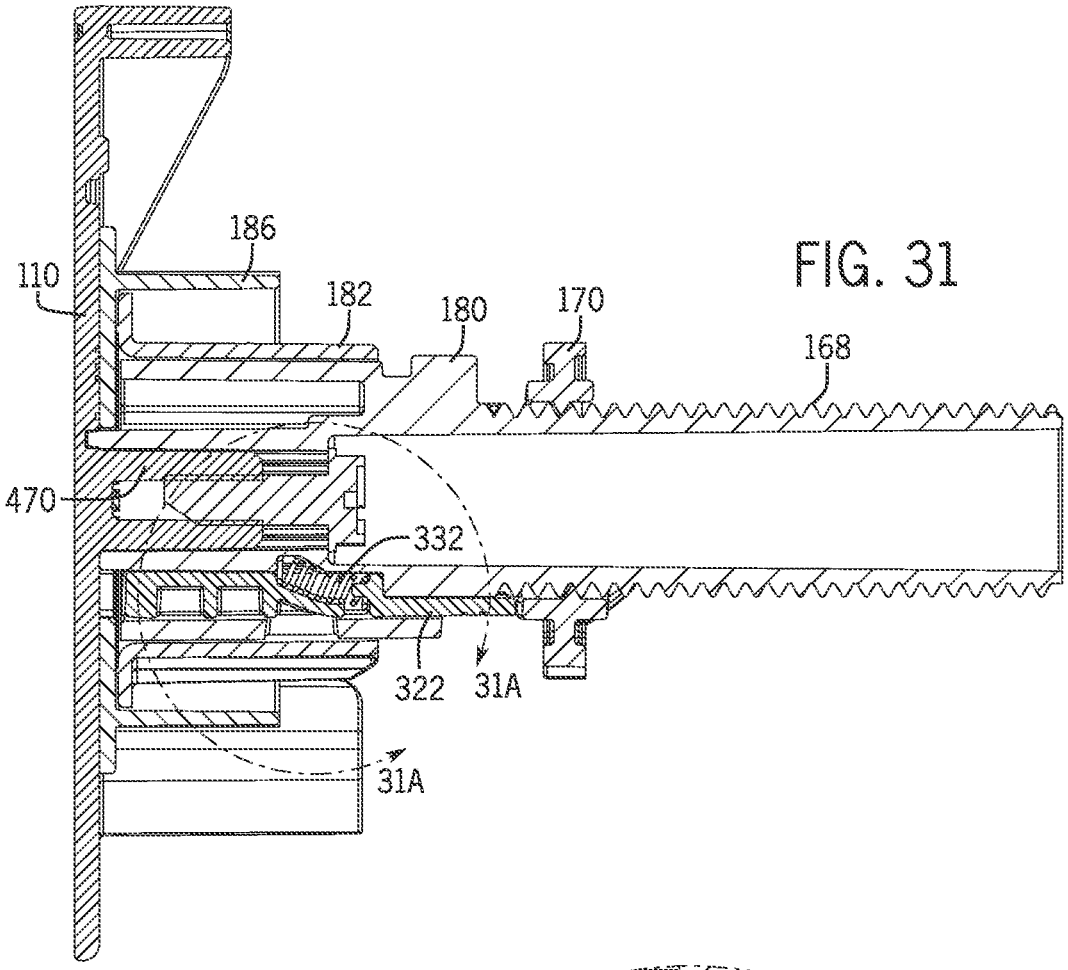
FIG. 31 is a lengthwise cross-sectional view of the assembled limit stop components of FIG. 22 taken along line 31-31 of FIG. 35 in accordance with an embodiment of the present disclosure.
Figure 31A:
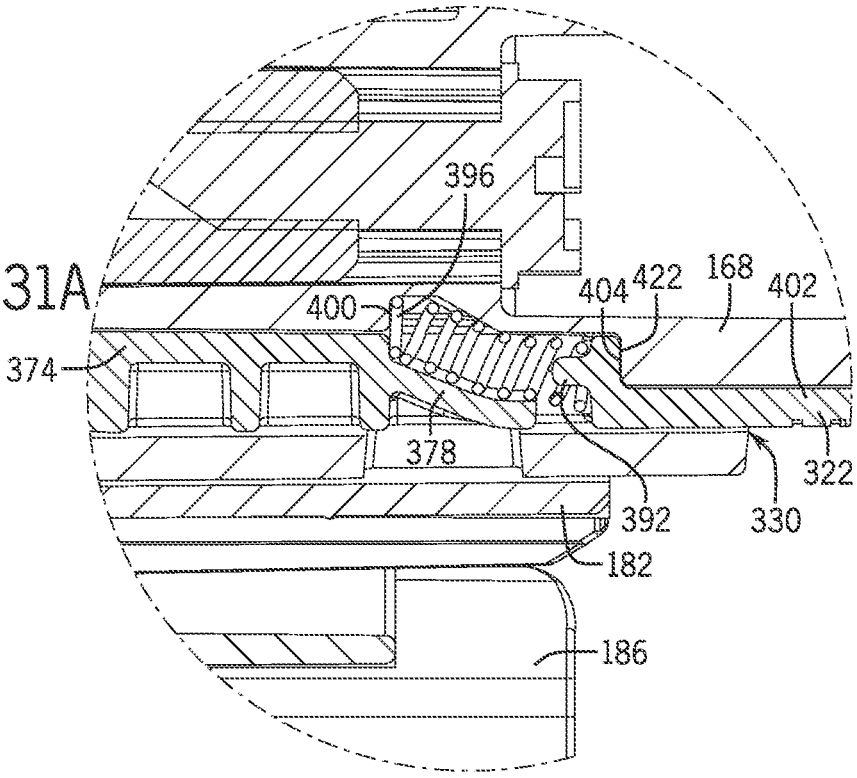
FIG. 31A is an enlarged view of Detail 31A of FIG. 31 in accordance with an embodiment of the present disclosure.

Referring to FIGS. 24-31A, the locking element 322 may include an extension 402 protruding longitudinally from the main body 374 of the locking element 322. The extension 402 may be substantially thinner than the main body 374 of the locking element 322 and may define a retention wall 404 at the intersection of the extension 402 and the main body 374. The retention wall 404 may be oriented transversely, such as perpendicularly, to the longitudinal direction of the locking element 322. The extension 402 may include a curved end 406 to facilitate engagement with the limit nut 170 as explained below. The extension 402 may include a plurality of longitudinal ribs 408 to reduce the weight of the locking element 322 and increase the rigidity of the extension 402. The plurality of longitudinal ribs 408 may extend continuously or discontinuously along a length of the extension 402. Referring to FIGS. 27, 28, and 30, the locking element 322 may include an exterior surface 410 having a plurality of voids 420 defined within the main body 374 of the locking element 322. The plurality of voids 420 may reduce the weight of the locking element 322. In some embodiments, one or more of the plurality of voids 420 may be operable to control other members of the covering 100, such as the first internal bushing 182.

Referring to FIGS. 31 and 31A, the limit screw 168 may include an abutment wall 422 that corresponds with the retention wall 404 of the locking element 322. Engagement of the retention wall 404 with the abutment wall 422 limits the axial displacement of the locking element 322 away from the left end cap 110. The biasing spring 332 may be longitudinally sized such that the biasing spring 332 may axial displace the locking element 322 away from the left end cap 110 to retain the retention wall 404 against the abutment wall 422 absent an external force driving the locking element 322 toward the left end cap 110.

Referring to FIGS. 22, 23, and 32-34, the limit nut 170 of the lock mechanism 166 may be positioned within the inner tube 140 and may travel axially along the limit screw 168 within the interior of the inner tube 140. The limit nut 170 may include an internal thread that threadedly engages an external thread of the limit screw 168. The limit nut 170 may be keyed to the inner wall of the inner tube 140 so that the limit nut 170 rotates in unison with the inner tube 140. The limit nut 170 and the inner tube 140 may include corresponding keying structures, such as ears 424 projecting outwardly from the limit nut 170 and a ridge 426 projecting inwardly from the inner tube 140, to ensure the limit nut 170 and the inner tube 140 rotate in unison with one another.

Figure 32:
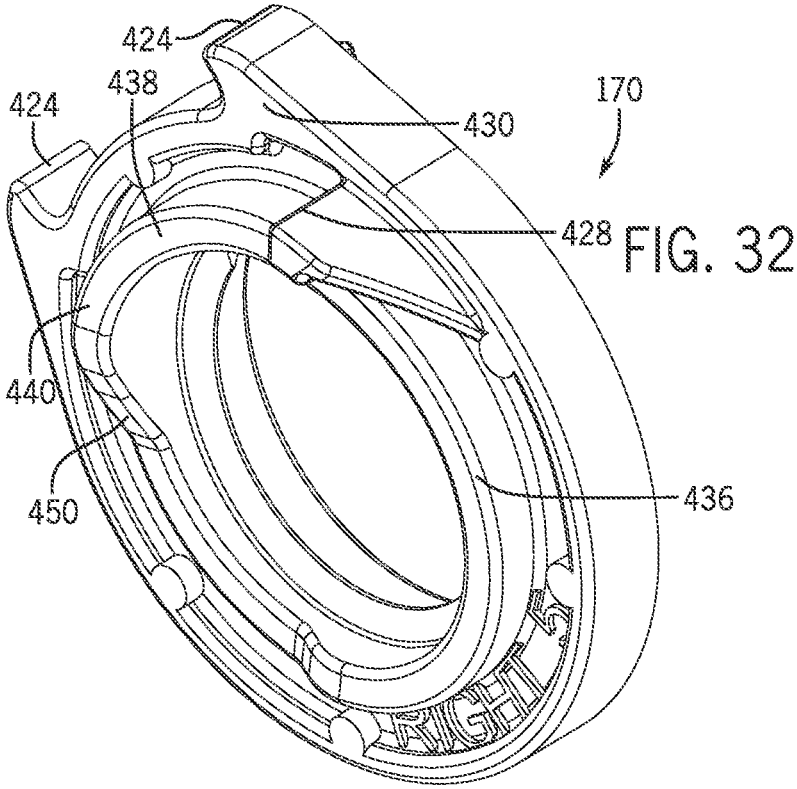
FIG. 32 is an isometric view of a limit nut in accordance with an embodiment of the present disclosure.
Figure 33:
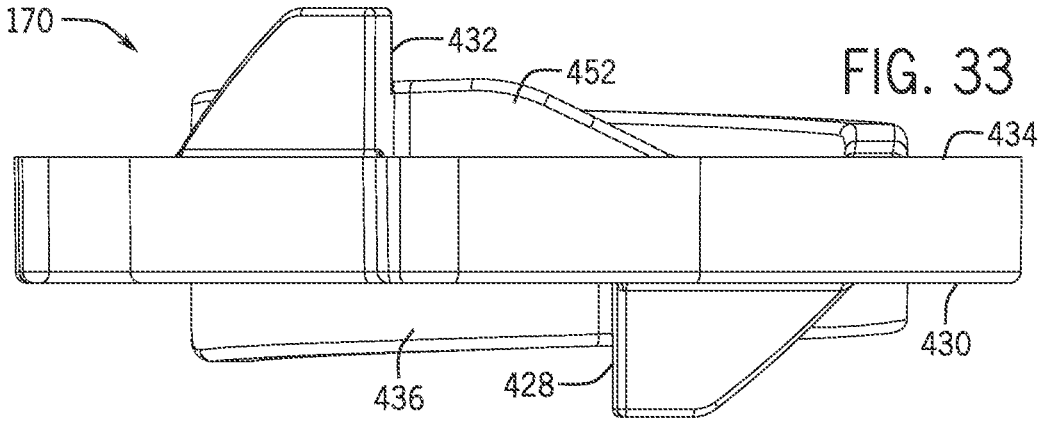
FIG. 33 is a top plan view of the limit nut of FIG. 32 in accordance with an embodiment of the present disclosure.
Figure 34:
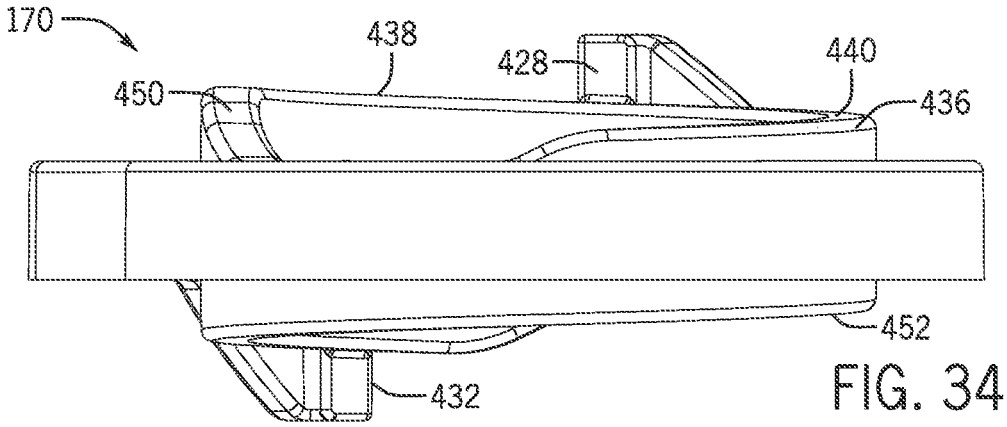
FIG. 34 is a bottom plan view of the limit nut of FIG. 32 in accordance with an embodiment of the present disclosure.

Rotation of the inner tube 140 relative to the limit screw 168 generally moves or translates the limit nut 170 axially along the threaded portion 336 of the limit screw 168. To limit the axial range of the limit nut 170, the limit screw 168 may include a lower limit stop 180 extending outwardly from a periphery of the limit screw 168. As mentioned above, the lower limit stop 180 may be diametrically opposed from the cavity 330 housing the locking element 322. Upon contact with the limit nut 170, the lower limit stop 180 generally restricts or limits rotation of the limit nut 170 relative to the limit screw 168 in the shade extension direction, thereby restricting or limiting further rotation of the inner tube 140 in the shade extension direction. To ensure a solid engagement between the limit nut 170 and the lower limit stop 180, the limit nut 170 may include a longitudinally-extending abutment wall 428 that interacts with the lower limit stop 180 upon the limit nut 170 reaching a desired stopping position, which may correspond to a fully extended, open configuration of the shade 106 (see FIGS. 3 and 3A). As shown in FIGS. 32-34, the abutment wall 428 may be formed at an anterior face 430 of the limit nut 170 facing toward the lower limit stop 180. In some embodiments, a second, corresponding abutment wall 432 may be formed at a posterior face 434 of the limit nut 170 facing opposite the anterior face 430. In such embodiments, the limit nut 170 may be threadedly engaged with the limit screw 168 without specific regard to orientation.

As the shade 106 approaches its fully extended position, the limit nut 170 may engage the locking element 322 to axially displace the locking element 322 from the first position toward the second position. Referring to FIGS. 32-34, the limit nut 170 may include an engagement structure 436 that projects axially from the anterior face 430 of the limit nut 170. The engagement structure 436 may at least partially surround a central axis of the limit nut 170. The engagement structure 436 may be radially positioned on the limit nut 170 to correspond to the radial location of the extension 402 of the locking element 322 on the limit screw 168. In some embodiments, for example in FIG. 32, the engagement structure 436 may be positioned radially inwardly from the abutment wall 428 and adjacent an inner periphery of the limit nut 170. However, depending on the radial location of the locking element 322, in some embodiments the engagement structure 436 may be positioned radially outwardly from the abutment wall 428 adjacent an outer periphery of the limit nut 170.

Referring still to FIGS. 32-34, the engagement structure 436 may include an anterior engagement surface or a rim 438 positioned at a first distance away from the anterior face 430 of the limit nut 170. The first distance may be sufficient to axially displace the locking element 322 from its first position to its second position. The rim 438 may be generally planar and configured to engage the locking element 322 by providing a bearing surface 440 on which the locking element 322 may bear against. A ramp 450 may connect the rim 438 to the anterior face 430 of the limit nut 170. The ramp 450 may extend at an angle that matches the curved end 406 of the locking element 322. The ramp 450 may displace the locking element 322 from its first position to its second position as the limit nut 170 rotates a relatively small angle, such as about 5 degrees or less. In some embodiments, the rim 438 may extend in a generally helical path and may be defined by a constant radius having an origin located at the rotation axis of the inner tube 140. In some embodiments, the rim 438 may extend in a circular path at a constant distance from the anterior face 430 of the limit nut 170.

During extension of the shade 106, the limit nut 170 may rotate about the limit screw 168 and translate towards the locking element 322 and the lower limit stop 180. When the shade 106 is in a fully extended position and the strips of material 116 are in the closed position (see FIGS. 2 and 2A), the ramp 450 of the limit nut 170 may engage the locking element 322. As the limit nut 170 continues to rotate in the shade extension direction, the locking element 322 may travel up the ramp 450 and the ramp 450 may displace the locking element 322 from the first position (permitting rotation of the first outer bushing 186) to the second position (restricting rotation of the first outer bushing 186 relative to the limit screw 168). As the limit nut 170 continues to rotate in the shade extension direction and translate towards the first outer bushing 186, the locking element 322 may travel along the rim 438 of the engagement structure 436 to maintain the locking element 322 in the second position. During this continued rotation, the inner tube 140 may rotate relative to the outer tube 150 in the shade extension direction to wrap the operating elements 108 about the inner tube 140 and open or retract the strips of material 116. The engagement structure 436 may maintain the locking element 322 in the second, rotation restricting position until the limit nut 170 contacts the lower limit stop 180, which may limit further rotation of the limit nut 170, and thus the inner tube 140, relative to the outer tube 150. Once the engagement structure 436 axially displaces the locking element 322 from the first position to the second position, the limit nut 170 may rotate about 270 degrees about the limit screw 168 before contacting the lower limit stop 180. When the limit nut 170 contacts the lower limit stop 180, the strips of material 116 may be fully opened or retracted (see FIGS. 3 and 3A, for example).

With continued reference to FIGS. 32-34, the distance at which the engagement structure 436 extends from the anterior face 430 may vary depending on the rotational position of the limit nut 170. FIGS. 33 and 34, for example, show the axially sloping ramp 450 transitioning the engagement structure 436 from the anterior face 430 outward to the rim 438 positioned at the first distance away from the anterior face 430. The rim 438 is generally planar but downwardly sloping until a portion of the rim 438 located a rotational distance from the top portion of the ramp 450 is positioned at a second distance away from the anterior face 430. As shown in FIG. 34, the first distance is greater than the second distance. In some embodiments, the downwardly sloping rim 438 matches the thread pitch of the threaded portion 336 of the limit screw 168. In such embodiments, the downwardly sloping rim 438 permits the limit nut 170 to move axially along the limit screw 168 towards the locking element 322 while maintaining the locking element 322 in a stationary position. In some embodiments, a second, corresponding engagement structure 452 may be formed at the posterior face 434. In such embodiments, the limit nut 170 may be threadedly engaged with the limit screw 168 without specific regard to orientation.

The operation of the lock mechanism 166 is described below with reference to FIGS. 35-49. As shown in FIGS. 35 and 36, the lock mechanism 166 may be attached to the left end cap 110 and may include the locking element 322, the limit screw 168, the biasing spring 332, the limit nut 170, the first internal bushing 182, and the first outer bushing 186 discussed above. Although the lock mechanism 166 is depicted in conjunction with the left end cap 110, the lock mechanism 166 may be used in conjunction with the right end cap 112. During extension of the shade 106, the user may actuate the drive mechanism 134 to cause the inner tube 140 to rotate in the shade extension direction (clockwise in FIGS. 45 and 49), which in turn cause the outer tube 150 and the limit nut 170 to rotate in the shade extension direction.

Figure 38:
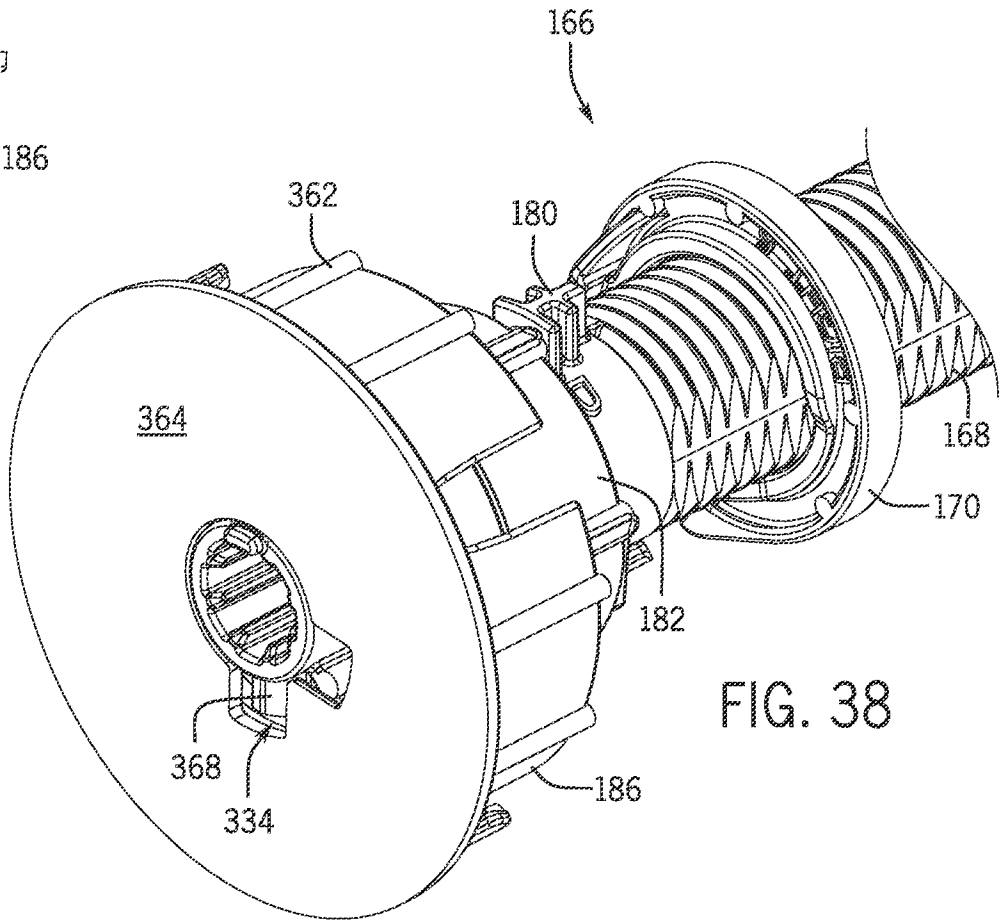
FIG. 38 is an isometric view of the limit stop assembly of FIG. 37 in accordance with an embodiment of the present disclosure.
Figure 37:
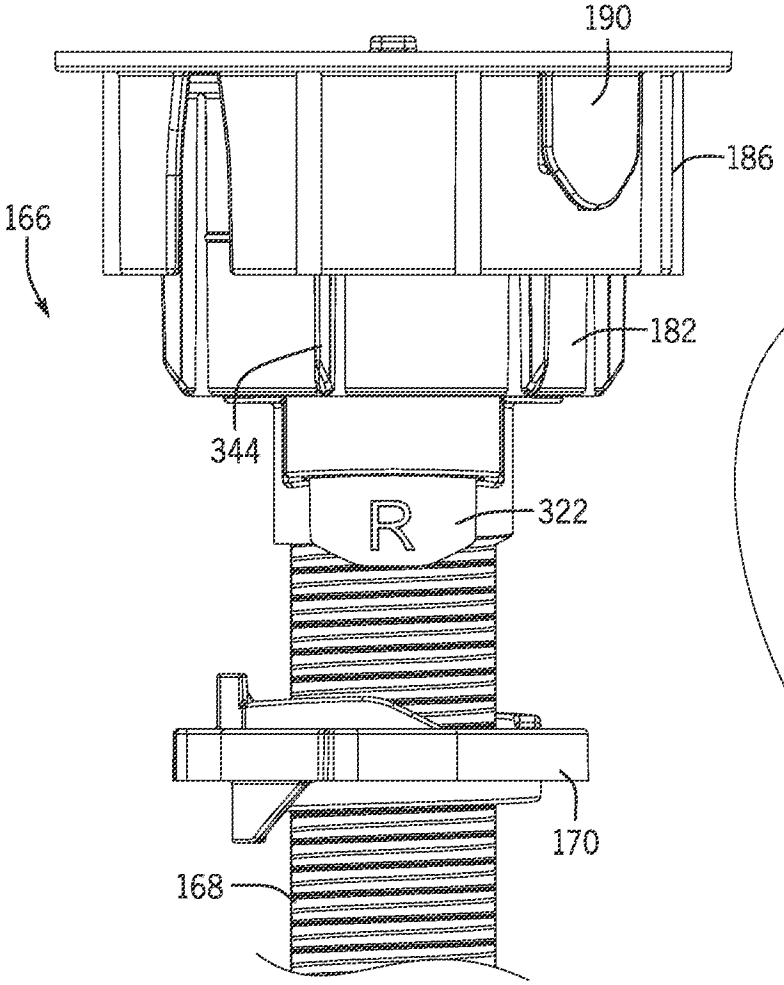
FIG. 37 is a bottom plan view of a limit stop assembly in accordance with an embodiment of the present disclosure.

Referring to FIGS. 1, 37, and 38, the covering 100 is in a fully retracted position and concealed within the head rail 102. In this position (see FIGS. 37 and 38), the limit nut 170 is threadedly engaged with the limit screw 168 and axially positioned a distance away from the locking element 322. When the limit nut 170 is not engaged with the locking element 322, the locking element 322 is positioned in a first position permitting rotation of the outer tube 150. To extend the shade 106 from the head rail 102, the user may actuate the drive mechanism 134 to cause the inner tube 140 to rotate in the shade extension direction (clockwise in FIGS. 45 and 49), which in turn causes the limit nut 170 to rotate about the limit screw 168 and travel axially along the limit screw 168 towards the locking element 322 due at least in part to the limit nut 170 being keyed to the inner tube 140 in a manner as explained above. In general, the limit nut 170 and the inner tube 140 rotate in the direction the user controls the inner tube 140 to rotate.

Figure 40:
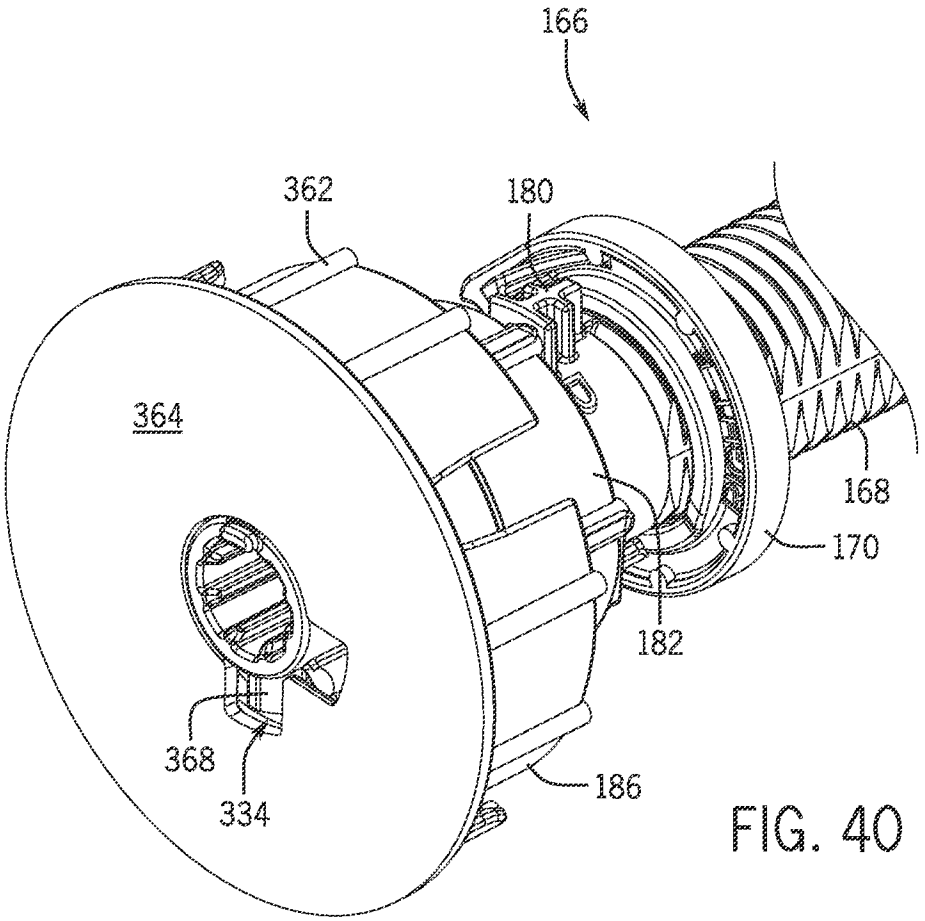
FIG. 40 is an isometric view of the limit stop assembly of FIG. 39 in accordance with an embodiment of the present disclosure.
Figure 39:
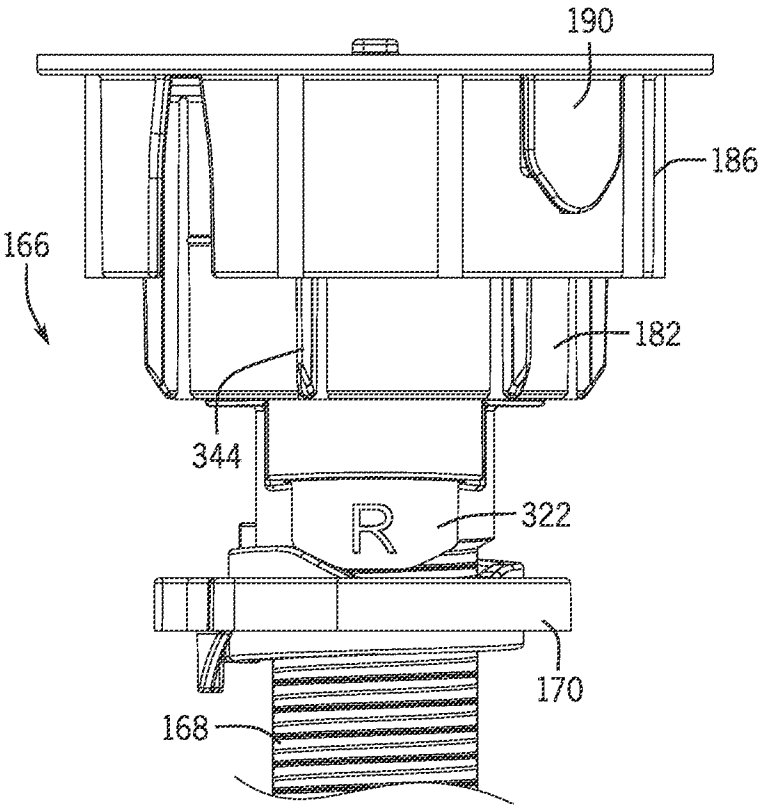
FIG. 39 is a bottom plan view of a limit stop assembly showing a limit nut engaging a locking element in a first position in accordance with an embodiment of the present disclosure.

Referring to FIGS. 2, 2A, 39, and 40, the covering 100 is shown with the shade 106 in a fully extended position with the strips of material 116 in a closed or extended configuration. As shown in FIGS. 2 and 2A, the shade 106 is substantially unwrapped from the outer tube 150 with the strips of material 116 in a closed or extended configuration in which the support sheet 114, the operating element 108, and the plurality of strips of material 116 are relatively close together extending vertically in an approximately coplanar, contiguous relationship with one another. When the shade 106 is in a fully extended position, the ramp 450 of the engagement structure 436 may engage the curved end 406 of the locking element extension 402. Further, as shown in FIG. 40, the stop aperture 334 of the first outer bushing 186 may be axially aligned with the engagement feature 368 of the locking element 322 when the shade 106 is in a fully extended position.

Figure 42:
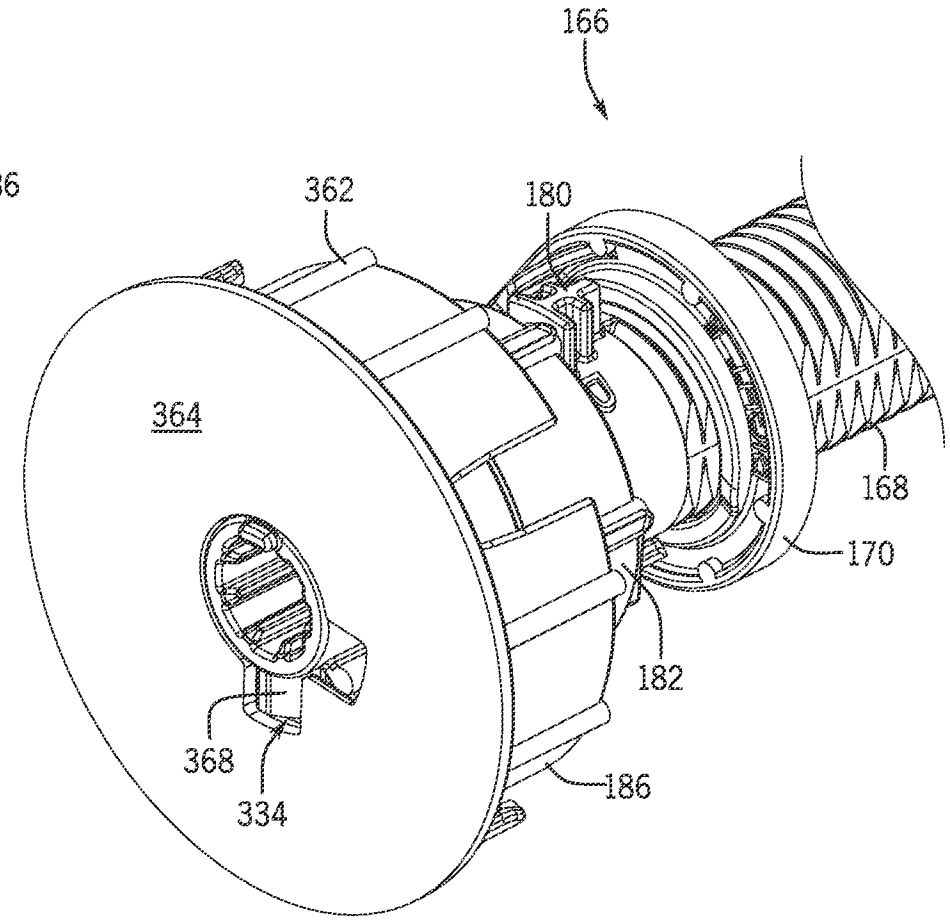
FIG. 42 is an isometric view of the limit stop assembly of FIG. 41 in accordance with an embodiment of the present disclosure.
Figure 41:
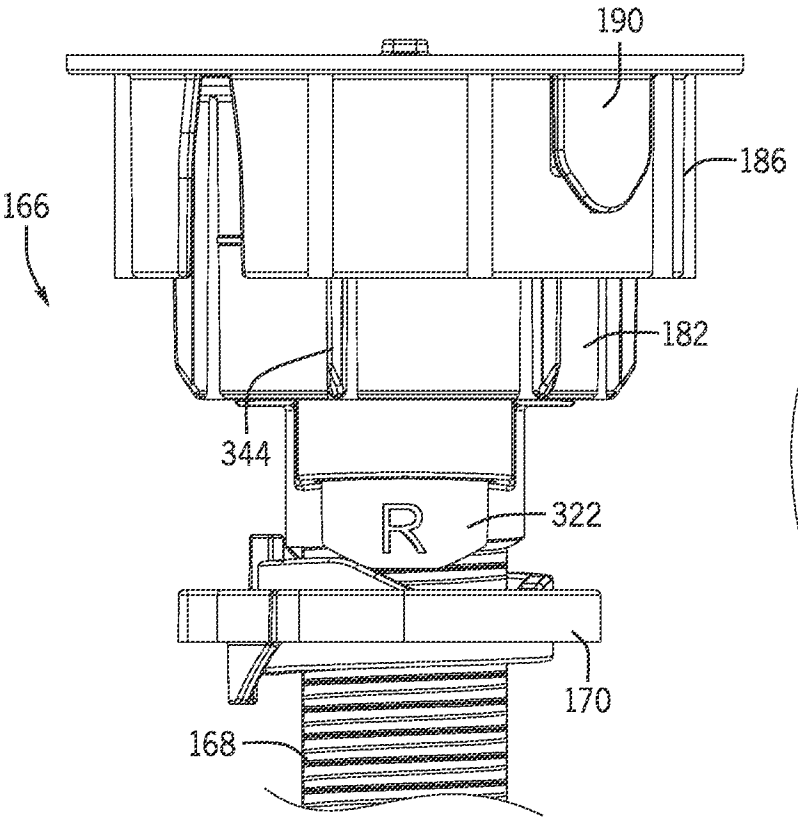
FIG. 41 is a bottom plan view of a limit stop assembly showing a limit nut engaging a locking element in a second position in accordance with an embodiment of the present disclosure.

Referring to FIGS. 2, 2A, 41, and 42, continued rotation of the limit nut 170 about the limit screw 168 may further engage the ramp 450 of the limit nut engagement structure 436 with the curved end 406 of the locking element extension 402 causing the locking element 322 to longitudinally translate through the cavity 330 of the limit screw 168 towards the left end cap 110. As the locking element 322 translates longitudinally through the cavity 330 towards the left end cap 110, the biasing spring 332 is compressed. As shown in FIG. 42, the engagement feature 368 of the locking element 322 is partially extended through the stop aperture 334 of the first outer bushing 186 thereby restricting rotation of the first outer bushing 186 about the rotation axis of the inner tube 140. Because the first outer bushing 186 is keyed to the outer tube 150 via the axial projections 190, extension of the engagement feature 368 through the stop aperture 334 also restricts rotation of the outer tube 150.

Figure 44:
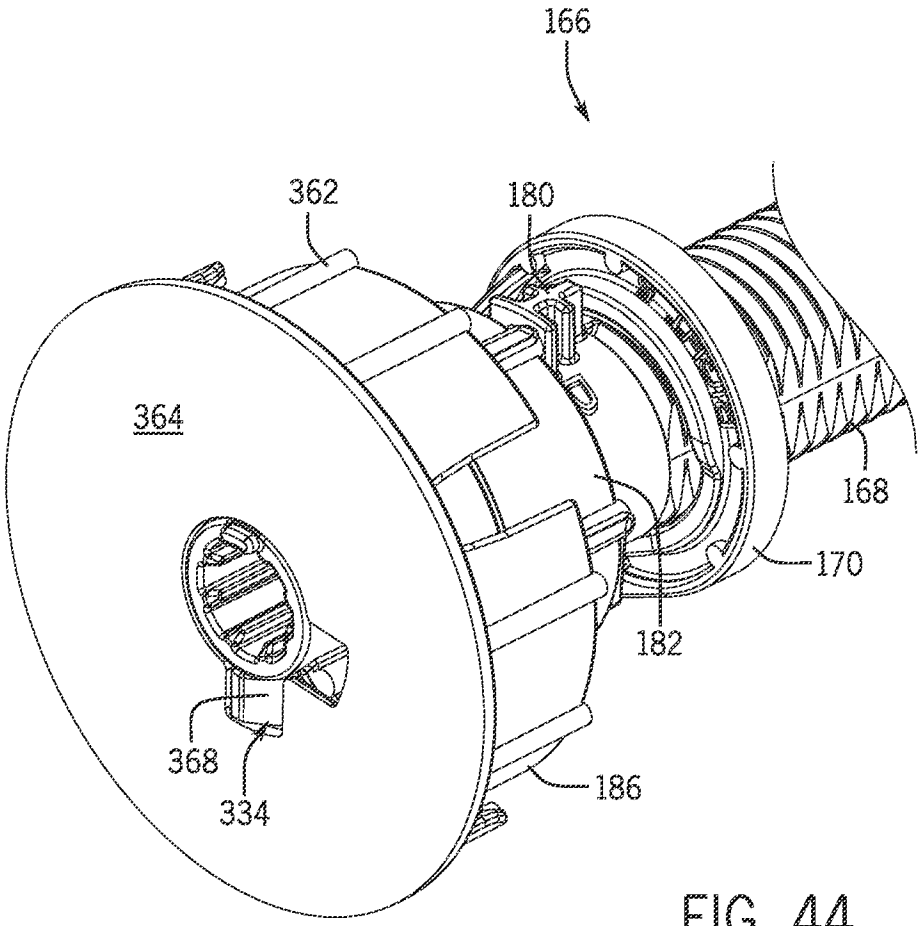
FIG. 44 is an isometric view of the limit stop assembly of FIG. 43 in accordance with an embodiment of the present disclosure.
Figure 43:
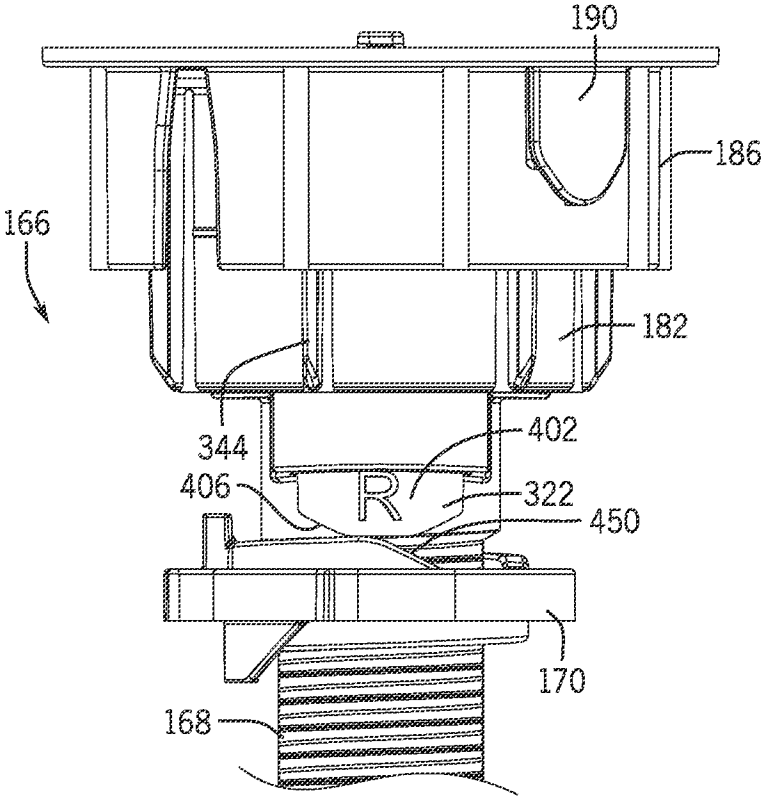
FIG. 43 is a bottom plan view of a limit stop assembly showing a limit nut engaging a locking element in a third position in accordance with an embodiment of the present disclosure.
Figure 45:
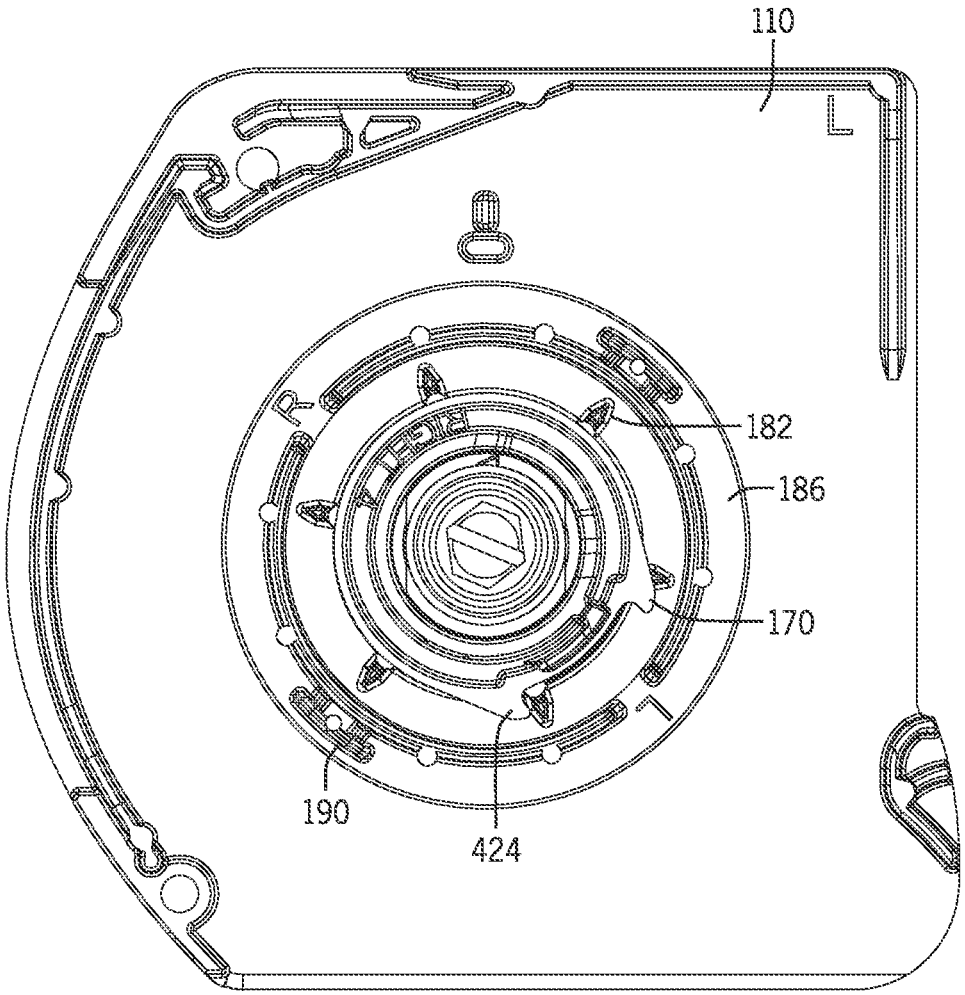
FIG. 45 is an elevation view of the limit stop assembly of FIG. 43 associated with an end cap in accordance with an embodiment of the present disclosure.

Referring to FIGS. 43-45, the ramp 450 of the limit nut 170 has fully engaged the curved end 406 of the locking element extension 402 (see FIG. 43). The locking element 322 is fully longitudinally extended through the cavity 330 of the limit screw 168 towards the left end cap 110 to define a second position of the locking element 322 restricting rotation of the first outer bushing 186 about the rotation axis of the inner tube 140. As shown in FIG. 44, the engagement feature 368 of the locking element 322 is fully extended through the stop aperture 334 of the first outer bushing 186 thereby restricting rotation of both the first outer bushing 186 and the outer tube 150 about the rotation axis as explained above. As shown in FIG. 45, the limit nut 170 is rotationally positioned about the rotation axis in position α.

Referring to FIGS. 3, 3A, and 46-49, the covering 100 is shown with the shade 106 in a fully extended position with the strips of material 116 in an open or collapsed configuration. In this position, the support sheet 114 is vertically extended with the strips of material 116 extending substantially horizontally away from the front face 118 of the support sheet 114 and towards the interior of a room. As explained above, opening of the strips of material 116 may be caused by the continued rotation of the inner tube 140 in the extension direction relative to the outer tube 150. Specifically, upon engagement of the locking element 322 with the first outer bushing 186, the drive mechanism 134 continues to rotate the inner tube 140 relative to the outer tube 150 to wrap the operating element 108 about the inner tube 140 and open the plurality of strips of material 116.

Figure 47:
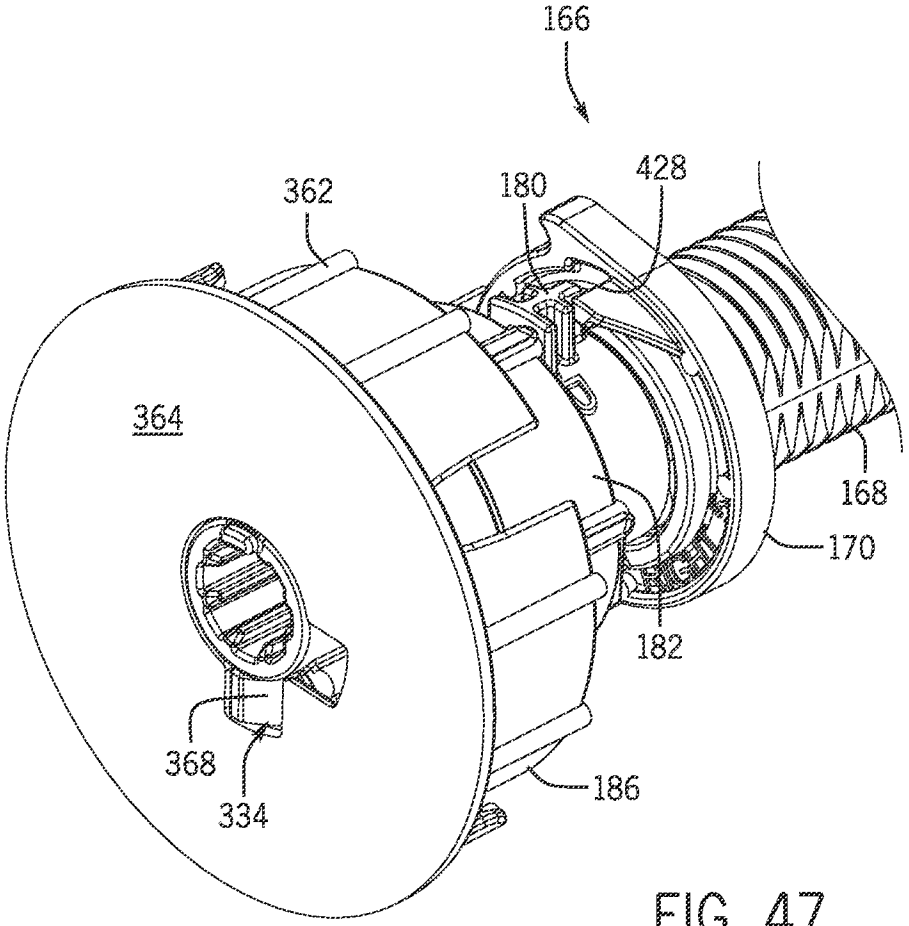
FIG. 47 is an isometric view of the limit stop assembly of FIG. 46 in accordance with an embodiment of the present disclosure.
Figure 46:
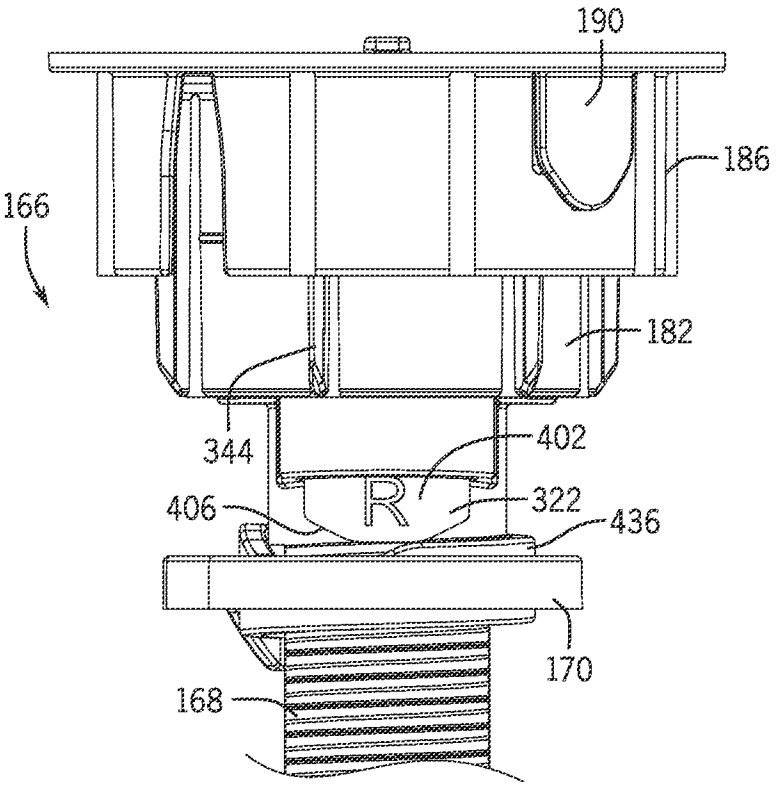
FIG. 46 is a bottom plan view of a limit stop assembly showing a limit nut engaging a locking element in a fourth position in accordance with an embodiment of the present disclosure.

Referring to FIG. 46, the engagement structure 436 of the limit nut 170 is engaged with the curved end 406 of the locking element extension 402, maintaining the locking element 322 in the second position within the cavity 330 of the limit screw 168 against the compression force of the biasing spring 332. The rim 438 of the engagement structure 436 may be downwardly sloping to match the thread pitch of the threaded portion 336 of the limit screw 168, thereby permitting the limit nut 170 to translate axially along the limit screw 168 towards the left end cap 110 while maintaining the translational positioning of the locking element 322 in the second position within the cavity 330. As shown in FIG. 47, the engagement feature 368 of the locking element 322 may be fully extended through the stop aperture 334 of the first outer bushing 186 similar to FIG. 44.

Figure 49:
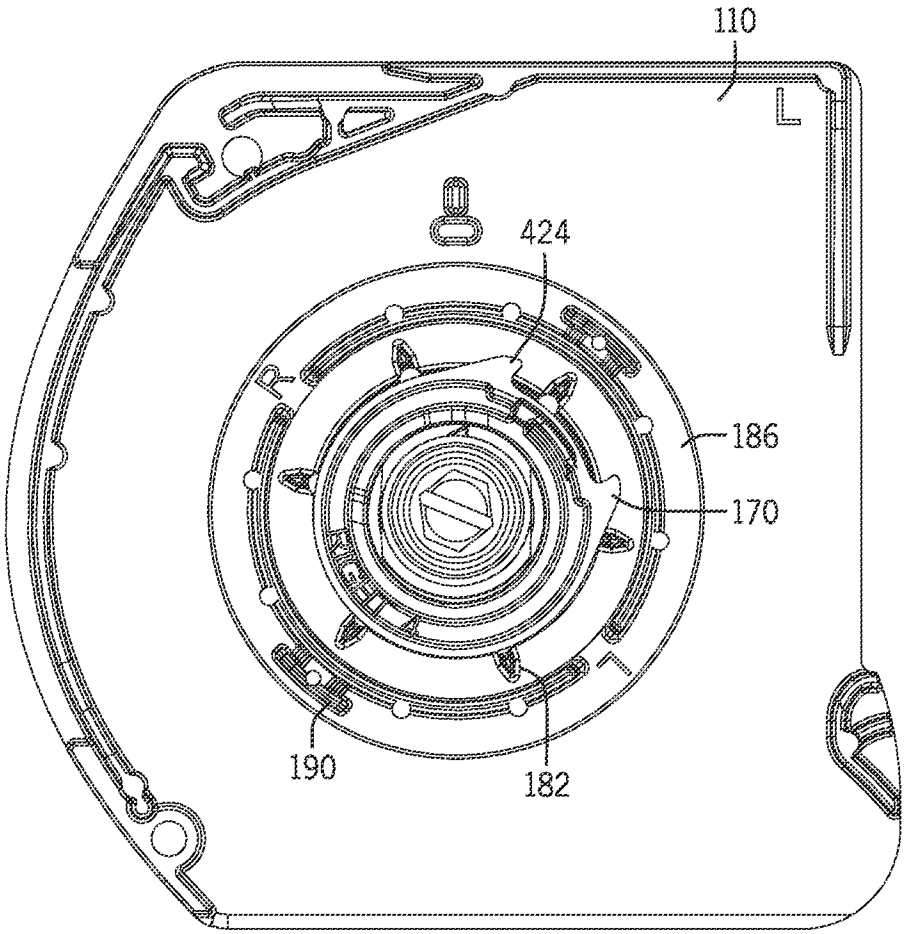
FIG. 49 is an elevation view of the limit stop assembly of FIG. 46 associated with an end cap in accordance with an embodiment of the present disclosure.
Figure 48:
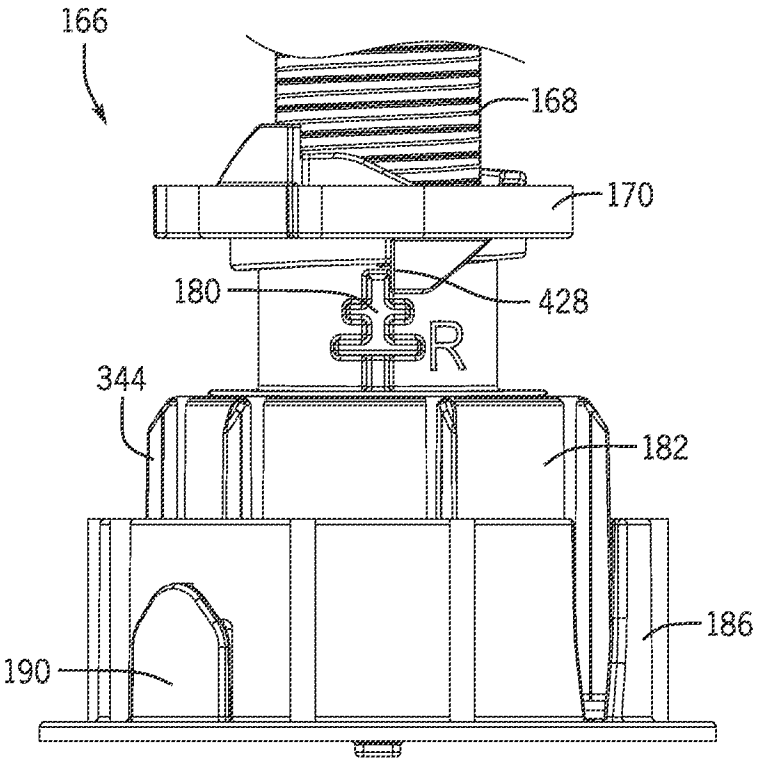
FIG. 48 is a top plan view of the limit stop assembly of FIG. 46 in accordance with an embodiment of the present disclosure.

Referring FIGS. 47-49, when the shade 106 is fully extended and the strips of material 116 are in a fully open or retracted position, the abutment wall 428 of the limit nut 170 may be engaged with the lower limit stop 180 of the limit screw 168. As shown in FIG. 49, the limit nut 170 is rotationally positioned about the rotation axis in position (3. In some embodiments, rotational position α and rotational position β are less than 360 degrees from one another. In some embodiments, upon the locking element 322 engaging the first outer bushing 186 to lock rotation of the outer tube, the drive mechanism 134 may rotate the inner tube 140 another 270 degrees (clockwise in FIG. 49) until the abutment wall 428 contacts the lower limit stop 180. In some embodiments, rotational position α and rotational position β may be substantially any degree of rotation separated from each other.

Retraction of the shade 106, if desired, is accomplished in reverse order as described above, such as generally following FIGS. 49 to 37. This allows the user to select whether to have the covering 100 in a fully retracted configuration, a fully extended and closed configuration, a fully extended and open configuration, or anywhere in between. During retraction of the shade 106, the user actuates the drive mechanism 134 to cause the inner tube 140 to rotate in the shade retraction direction (counterclockwise in FIG. 49), which in turn causes the limit nut 170 to rotate in the shade retraction direction. As the inner tube 140 rotates in the shade retraction direction, the operating element 108 is unwrapped from the inner tube 140, thereby closing or extending the strips of material 116 as explained above. Because the outer tube 150 is restricted from rotating via the engagement feature 368 of the locking element 322 protruding into the stop aperture 334 of the first outer bushing 186, only the inner tube 140 and limit nut 170 rotate until the limit nut 170 no longer engages the locking element 322 as described below.

As the inner tube 140 continues to rotate, the curved end 406 of the locking element 322 rides on the bearing surface 440 of the rim 438 of the engagement structure 436 of the limit nut 170. The inner tube 140 may rotate in the shade retraction direction relative to the outer tube 150 until the limit nut 170 no longer engages the locking element 322. In some embodiments, the inner tube 140 may rotate about 270 degrees in the shade retraction direction before the limit nut 170 disengages the locking element 322. Since the locking element 322 is biased in a direction away from the left end cap 110, the locking element 322 may move away from the left end cap 110 towards the first position (where the locking element 322 permits rotation of the outer tube 150) as the limit nut 170 travels axially along the limit screw 168 away from the left end cap 110 until the limit nut 170 disengages the locking element 322 and the retention wall 404 of the locking element 322 contacts the abutment wall 422 of the limit screw 168.

Once the limit nut 170 disengages the locking element 322, the first engagement features 228 of the inner tube 140 may engage the longitudinal rib of the outer tube 150. As explained above, continued rotation of the inner tube 140 in the shade retraction direction causes the outer tube 150 to rotate in unison with the inner tube 140 in the shade retraction direction. Continued rotation of the inner and outer tubes 140, 150 in the shade retraction direction wraps the shade 106 and operating elements 108 about the outer tube 150.

The operation of the covering 100 is described below with reference to FIGS. 1-3A and 50-52. As shown in FIGS. 1 and 50, the shade 106 is in a fully-retracted position and concealed within the head rail 102. In this configuration (see FIG. 50), the first portion 316 of the operating element 108 may be wrapped about the inner tube 140, and the support sheet 114, the second portion 318 of the operating element 108, and the plurality of strips of material 116 may be fully wrapped about the outer tube 150. The first engagement features 228 of the inner tube 140 may be engaged with the longitudinal second engagement feature 250 of the outer tube 150, and the limit nut 170 may be keyed to the inner tube 140. The limit nut 170 may be threadedly engaged with the limit screw 168 and positioned a distance axially away from the locking element 322 (see FIG. 37). The locking element 322 may be in the first position permitting rotation of the outer tube 150. The collars 198 may be positioned radially between the inner tube 140 and the outer tube 150, providing a bearing surface 210 for the inner tube 140 and connecting the first shell 152 and the second shell 154 together. In some embodiments, the bottom rail 104 engages a portion of the head rail 102 to define an upper limit stop.

To extend the shade 106 from the head rail 102, the user may actuate the drive mechanism 134 to cause the inner tube 140 to rotate in the shade extension direction (clockwise in FIGS. 50-52), which in turn may cause the outer tube 150 to rotate in the shade extension direction due at least in part to the rotation of the inner tube 140 being transferred to the outer tube 150 through the operating elements 108. As the shade 106 extends off of the outer tube 150, the outer tube 150 generally rotates in unison with the inner tube 140.

Rotation of the inner tube 140 in the shade extension direction may cause the limit nut 170 to rotate in the shade extension direction and travel axially along the limit screw 168 towards the locking element 322.

Figure 51:
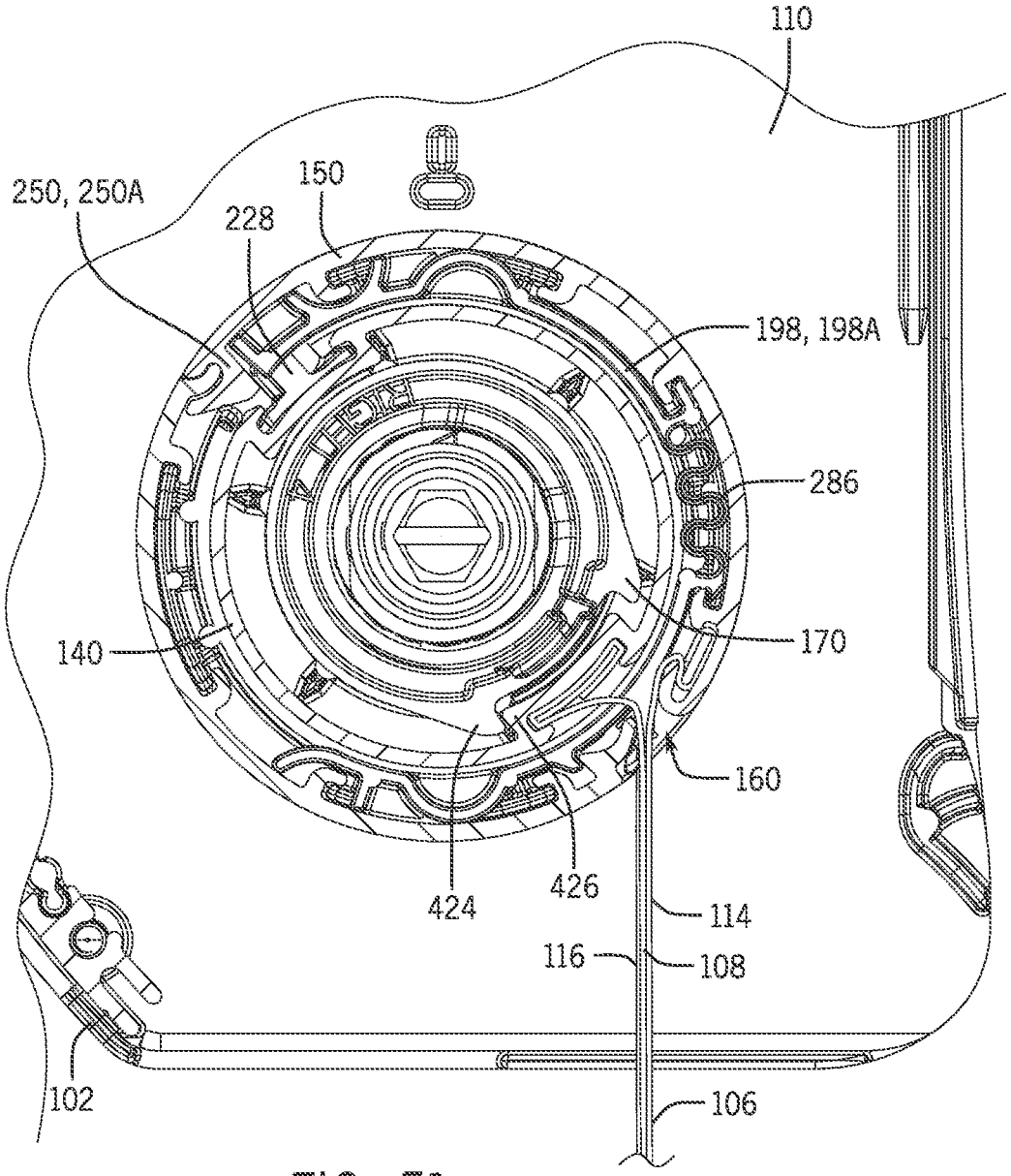
FIG. 51 is a fragmentary transverse cross-sectional view of a covering taken along line 51-51 of FIG. 2 in accordance with an embodiment of the present disclosure.

Referring to FIGS. 2, 2A, and 51, the shade 106 may extend off of the outer tube 150 in a closed or collapsed configuration in which the support sheet 114, the operating element 108, and the plurality of strips of material 116 are relatively close together extending vertically in an approximately coplanar, contiguous relationship with each other. Once the shade 106 and operating element 108 are substantially unwrapped from the outer tube 150, the limit nut 170 may engage the locking element 322 and cause the locking element 322 to translate longitudinally towards the left end cap 110. Translation of the locking element 322 towards the left end cap 110 may cause the locking element 322 to protrude into the stop aperture 334 of the first outer bushing 186, thereby preventing further rotation of the outer tube 150 in the shade extension direction (see FIG. 44, for instance). Continued rotation of the inner tube 140 in the shade extension direction may wrap the operating element 108 about the inner tube 140 to shift the strips of material 116 from a closed position (FIGS. 2 and 2A) to an open position (FIGS. 3 and 3A) by raising the second edge portions 130 of one or more of the plurality of strips of material 116 and creating the substantially C-shaped cells. In some embodiments, the inner tube 140 continues to rotate about 270 degrees in the shade extension direction once the outer tube 150 is locked in position until the limit nut 170 contacts the lower limit stop 180.

Referring to FIGS. 3, 3A, and 51, the covering 100 is shown with the shade 106 in a fully extended position with the strips of material 116 in an open configuration. In this position, the support sheet 114 is vertically extended with the strips of material 116 extending substantially horizontally away from the front face 118 of the support sheet 114 and towards the interior of a room. The operating elements 108 may be at least partially wrapped about the inner tube 140 (clockwise in FIG. 51), and the operating elements 108 may extend vertically downward through the slot 160 of the outer tube 150 towards the bottom rail 104. The locking element 322 may be maintained in the second position by the limit nut 170 to restrict rotation of the outer tube 150 during opening or closing of the strips of material 116. When the shade 106 is in the fully extended, open configuration, the limit nut 170 may be engaged with the lower limit stop 180 formed on the limit screw 168 and may prevent further rotation of the inner tube 140 in the shade extension direction.

Retraction of the shade 106 into the head rail 102 is accomplished in reverse order as described above, such as generally following FIGS. 52-50. This allows the user to have the covering 100 in a fully retracted configuration, a fully extended and closed configuration, a fully extended and open configuration, or anywhere in between. To close the strips of material 116 from the open configuration to the closed configuration, the user may actuate the drive mechanism 134 to cause the inner tube 140 to rotate in the shade retraction direction (counterclockwise in FIGS. 52-50), which in turn may cause the limit nut 170 to rotate in the shade retraction direction. Referring to FIG. 51, when the shade 106 is in the fully extended, open configuration, the limit nut 170 may be engaged with the lower limit stop 180 formed on the limit screw 168. Rotation of the inner tube 140 in the shade retraction direction may simultaneously move the abutment wall 428 of the limit nut 170 rotationally away from the lower limit stop 180 and translate the limit nut 170 axially away from the left end cap 110. As the inner tube 140 rotates in the shade retraction direction, the operating elements 108 may be unwrapped from the inner tube 140 and may drop out of the slot 160 formed in the outer tube 150. As the operating elements 108 are unwrapped from the inner tube 140, the second edge portions 130 of the plurality of strips of material 116 may be lowered along the front face 118 of the support sheet 114, thereby closing the strips of material 116 as explained above. Until the second edge portions 130 of the plurality of strips of material 116 are fully lowered, the engagement feature 368 of the locking element 322 may protrude into the stop aperture 334 of the first outer bushing 186 and restrict rotation of the outer tube 150. Until the limit nut 170 disengages the locking element 322, the inner tube 140 and limit nut 170 may rotate in the shade retraction direction relative to the outer tube 150.

Referring to FIG. 51, as the operating elements 108 are further unwrapped from the inner tube 140 and the limit nut 170 disengages the locking element 322, the first engagement features 228 of the inner tube 140 may engage the longitudinal second engagement feature 250 of the outer tube 150. Once the first engagement features 228 engage the second engagement feature 250, continued rotation of the inner tube 140 in the shade retraction direction may cause the outer tube 150 to rotate in the shade retraction direction. When the first engagement features 228 engage the second engagement feature 250, a retraction force may be applied to the outer tube 150 by the drive mechanism 134 through the inner tube 140 and the first engagement features 228. When the limit nut 170 is disengaged from the locking element 322, the inner tube 140 and the outer tube 150 may rotate in unison about the rotation axis of the inner tube 140. Continued rotation of the outer tube 150 in the shade retraction direction may wrap the shade 106 and the second portion 318 of the operating elements 108 about the outer tube 150. The shade 106 and operating elements 108 may be under tension as they are wrapped about the outer tube 150 due to the suspended portion of the shade 106 and the weight of the bottom rail 104. The weight of the suspended portion of the shade 106 and the bottom rail 104 may apply an unwinding force (clockwise in FIGS. 50-52) due to gravity to the outer tube 150 generally opposite the retraction force. The first engagement features 228 may be constantly engaged with the second engagement feature 250 due at least in part to the unwinding force from gravity.

Figure 52:
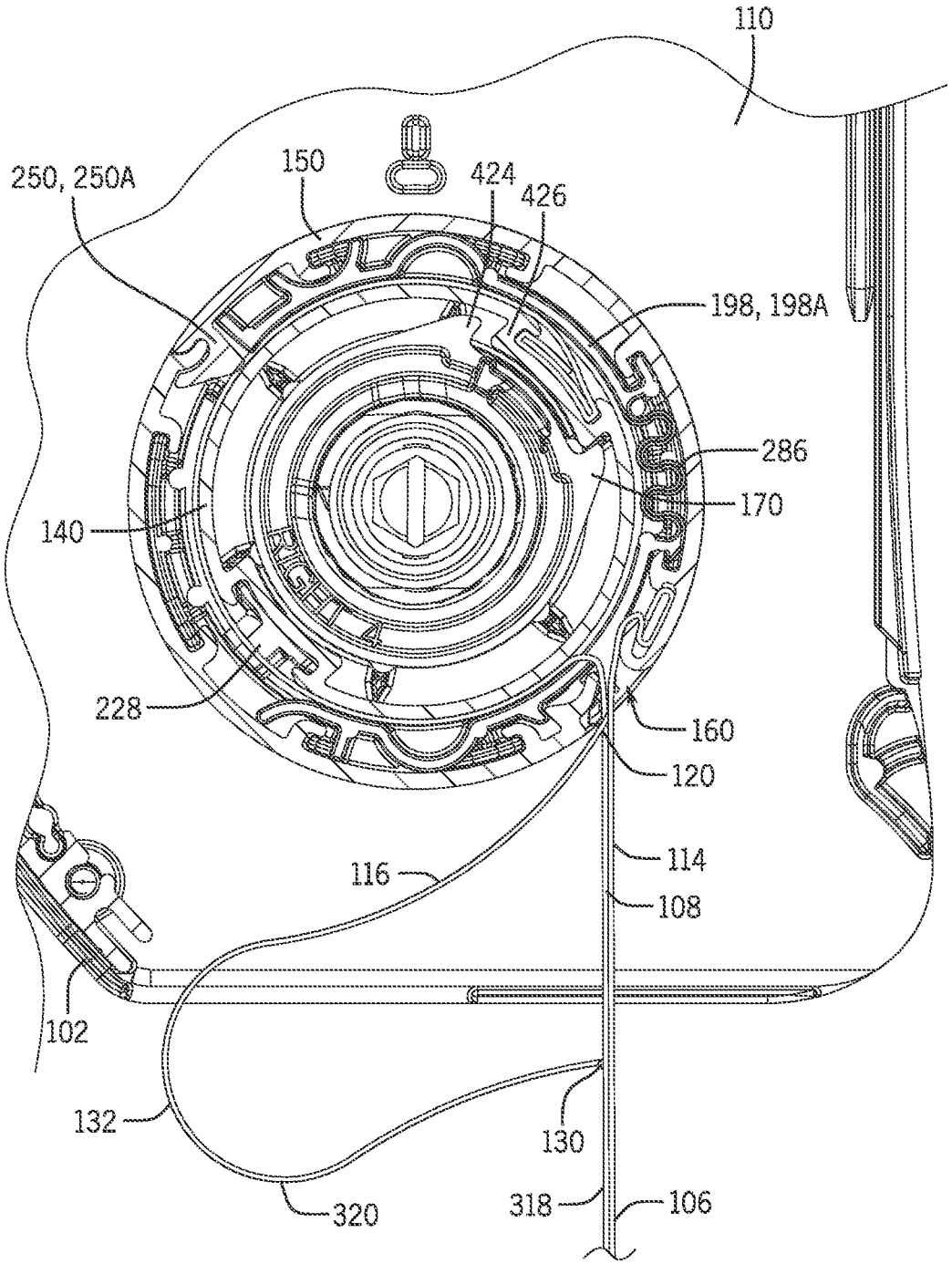
FIG. 52 is a fragmentary transverse cross-sectional view of a covering taken along line 52-52 of FIG. 3 in accordance with an embodiment of the present disclosure.

Referring to FIG. 52, as the outer tube 150 continues to rotate in the shade retraction direction, the shade 106 and operating elements 108 may wrap about the outer tube 150. When the shade 106 is fully retracted, the bottom rail 104 may engage a portion of the head rail 102, such as an abutment, to serve as an upper limit stop for the dual tube unit 138. Other mechanisms, such as an upper limit stop positioned on the limit screw 168 opposite the lower limit stop 180, may be used to define the top retraction position.

Figure 53:
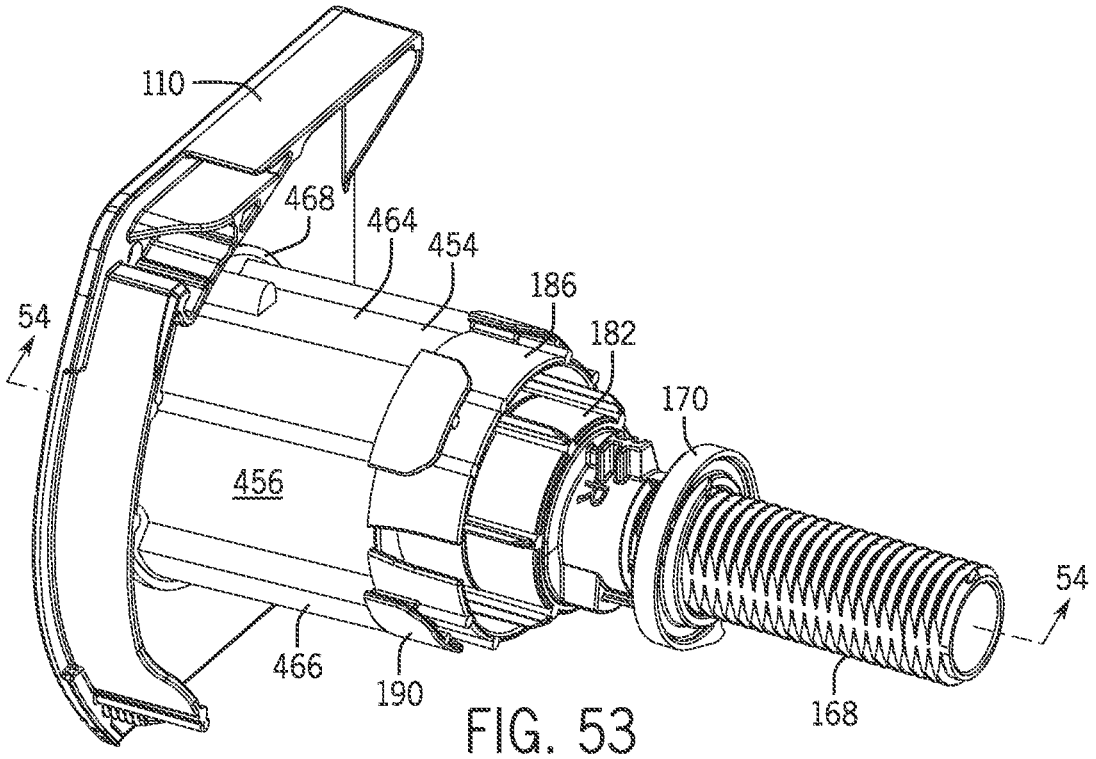
FIG. 53 is an isometric view of a limit stop assembly and a lift assist associated with an end cap in accordance with an embodiment of the present disclosure.
Figure 54:
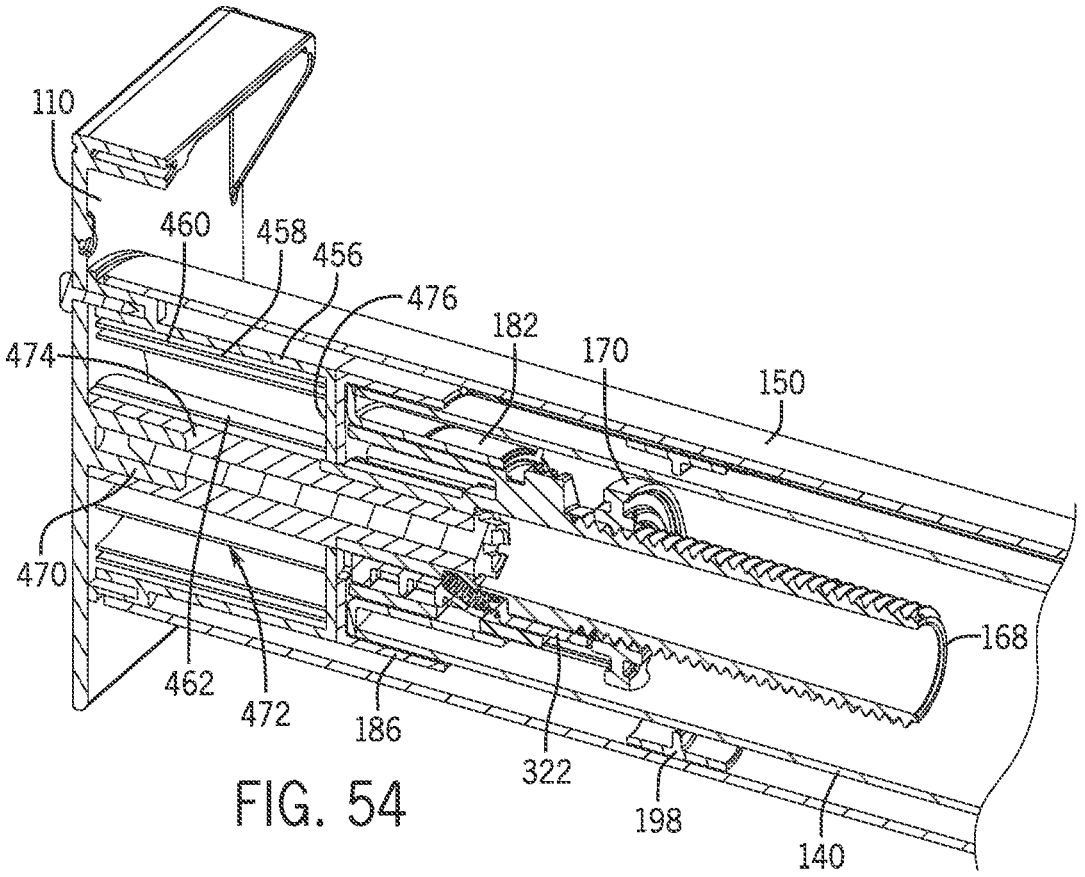
FIG. 54 is a lengthwise cross-sectional view of the limit stop assembly, the lift assist, and the end cap of FIG. 53 taken along line 54-54 of FIG. 53 in accordance with an embodiment of the present disclosure.

Referring to FIGS. 53 and 54, in some embodiments the covering 100 may include a lift assist 454 to reduce the force required to retract the shade 106. The lift assist 454 may reduce the torque translated to the drive mechanism 134. As shown in FIG. 54, the lift assist 454 may be coaxially aligned about the rotation axis of the inner and outer tubes 140, 150. The lift assist 454 may be positioned between the left end cap 110 and the first outer bushing 186. While described as being attached to the left end cap 110, the lift assist 454 may be attached to the right end cap 112.

The lift assist 454 may tightly engage the outer tube 150. In some embodiments, the lift assist 454 may be generally cylindrical and may have an outer diameter smaller than an inside diameter of the outer tube 150. The lift assist 454 may be received within the outer tube 150 and may tightly engage an inside surface of the outer tube 150. Additionally, or alternatively, in some embodiments the lift assist 454 may at least partially surround the outer tube 150 and may tightly engage an exterior surface of the outer tube 150. In some embodiments, the lift assist 454 may be mounted onto the left end cap 110 and may engage the outer tube 150 by adhesive, corresponding retention features, heat or sonic welding, or any other suitable attachment means. In some embodiments, the outer tube 150 may be longer than the inner tube 140 by an axial length of the lift assist 454.

The lift assist 454 may reduce the force required to lift the shade 106 by providing a rotational force to the outer tube 150. With continued reference to FIGS. 53 and 54, the lift assist 454 may include a sleeve 456 and a biasing spring 458 operably associated with the sleeve 456 to rotationally bias the sleeve 456. The sleeve 456 may be engaged with the outer tube 150 and may be rotatable relative to the left end cap 110 so that the sleeve 456 rotates in unison with the outer tube 150 relative to the left end cap 110. The biasing spring 458 may include a first end 460 attached to the sleeve 456 and a second end 462 attached to a non-rotatable component, such as the left end cap 110. When the sleeve 456 is engaged with the outer tube 150, the sleeve 456 and the outer tube 150 may rotate in unison about the rotation axis of the inner and outer tubes 140, 150. During rotation of the sleeve 456 in a first rotational direction, the biasing spring 458 may oppose the rotation of the sleeve 456 and the sleeve 456 may wind the biasing spring 458 to store mechanical energy in the biasing spring 458. During rotation of the sleeve 456 in a second rotational direction opposite the first rotational direction, the biasing spring 458 may assist the rotation of the sleeve 456 and may unwind. The biasing spring 458 may be a power spring, a clock spring, a helical torsion spring, or other suitable types of biasing springs.

The sleeve 456 may include a substantially cylindrical body 464, a plurality of longitudinally-extending, circumferentially-spaced ribs 466 projecting radially outwardly from an outer surface of the body 464, and a flange 468 projecting radially outwardly from an end of the body 464. The body 464 of the sleeve 456 may define a substantially cylindrical inner surface that rotatably bears against a cylindrical protrusion 470 attached to and extending from the left end cap 110 in an axial direction toward the dual tube unit 138. The ribs 466 may engage an inner surface of the outer tube 150 such that the sleeve 456 rotates in unison with the outer tube 150 about the rotation axis of the inner and outer tubes 140, 150. The flange 468 may project radially outwardly of the ribs 466 and may abut against an end of the outer tube 150 to axially locate the sleeve 456 relative to the outer tube 150. In some embodiments, the terminal wall 364 of the first outer bushing 186 may be removed to axially locate the sleeve 456 relative to the outer tube 150. The flange 468 may have a substantially cylindrical outer surface. The sleeve 456 may be radially positioned between the outer tube 150 and the cylindrical protrusion 470 of the left end cap 110.

Referring to FIG. 9, the retention features 192 of the outer tube 150 may snugly receive the ribs 466 of the sleeve 456. As shown in dashed lines in FIG. 9, when the sleeve 456 is engaged with the outer tube 150, the ribs 466 may be snugly received between the shelves 194 and the circumferential wall 196 of the outer tube 150 to prevent relative rotational movement between the sleeve 456 and the outer tube 150. In some embodiments, the ribs 466 of the sleeve 456 may circumferentially align with the axial projections 190 of the first outer bushing 186. In such embodiments, the ribs 466 of the sleeve 456 and the axial projections 190 of the first outer bushing 186 may be received within the same retention features 192. In some embodiments, the sleeve 456 may be attached to the first outer bushing 186 so that the sleeve 456 rotates in unison with the first outer bushing 186 and the outer tube 150 about the rotation axis of the inner and outer tubes 140, 150. In such embodiments, the lift assist 454 may engage the outer tube 150 indirectly through engagement of the first outer bushing 186 with the outer tube 150. In some embodiments, the sleeve 456 and the first outer bushing 186 may be formed as a unitary structure.

With reference to FIG. 54, the biasing spring 458 may be received within an internal cavity 472 of the sleeve 456. The biasing spring 458 may be radially positioned between the body 464 of the sleeve 456 and a stationary shaft 474, which may be attached to the left end cap 110. The biasing spring 458 may be axially positioned between the left end cap 110 and an inwardly-projecting end wall 476 of the sleeve 456. In some embodiments, the second end 462 of the biasing spring 458 may be attached to the stationary shaft 474. In some embodiments, as the sleeve 456 rotates in unison with the outer tube 150, the first end 460 of the biasing spring 458 may rotate or twist about the rotation axis and wind or unwind the biasing spring 458. When the sleeve 456 is in a first rotational position (e.g., when the shade 106 is fully retracted), the biasing spring 458 may be fully unwound. When the sleeve 456 is in a second rotational position (e.g., when the shade 106 is fully extended), the biasing spring 458 may be fully wound and may bias the sleeve 456 towards the first rotational position. The sleeve 456 may be biased to automatically return to the first rotational position absent an external force rotating the sleeve 456 towards the second rotational position. Rotation of the sleeve 456 in the shade extension direction may wind the biasing spring 458, and rotation of the sleeve 456 in the shade retraction direction may unwind the biasing spring 458.

With reference to FIGS. 1-3A, 53, and 54, during extension of the shade 106, the sleeve 456 may rotate about the rotation axis in the shade extension direction from the first rotational position to the second rotational position. During rotation of the sleeve 456 in the shade extension direction, the biasing spring 458 may store mechanical energy biasing the sleeve 456 towards the first rotational position. Absent an external force rotating the sleeve 456 towards the second rotational position, the biasing spring 458 may bias the sleeve 456 to rotate in the shade retraction direction towards the first rotational position. Because the sleeve 456 rotates in unison with the outer tube 150, biasing of the sleeve 456 towards the second rotational position also biases the outer tube 150 to rotate in the shade retraction direction. In some embodiments, the stored mechanical energy in the biasing spring 458 may induce a rotational force on the outer tube 150 counteracting at least a portion of the weight of the shade 106 and the weight of the operating elements 108 to reduce an operating force needed to rotate the outer tube 150 in the shade retraction direction and lift the shade 106 and the second portions 318 of the operating elements 108 toward the fully retracted position. In some embodiments, the rotational force may be equal to or less than the weight of the shade 106 and the weight of the operating elements 108. In some embodiments, the rotational force may vary with rotational distance away from the first rotational position. For example, the rotational force may increase as the shade 106 and the operating elements 108 are extended over the architectural opening to account for the increased weight of both the shade 106 and the operating elements 108 suspended off of the outer tube 150. Because the lift assist 454 provides a rotational force on the outer tube 150, resistance is not felt by a user when rotating the inner tube 140 relative to the outer tube 150 to retract the operating elements 108 through the slot 160 and open the strips of material 116.

Retraction of the shade 106 may be accomplished in reverse order as compared to the extension sequence described above. The retraction process generally involves actuation of the drive mechanism 134 to rotate the dual tube unit 138 in substantially the same manner as discussed above. In particular, actuation of the drive mechanism 134 may at least partially drivingly rotate the dual tube unit 138 in the shade retraction direction to retract the shade 106 and the second portions 318 of the operating elements 108 onto the outer tube 150. Because the lift assist 454 is biased to rotate in the shade retraction direction, the lift assist 454 provides a rotational force on the outer tube 150 in the shade retraction direction to decrease the amount of rotational force needed by the drive mechanism 134 to retract the shade 106 and operating elements 108 onto the outer tube 150.

While described herein with reference to the shade 106 being wrapped about the outer tube 150, it is contemplated that the shade 106 may also stack or fold onto itself without departing from the spirit of the invention. In such embodiments, stacking of the shade 106 may be facilitated by the outer tube 150, such as, for example, wrapping at least one lift cord about the outer tube 150. Thus, various types of shade configurations may be utilized as described above.

The foregoing description has broad application. While the provided examples describe a shade having spaced apart strips of material that move with respect to a sheer panel to vary light transmission through the shade, it should be appreciated that the concepts disclosed herein may equally apply to many types of shades. Accordingly, the discussion of any embodiment is meant only to be explanatory and is not intended to suggest that the scope of the disclosure, including the claims, is limited to these examples. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation.

The term "a" or "an" entity, as used herein, refers to one or more of that entity. As such, the terms "a" (or "an"), "one or more" and "at least one" can be used interchangeably herein.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. A lock mechanism arranged and configured to be used with an architectural-structure covering including a rotatable outer tube and a rotatable inner tube located at least partially within the outer tube, said lock mechanism selectively restricting rotation of the outer tube relative to the inner tube, said lock mechanism comprising:

a locking element located at least partially within the inner tube and operably associated with the outer tube, wherein said locking element is movable between a first position that permits rotation of the outer tube and a second position that restricts rotation of the outer tube; and a limit nut configured to displace said locking element from said first position to said second position.

2. The lock mechanism of claim 1, wherein said locking element is moved from the first position to the second position once a shade coupled to the outer tube reaches a fully extended position so that the outer tube is unaffected by continued rotation of the inner tube.

3. The lock mechanism of claim 1, wherein said locking element is axially, slidably movable between said first and second positions.

4. The lock mechanism of claim 1, wherein said lock mechanism is coupleable to an end cap of the architectural-structural covering.

5. The lock mechanism of claim 1, further comprising:

a limit screw having a cavity therein for receiving at least a portion of said locking element; and a biasing spring;

wherein said limit nut is threadedly engaged with, and travelable axially along, said limit screw.

6. The lock mechanism of claim 5, wherein said biasing spring is configured to bias said locking element towards said first position.

7. The lock mechanism of claim 5, wherein said limit screw, said limit nut, and said locking element are located within the inner tube.

8. The lock mechanism of claim 5, wherein said limit screw includes an aperture extending from a periphery thereof into said cavity for receiving a corresponding protrusion of said locking element to substantially retain said locking element in said cavity.

9. The lock mechanism of claim 5, wherein said locking element includes a main body having a recess for receiving at least a portion of said biasing spring.

10. The lock mechanism of claim 9, wherein said recess includes an upwardly sloping ramp transitioning from a bottom wall of said recess towards an interior surface of said locking element.

11. The lock mechanism of claim 9, wherein said recess includes a retention feature for securing said biasing spring at least partially within said recess.

12. The lock mechanism of claim 9, wherein said biasing spring includes a first end and a second end, said second end abutting an end wall of said recess, said first end extending external to said recess.

13. The lock mechanism of claim 12, wherein said first end of said biasing spring contacts an abutment feature within said cavity of said limit screw.

14. The lock mechanism of claim 5, wherein said locking element includes an extension having an end portion for contacting said limit nut.

15. The lock mechanism of claim 14, wherein said extension is thinner than said main body thereby defining a retention wall at an intersection of said extension and said main body.

16. The lock mechanism of claim 15, wherein said limit screw includes an abutment wall for contacting said retention wall of said locking element to limit axial displacement of said locking element.

17. The lock mechanism of claim 16, wherein said biasing spring is configured to bias said abutment wall of said limit screw into contact with said retention wall of said locking element.

18. The lock mechanism of claim 5, further comprising:
an internal bushing; and
an outer bushing having a stop aperture therein, the stop aperture being adapted to receive a portion of said locking element.

19. The lock mechanism of claim 18, wherein said locking element moves through said cavity to contact said stop aperture in said outer bushing in said second position to prevent rotation of said outer tube.

20. The lock mechanism of claim 18, wherein said limit screw includes a threaded portion and an unthreaded portion.

21. The lock mechanism of claim 20, wherein a lower limit stop for the shade is positioned at an intersection of said threaded and unthreaded portions, said cavity being positioned diametrically opposite to said lower limit stop.

22. The lock mechanism of claim 20, wherein said cavity extends along said unthreaded portion of said limit screw to a terminal end of said limit screw, said cavity opening towards said outer bushing.

23. The lock mechanism of claim 20, wherein said internal bushing is rotatably mounted on said unthreaded portion of said limit screw, said internal bushing contacting an inner surface of said inner tube so that said internal bushing rotates in unison with said inner tube about said unthreaded portion of said limit screw.

24. The lock mechanism of claim 23, wherein said outer bushing is rotatably mounted on said internal bushing, said outer bushing contacting an inner surface of said outer tube so that said outer bushing rotates in unison with said outer tube about said internal bushing.

25. The lock mechanism of claim 18, wherein said portion of said locking element is positioned at an end thereof, said portion being configured to be received within said stop aperture when said locking element is in said second position.

26. The lock mechanism of claim 25, wherein insertion of said portion into said stop aperture prevents rotation of said outer bushing, thereby preventing rotation of said outer tube.

27. A method for retracting and extending an architectural-structural covering including a rotatable outer tube, a shade coupled to said outer tube, and a rotatable inner tube received within said outer tube; said method comprising:
rotating said inner and outer tubes in unison in a shade extension direction until said shade is in a fully extended position;
displacing a locking element from a first position to a second position to restrict rotation of the outer tube, said locking element moving from said first position to said second position once said shade reaches said fully extended position; and
rotating said inner tube relative to said outer tube in said shade extension direction to move operating elements with respect to said shade to open strips of material associated with said shade.

28. The method of claim 27, further comprising:
rotating said inner tube in a shade retraction direction causing said operating elements to move with respect to said shade to close said strips of material;
displacing said locking element from said second position to said first position to enable rotation of said outer tube; and
rotating said inner and outer tubes in unison during retraction of said shade.

29. The method of claim 27, wherein, when in said fully extended position, a limit nut contacts said locking element to displace said locking element to said second position.

30. The method of claim 29, wherein, when in said second position, said locking element contacts an outer bushing for fixing a position of the outer tube so that continued rotation of said inner tube moves said inner tube relative to said outer tube.

31. The method of claim 30, wherein during extension of said shade, a user actuates a drive mechanism causing said inner tube to rotate in a shade extension direction causing said outer tube and said limit nut to rotate in said shade extension direction so that said limit nut travels axially along a limit screw towards said locking element.

32. A lock mechanism arranged and configured to be used with an architectural-structure covering including a rotatable outer tube and a rotatable inner tube located at least partially within the outer tube, said lock mechanism selectively restricting rotation of the outer tube relative to the inner tube, said lock mechanism comprising:
a locking element located at least partially within the inner tube and operably associated with the outer tube, wherein said locking element is axially, slidably movable between a first position that permits rotation of the outer tube and a second position that restricts rotation of the outer tube.

33. The lock mechanism of claim 32, wherein said locking element is moved from the first position to the second position once a shade coupled to the outer tube reaches a fully extended position so that the outer tube is unaffected by continued rotation of the inner tube.

34. The lock mechanism of claim 32, further comprising a limit nut configured to displace said locking element from said first position to said second position.

35. The lock mechanism of claim 32, wherein said lock mechanism is coupleable to an end cap of the architectural-structural covering.

36. The lock mechanism of claim 34, further comprising:

a limit screw having a cavity therein for receiving at least a portion of said locking element; and a biasing spring;

wherein said limit nut is threadedly engaged with, and travelable axially along, said limit screw.

37. The lock mechanism of claim 36, wherein said biasing spring is configured to bias said locking element towards said first position.

38. The lock mechanism of claim 36, wherein said limit screw, said limit nut, and said locking element are located within the inner tube.

39. The lock mechanism of claim 34, wherein said locking element includes an extension having an end portion for contacting said limit nut.

40. The lock mechanism of claim 39, wherein said extension is thinner than said main body thereby defining a retention wall at an intersection of said extension and said main body.

41. The lock mechanism of claim 40, wherein said limit screw includes an abutment wall for contacting said retention wall of said locking element to limit axial displacement of said locking element.

42. The lock mechanism of claim 41, wherein said biasing spring is configured to bias said abutment wall of said limit screw into contact with said retention wall of said locking element.

43. The lock mechanism of claim 32, wherein said locking element includes a main body having a recess for receiving at least a portion of a biasing spring.

44. The lock mechanism of claim 43, wherein said recess includes an upwardly sloping ramp transitioning from a bottom wall of said recess towards an interior surface of said locking element.

45. The lock mechanism of claim 43, wherein said recess includes a retention feature for securing said biasing spring at least partially within said recess.

46. The lock mechanism of claim 43, wherein said biasing spring includes a first end and a second end, said second end abutting an end wall of said recess, said first end extending external to said recess.

47. The lock mechanism of claim 46, wherein said first end of said biasing spring contacts an abutment feature within said cavity of said limit screw.

* * * * *